United States Patent [19]

Kuse et al.

[11] Patent Number: 4,828,970

[45] Date of Patent: May 9, 1989

[54] METHOD FOR PROCESSING A LIGHT-SENSITIVE SILVER HALIDE COLOR PHOTOGRAPHIC MATERIAL BY CONTROLLING THE PH VALUE OF THE BLEACH FIXING SOLUTION

[75] Inventors: Satoru Kuse; Shigeharu Koboshi, both of Hino, Japan

[73] Assignee: Konishiroku Photo Industry Co., Ltd., Tokyo, Japan

[21] Appl. No.: 38,834

[22] Filed: Apr. 15, 1987

[30] Foreign Application Priority Data

| | | | |
|---|---|---|---|
| Apr. 18, 1986 | [JP] | Japan | 61-91088 |
| Apr. 20, 1986 | [JP] | Japan | 61-90786 |
| Apr. 22, 1986 | [JP] | Japan | 61-92934 |
| Apr. 22, 1986 | [JP] | Japan | 61-92935 |
| Apr. 22, 1986 | [JP] | Japan | 61-92937 |

[51] Int. Cl.[4] ..... G03C 1/02; G03C 7/16; G03C 7/00

[52] U.S. Cl. ..... 430/393; 430/337; 430/376; 430/384; 430/385; 430/386; 430/387; 430/388; 430/389; 430/430; 430/435; 430/567

[58] Field of Search ..... 430/430, 393, 337, 376, 430/384, 385, 386, 387, 388, 389, 435, 567

[56] References Cited

U.S. PATENT DOCUMENTS

| | | | |
|---|---|---|---|
| 3,293,036 | 12/1966 | Meckl et al. | 430/466 |
| 3,929,484 | 12/1975 | Ross | 430/472 |
| 3,973,968 | 8/1976 | Fujiwahra et al. | 430/389 |
| 4,022,620 | 5/1977 | Okumura et al. | 430/389 |
| 4,409,324 | 10/1983 | Ishikawa et al. | 430/566 X |
| 4,465,762 | 8/1984 | Ishikawa et al. | 430/487 X |
| 4,565,774 | 1/1986 | Kajiwara et al. | 430/489 X |

FOREIGN PATENT DOCUMENTS

| | | |
|---|---|---|
| 50-123342 | 9/1975 | Japan . |
| 50-136031 | 10/1975 | Japan . |
| 51-10783 | 4/1976 | Japan . |
| 51-102636 | 9/1976 | Japan . |
| 56-18939 | 5/1981 | Japan . |
| 56-64339 | 6/1981 | Japan . |
| 57-144547 | 9/1982 | Japan . |
| 58-50534 | 3/1983 | Japan . |
| 58-50535 | 3/1983 | Japan . |
| 58-50536 | 3/1983 | Japan . |
| 58-95345 | 6/1983 | Japan . |
| 58-95736 | 6/1983 | Japan . |
| 58-184142 | 10/1983 | Japan . |
| 60-19140 | 1/1985 | Japan . |
| 62-65040 | 3/1987 | Japan . |
| 23334 | 8/1987 | Japan . |
| 1131335 | 10/1968 | United Kingdom . |

*Primary Examiner*—Mukund J. Shah

*Attorney, Agent, or Firm*—Finnegan, Henderson, Farabow, Garrett & Dunner

[57] ABSTRACT

There is disclosed a method for processing a light-sensitive silver halide color photographic material in which a light-sensitive silver halide color photographic material having at least one silver halide emulsion layer is exposed imagewise to light and then subjected to processing including at least a color development treatment or a color development treatment followed by a bleach-fixing treatment, the improvement wherein said at least one silver halide emulsion layer is a silver halide emulsion layer in which not less than 80 mole % of the total silver halide in the layer is silver chloride and the pH value of the bleach-fixing solution used in said bleach-fixing treatment is in the range of 4.5 to 6.8.

8 Claims, No Drawings

METHOD FOR PROCESSING A LIGHT-SENSITIVE SILVER HALIDE COLOR PHOTOGRAPHIC MATERIAL BY CONTROLLING THE PH VALUE OF THE BLEACH FIXING SOLUTION

BACKGROUND OF THE INVENTION

This invention relates to a method for processing a light-sensitive silver halide color photographic material. More particularly, the present invention relates to a method for processing a light-sensitive silver halide color photographic material, which enables quick processing and generates little stain caused in a bleach-fixing step and which can provide improved processing stability in quick processing.

Recently, it has been desired, in the industry, to develop a technology which enables quick processing of a light-sensitive silver halide color photographic material and can provide stable or constant photographic performance of a processed photographic material.

Namely, a light-sensitive silver halide color photographic material is subtracted to running treatment by using an automatic developing machine provided in each laboratory for development. As a part of improved services for users or customers, it is required that a photograph should be printed and returned to a user or a customer within the day when a light-sensitive silver halide color photographic material to be developed is received. Recently, it is required even to return a printed material within several hours after receipt of a light-sensitive silver halide color photographic material to be developed. Thus, it has been in a hurry to develop a technology which enables quicker processing.

The prior art technologies concerning quick processing of a light-sensitive silver halide color photographic material may be classified roughly into the following art:

(1) technology relying upon the improvement of a light-sensitive silver halide color photographic material;

(2) technology relying upon physical means at the time of development processing; and (3) technology relying upon the improvement of the composition of a processing solution used for development processing.

As concerns the above-mentioned art (1), there have been developed, specifically, (1) a technology which has improved the composition of a silver halide (see, for example, a technology of forming fine grains of a silver halide as described in Japanese Provisional Patent Publication (KOKAI) No. 184142/1983, and a technology of reducing the silver bromide content in a silver halide as described in Japanese Patent Publication (KOKOKU) No. 18939/1981; (2) a technology of using an additive (see, for example, a technology in which an 1-aryl-3-pyrazolidone having a specified structure as described in KOKAI No. 64339/1981 is added to a light-sensitive silver halide color photographic material and a technology in which a 1-arylpyrazolidone as described in KOKAI Nos. 144547/1982, 50534/1983, 50535/1983 and 50536/1983 is added to a light-sensitive silver halide color photographic material); (3) a technology using a coupler having a rapid reactivity (see, for example, a technology using a yellow coupler having rapid reactivity as described in KOKOKU No. 10783/1976, and KOKAI Nos. 123342/1975 and 102636/1976); and (4) a technology for providing a thinner film or layer which constitutes a photographic material [see, for example, a technology for providing a thinner film or layer which constitutes a photographic material as described in KOKAI No. 65040/1987 (Japanese Patent Application No. 65040/1987)].

As to the above-mentioned art (2), there is a technology of stirring a processing solution (see, for example, a technology of stirring a processing solution as described in Japanese Patent Application No. 23334/1986).

As to the above-mentioned art (3), there have been known (1) a technology using a development accelerator, (2) a technology of concentrating or thickening a color developing agent, (3) a technology of lowering the halide ion (particularly, bromide ion) concentration in a processing solution, and so on.

Basically, the processing of a light-sensitive material includes two steps, i.e., a color development step and a desilverization step. The desilverization step includes a bleaching step and a fixing step or a bleach-fixing step. As additional processing steps other than the above, there may be added a rinsing treatment, a stabilizing treatment, a water-washing step or a stablizing step replacing the water-washing step and so on.

In color development, an exposed silver halide is reduced to silver and, at the same time, an oxidized aromatic primary amine series color developing agent is reacted with a coupler to form a dye. In the course of the reaction, halide ions which have been formed by the reaction of silver halides are dissolved into a developing solution and accumulated therein. Further, components such as a development inhibitor which have been contained in a light-sensitive material may also be dissolved out into a color developing solution and accumulated therein.

In the desilverization step, silver formed by the development is bleached by an oxidizing agent and then all the silver salts are removed as soluble silver salts by a stabilizing agent from a light-sensitive material.

It should be noted here that there has also been known a single-bath bleach-fixing process which carries out the bleaching step simultaneously with the fixing step.

In cases where a typical light-sensitive material is processed with a single-bath bleach fixing solution immediately after it is subjected to color development, the pH of such a bleach-fixing solution is usually maintained neutral (pH 7.0–7.5) or at a slightly higher value than neutral. In the case of a usual light-sensitive material, when the pH value is low, a Leuco dye is liable to be formed and a trouble which is referred to as so-called leuco dye formation is liable to occur. Therefore, the bleach-fixing solution is kept to be neutral or at a slightly higher pH value.

Among the quick processing technologies as mentioned above, it is the above-mentioned art (1) that is excellent in quick processing ability. And among the art (1), a method of using a light-sensitive silver halide color photographic material containing higher concentration of silver chloride (see, for example, KOKAI Nos. 95345/1983, 19140/1985 and 95736/1983) exhibits excellent quick processability.

However, when a light-sensitive silver halide photographic material containing silver halide grains having high concentration of silver chloride is subjected to continuous processing in a single-bath bleach-fixing solution having a pH value of 7.0–7.5 or of slightly higher value as in the case of a light-sensitive silver halide color photographic material comprising principally silver bromide, various components in a color developing solution are liable to accumulate in the bleach-fixing solution and hence stain is liable to occur on a processed light-sensitive material (referred to as "BF-stain" hereinafter).

Recently, there have progressed a technology of reducing the amount of a replenishing solution for a bleach-fixing solution and a technology of regenerating it in higher percentage from a view point of economy in the processing and reduction in amount of a waste processing solution. As the result, accumulation of various components in a color developing solution, in a bleach-fixing solution, is liable to increase and thus the problems of BF-stain and others have become remarkable.

In the present situation, these problems can not be solved only by such technologies as those known to the art, for example, those disclosed in KOKAI No. 136031/1975, and U.K. Pat. No. 1,131,335 and U.S. Pat. No. 3,293,036.

Further, according to the method of regeneration or the method of supplying smaller amount of concentrated replenishing solution, the composition of a processing solution may easily be influenced remarkably by evaporation and regenerating operation. The composition may also differ remarkably depending upon the amount of exposed photographic materials to be processed as well as the amount of evaporated processing solution and the amount of the replenishing solution. In particular, the amount of exposed photographic materials in a laboratory differs remarkably between at the beginning of a week when larger amount thereof is ordered to be developed by customers and at a week end when the amount of order decreases; and between at a high-season and at an off-season, the difference of the amounts appearing as a ratio of 1:5 at the maximum. Under such circumstances, such a photographic performance as fog becomes unstable.

Although it can not be said that there has not been any occurrence of BF-stain in a usual light-sensitive photographic material containing silver bromide as a main component, it has been found that this phenomenon becomes a serious problem in the case of a light-sensitive photographic material for the use of quick processing containing silver chloride as a main component.

It may be consided that the BF-stain is caused after a color developing agent itself is passed into the bleach-fixing bath and becomes an oxidized form such as a quinonediimine produced by an oxidizing agent such as ethylenediaminetetraacetic acid iron complex (EDTA-Fe) in the bleach-fixing bath and then the oxidized form is reacted in the bleach-fixing bath with a coupler in the light-sensitive color photographic material. Particularly, the BF-stain may remarkably be generated when the sulfite ion concentration in the color developing solution is low.

As a result of the present inventor's extensive study to solve the above-mentioned problems, the present inventors have found that the above-mentioned problems can be solved by subjecting a light-sensitive silver halide color photographic material including a silver halide emulsion layer containing at least a certain amount of silver chloride to color development followed by processing in a combined bleach-fixing solution (or bath) having a certain range of pH values, and have accomplished the present invention.

Although there may be a problem that there is a possibility of occurrence of leuco dye formation phenomenon when the pH value of a bleach-fixing bath is low, if a light-sensitive silver halide color photographic material including a silver halide emulsion layer containing at least a certain proportion (80 mole % or more) of silver chloride is subjected to color development followed by processing with a bleach-fixing bath having a lower pH value of 4.5–6.8, then not only the leuco dye formation does not occur, but also BF-stain is difficult to occur even when various components in a color developing solution are accumulated by the continuous processing in a bleach-fixing bath, because of the rapid development rate of silver chloride.

Further, the development rate may further be enhanced by reducing the sulfite ion ($SO_3^{2-}$) concentration according to the above-mentioned art [3].

Furthermore, it was found that, by incorporating the color developing solution with an alkanol amine, the fog caused in the bleach-fixing solution could be suppressed and the generation of fog could be reduced even in the case when smaller amount of a replenishing bleach-fixing solution was supplied.

In addition, it was found that the above-mentioned BF-stain may further be reduced by using, as the color developing agent, a p-phenylenediamine series color developing agent, particularly a water-soluble p-phenylenediamine series color developing agent; and that even if BF-stain is caused less amount of the stain may be visualized in appearance by incorporating the color developing solution with a triazine series fluorescent-brightening agent.

Furthermore, it was found that the incorporation of a specific magenta coupler, a specific cyan coupler or a combination thereof in at least one layer of the silver halide emulsion layers in the light-sensitive silver halide color photographic material would enhance the stability during storage of the color developing solution, reduce the BF-stain caused by the bleach-fixing solution and provide an excellent photographic property at the maximum color density.

SUMMARY OF THE INVENTION

The first object of the present invention is to provide an improved method for processing a light-sensitive silver halide color photographic material in which the light-sensitive silver halide color photographic material uses a silver halide of high silver chloride content to provide a rapid developability and which provides little BF-stain caused by the bleach-fixing step.

The second object of the present invention is to provide a method for processing a light-sensitive silver halide color photographic material which provides little fog in a bleach-fixing solution, in particular, even in a bleach-fixing solution which is replenished with a small amount of a replenishing solution.

The third object of the present invention is to provide a method for processing a light-sensitive silver halide color photographic material which has improved the processing stability.

Other objects of the present invention will be apparent in the hereinafter provided description of the specification.

The present invention is a method for processing a light-sensitive silver halide color photographic material in which a light-sensitive silver halide color photographic material having at least one silver halide emulsion layer is exposed imagewise to light and then subjected to processing including at least a color development treatment or a color development treatment followed by a bleach-fixing treatment, the improvement wherein said at least one silver halide emulsion layer is a silver halide emulsion layer in which not less than 80 mole % of the total silver halide in the layer is silver chloride and the pH value of the bleach-fixing solution used in said bleach-fixing treatment is in the range of 4.5 to 6.8.

DESCRIPTION OF THE PREFERRED EMBODIMENTS

The present invention will be explained below in more detail.

The pH value of the bleach-fixing solution employed in the method of the present invention is in the range of 4.5 to 6.8, preferably of 5.0 to 6.3.

The adjustment of the pH value of the bleach-fixing solution may be carried out by using, for example, ammonia water, potassium carbonate, sodium carbonate, sodium hydroxide, and potassium hydroxide.

While the sulfite ion concentration in the color developing solution used in the method according to the present invention is not critical, it may preferably be not more than $2\times10^{-2}$ mole/l, more preferably $4\times10^{-3}$ mole/l in order to attain quicker processing.

As a source for the sulfite ion according to the present invention, there may be mentioned such a sulfite salt as sodium sulfite, potassium sulfite, sodium bisulfite, potassium bisulfite and so on.

In the method of the present invention, it may be preferable to incorporate the color developing solution with an alkanol amine represented by the following formula (1):

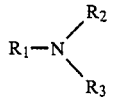

(I)

wherein $R_1$ represents a hydroxyalkyl group having 2 to 6 carbon atoms; $R_2$ and $R_3$ each represent a hydrogen atom, an alkyl group having 1 to 6 carbon atoms, a hydroxyalkyl group having 2 to 6 carbon atoms, a benzyl group or a group of

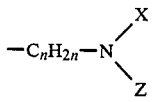

(in which n is an integer of 1 to 6, and X and Z each represent a hydrogen atom, an alkyl group having 1 to 6 carbon atoms or a hydroxyalkyl group having 2 to 6 carbon atoms), in order to prevent also the occurrence of stain caused during the bleach-fixing step when heavy metal ions are included in the color developing solution.

The effect of said alkanolamine may remarkably be exhibited particularly when the sulfite ion concentration in the color developing solution is not more than $4\times10^{-3}$ mole/l preferable not more than $2\times10^{-3}$ mole/l.

While it has been known in KOKAI No. 3532/1979 that an alkanolamine is added to a color developing solution for the purpose of inhibiting air oxidation, it is surprising to have found that, even in the case when a light-sensitive material having higher content of silver chloride is processed with a color developing solution having an extremely low concentration of sulfite ion, the use of the compound represented by formula (I) would enable prevention of a color developing agent from becoming unstable due to contamination with such a heavy metal ion as iron and copper ions, namely prevention of bleach-fogging phenomenon caused by the oxidation of the developing agent.

Of the compound represented by the above mentioned general formula (I) according to the present invention, the compound represented by the below-mentioned general formula (II) may preferably be employed from the stand point of attaining more effectively the object of the present invention and obtaining more efficiently the effect of the present invention.

General formula (II)

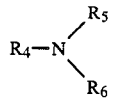

(II)

In the above formula (II), $R_4$ represents a hydroxyalkyl group having 2 to 4 carbon atoms, $R_5$ and $R_6$ each represent an alkyl group having 1 to 4 carbon atoms or a hydroxyalkyl group having 2 to 4 carbon atoms.

Preferred specific examples for the compound represented by the above-mentioned formula (I) are as follows: Ethanolamine (I-1), diethanolamine (I-2), triethanolamine (I-3), diisopropanolamine (I-4), 2-methylaminoethanol (I-5), 2-ethylaminoethanol (I-6), 2-dimethylaminoethanol (I-7), 2-diethylaminoethanol (I-8), 1-diethylamino-2-propanol (I-9), 3-diethylamino-1-propanol (I-10), 3-dimethylamino-1-propanol (I-11), isopropylaminoethanol (I-12), 3-amino-1-propanol (I-13), 2-amino-2-methyl-1,3-propanediol (I-14), ethylenediaminetetraisopropanol (I-15), benzylethanolamine (I-16), 2-amino-2-(hydroxymethyl)-1,3-propanediol (I-17).

The compound represented by the above-mentioned general formula (I) may preferably be employed in an amount ranging from 3 to 100 g, more preferably from 6 to 50 g per one liter of the color developing solution, from the standpoint of attaining the object and obtaining the effect of the present invention.

As the color developing agent used in the color developing solution according to the present invention, there may preferably be used a p-phenylenediamine series compound having a water-soluble group, from the standpoint of attaining the object and obtaining the effect of the present invention.

The p-phenylenediamine series compound having a water-soluble group does not cause less stain on a light-sensitive material and less damage to human skin, thus showing an advantage over a p-phenylenediamine series compound having no water-soluble group such as N,N-diethyl-p-phenylenediamine.

In addition, the p-phenylenediamine series compound according to the present invention may attain the object of the present invention more efficiently when combined with the compound of the above-mentioned formula (I).

As the p-phenylenediamine series compound having a water-soluble group, there may be mentioned those having at least one water-soluble group on the amino group or the benzene nucleus of the p-phenylenediamine series compound. Preferred specific water-soluble groups are as follows:

—$(CH_2)$—$CH_2OH$; —$(CH_2)$—$(CH_2)$—$CH_3$; —$(CH_2)$—O—$(CH_2)$—$CH_3$; —$(CH_2CH_2O)$—$C_mH_{2m+1}$ (wherein m and n each represent an integer of not less than zero); —COOH; and —$SO_3H$.
Exemplified color developing agents, which may be preferred in the present invention, are shown as follows:
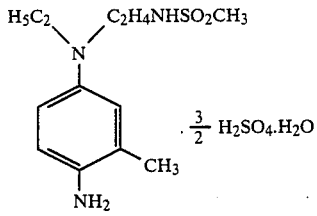
(A-1)
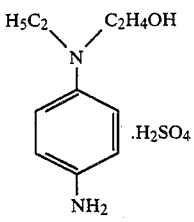
(A-2)
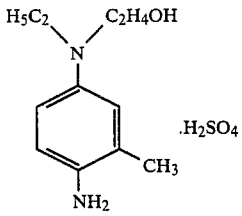
(A-3)
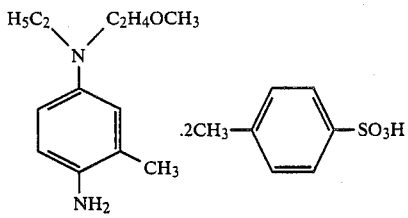
(A-4)
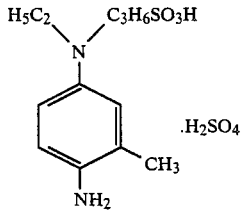
(A-5)
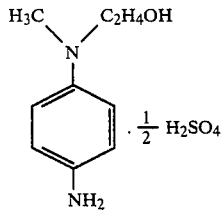
(A-6)
-continued
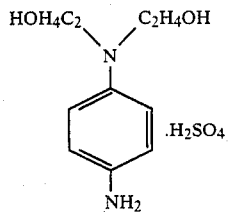
(A-7)
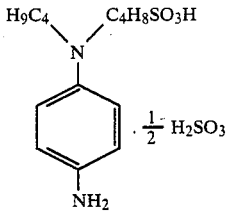
(A-8)
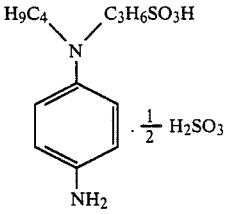
(A-9)
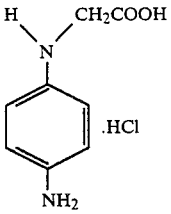
(A-10)
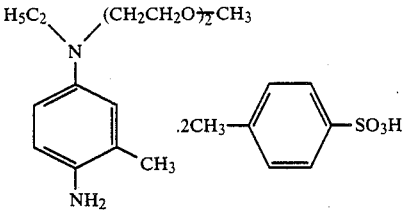
(A-11)
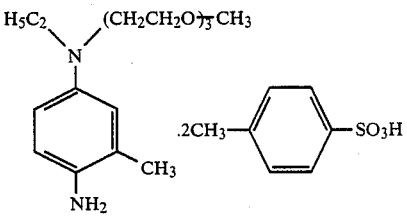
(A-12)
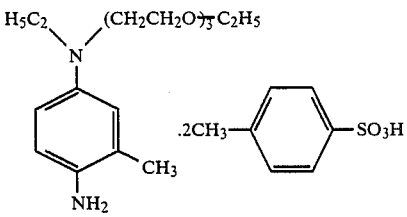
(A-13)

-continued

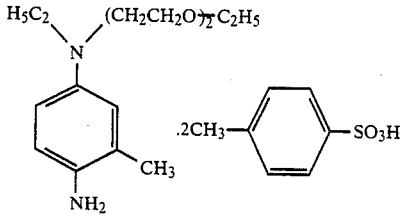

(A-14)

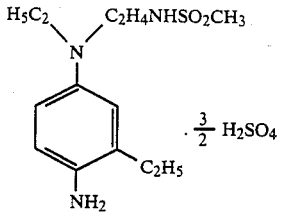

(A-15)

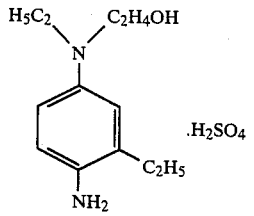

(A-16)

Of the color developing agents as exemplified above, more preferable compounds are Exemplified compounds Nos. (A-1), (A-2), (A-3), (A-4), (A-6), (A-7) and (A-15), with the especially preferred compound being (A-1).

The above-mentioned color developing agent may usually be employed in the form of a salt such as hydrochloride, sulfate, p-toluenesulfonate and the like.

The color developing agent having a water-soluble group as used in the present invention may preferably be employed in an amount of $1\times10^{-2}$ to $2\times10^{-1}$ mole per one liter of the color developing solution, more preferably $1.5\times10^{-2}$ to $2\times10^{-1}$ mole per one liter of the color developing solution from the standpoint of quick processing.

In the present invention, the object of the present invention may effectively be attained by using a triazylstylbene series fluoroescent-brightening agent represented by the below-mentioned general formula (III) in the color developing solution.

General formula (III):

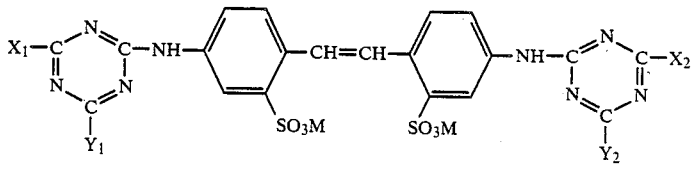

(III)

wherein $X_1$, $X_2$, $Y_1$ and $Y_2$ each represent a hydroxyl group, a halogen atom such as chlorine and bromine, a morpholino group, an alkoxy group (e.g., methoxy, ethoxy, methoxyethoxy), an aryloxy group (e.g., phenoxy, p-sulfophenoxy), an alkyl group (e.g., methyl, ethyl), an aryl group (e.g., phenyl, methoxyphenyl), an amino group, an alkyl amino group (e.g., methylamino, ehtylamino, propylamino, dimethylamino, cyclohexylamino, β-hydroxyethylamino, di(β-hydroxyethyl)amino, β-sulfoethylamino, N-(β-sulfoethyl)-N'-methylamino, N-(β-hydroxyethyl)-N'-methylamino) or an arylamino group (e.g., anilino; o-, m-, p-chloroanilino; o-, m-toluidino; o-, m-, p-carboxyanilino; o-, m-, p-hydroxyanilino; sulfonaphthylamino; o-, m-, p-aminoanilino; o-, m-, p-anidino); M represents a hydrogen atom, a sodium atom, a potassium atom, ammonium or a lithium atom.

More specifically, there may be mentioned the following compounds, which however should not be construed to limit the present invention.

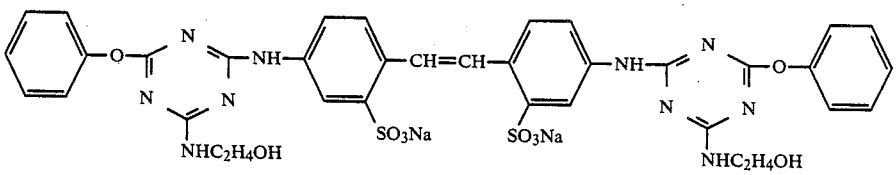

(A'-1)

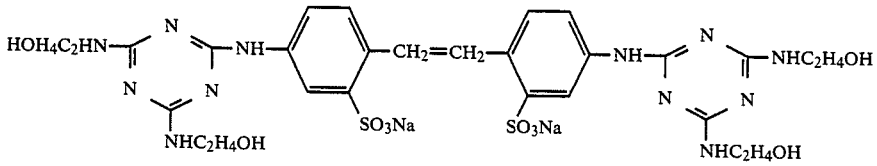

(A'-2)

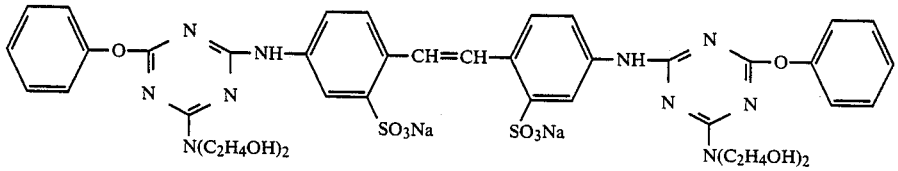

(A'-3)

-continued
(A'-4)
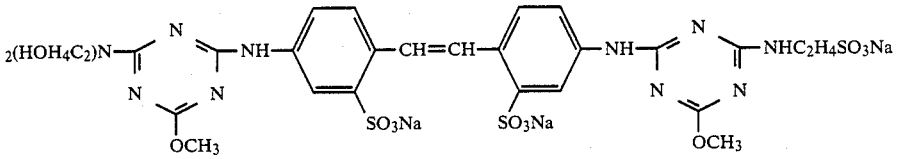
(A'-5)
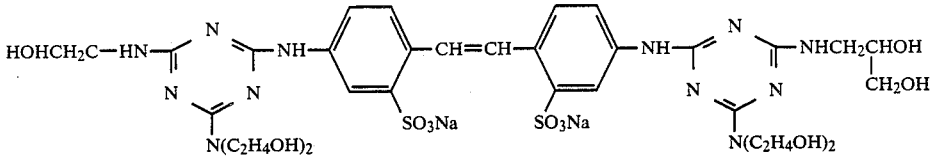
(A'-6)
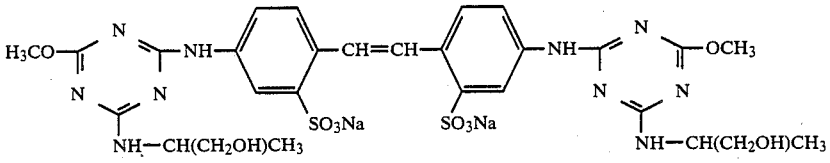
(A'-7)
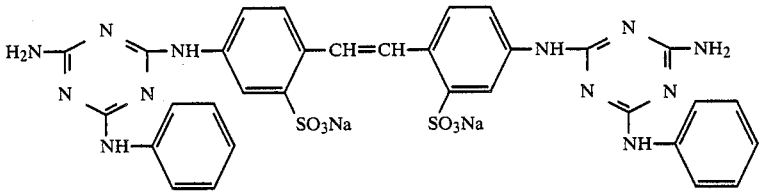
(A'-8)
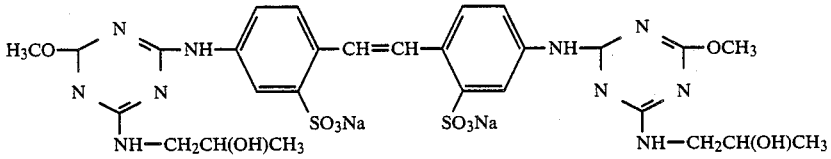
(A'-9)
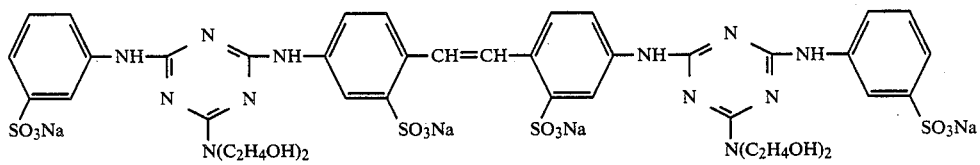
(A'-10)
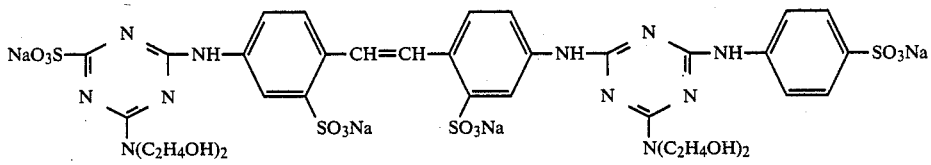
(A'-11)
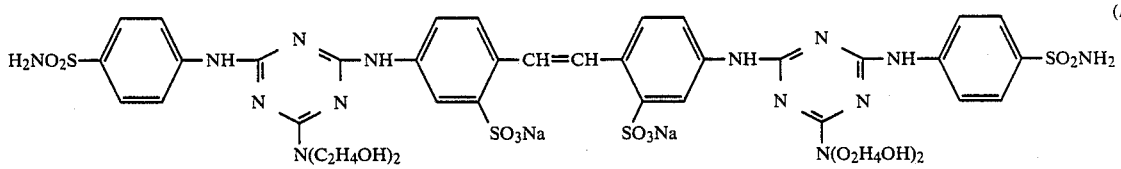
(A'-12)
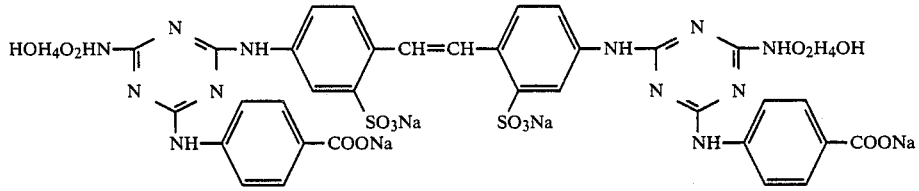

-continued

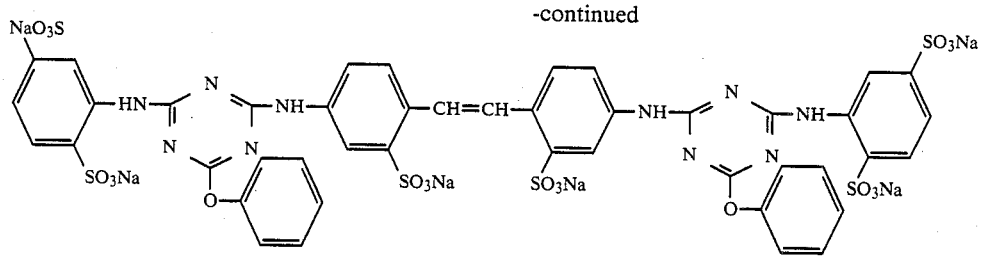

(A'-13)

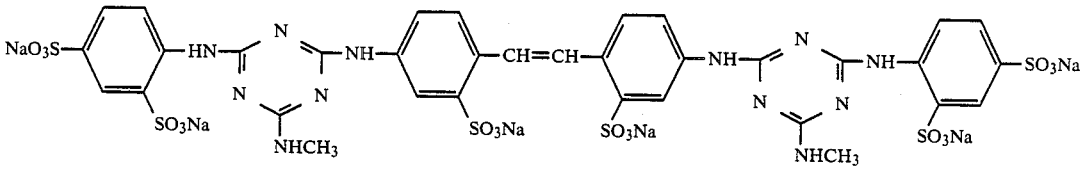

(A'-14)

The triazylstylbene series fluorescent-brightening agent according to the present invention may be synthesized by the conventional method as described in, for example, "Fluorescent-brightening agents", page 8 edited by KASEIHIN-KOGYO-KYOKAI (Chemical product Industries Association, Japan) and published in August, 1976.

The triazylstylbene series fluorescent-brightening agent may preferably be employed in an amount ranging from 0.2 to 6 g, more preferably 0.4 to 3 g per one liter of the color developing agent used in the present invention.

In the color developing agent, there may be incorporated the following additives.

As an alkali agent other than the above-mentioned carbonate salt, there may be used, for example, sodium hydroxide, potassium hydroxide, silicate salts, sodium metaborate, potassium metaborate, trisodium phosphate, tripotassium phosphate and borax alone or in combination, in an amount of a range which does not cause precipitation and which maintains the pH-stabilizing effect.

Further, for the purpose of effective formulation of the color developing solution and of enhancing the ionic strength therein, there may be used various salts such as disodium phosphate, dipotassium phosphate, sodium bicarbonate and a borate salt.

In addition, an inorganic or organic antifogging agent may be added as occasion demands.

If necessary, a development accelerator may also be used. The development accelerator includes various pyridinium compounds described in for example, U.S. Pat. Nos. 2,648,604 and 3,671,247, and KOKOKU No. 9503/1969; other cationic compounds; a cationic dye such as phenosafranine; a neutral salt such as thallium nitrate; a nonionic compound such as polyethylene glycol, its derivatives and polythioethers disclosed in U.S. Pat. Nos. 2,533,990, 2,531,832, 2,950,970 and 2,577,127, and KOKOKU No. 9504/1969; organic solvent and organic amines as described in KOKOKU No. 9509/1969; ethanolamine; ethylenediamine; diethyleneamine; triethanolamine; and so on.

Further, there may be mentioned benzyl alcohol and phenethyl alcohol as disclosed in U.S. Pat. No. 2,304,925, and additionally acetylene glycol, methyl ethyl ketone, cyclohexanone, thioethers, pyridine, ammonia, hydrazine, amines and so on.

In cases when a poorly soluble organic solvent represented by benzyl alcohol is used, tar is liable to be caused in the running treatment adopting a system in which a small amount of replenisher is supplied, due to the use of a color developing solution for a long peried of time. The thus formed tar sticks to a process paper light-sensitive material and damages its commercial value, thus causing a serious problem.

Further, a poorly soluble organic solvent requires troublesome procedure, such as the use of a stirring device, when a color developing solution itself is prepared. Even if such a stirring device is used, its development accelerating effect is limited due to its low solubility.

Furthermore, a poorly soluble organic solvent exhibits a large pollution loading value, such as biochemical oxygen demand (BOD), etc., and it is not permitted to discharge it into sewerage and river. Treatment of waste water has a problem that it requires great deal of labour and cost. Therefor, preferably, the amount of a poorly soluble organic solvent to be used should be reduced to the utmost or it should not be used.

When a compound represented by the following formula (IV):

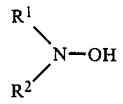

(IV)

(wherein $R^1$ and $R^2$ each represent an alkyl group having 1 to 3 carbon atoms)

is employed, in place of hydroxylamine which has conventionally be used as a preservative, in the color developing solution used in the present invention, the object of the present invention may advantageously be attained; the desired effect of the present invention may better be obtained; and the storage stability of the color developing solution may be improved. Further, since the above-mentioned compound of formula (IV) does not generate silver development which is coused by hydroxylamine when a light-sensitive material of higher silver chloride content is employed, it may preferably be used in the present invention.

In formula (IV), while $R^1$ and $R^2$ each represent an alkyl group having 1 to 3 carbon atoms, $R^1$ and $R^2$ may be the same and defferent and each include, for example, a methyl group, an ethyl group, an n-propyl group and an isopropyl group.

Preferably, both of $R^1$ and $R^2$ represent an ethyl group.

Hereinafter enumerated are specific compounds represented by the above formula (IV), which however should not be construed to limit the present invention.

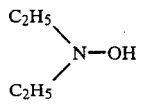
(IV-1)

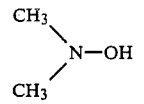
(IV-2)

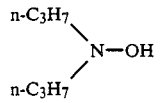
(IV-3)

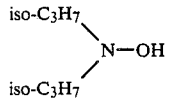
(IV-4)

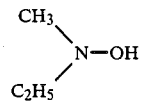
(IV-5)

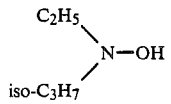
(IV-6)

The compound of formula (IV) may be used in the form of a salt such as hydrochloride, sulfate, p-toluenesulfonate, oxalate, phosphate, acetate and the like.

The concentration of the compound represented by formula (IV) to be used in the color developing solution is approximately the same as in hydroxylamine which has usually been employed as a preservative. Namely, it may preferably be used in an amount of 0.1 g/l to 50 g/l, more preferably 1 g/l to 30 g/l, most preferably 5 g/l to 20 g/l.

In cases where at least one compound selected from the compounds represented by the below mentioned general formula (B-I) or (B-II) is incorporated in the color developing agent used in the present invention, the object of the present invention may better be attained and the effect of the present invention may advantageously be obtained; and, even in case when an organic iron complex (for example, ethylenediaminetetraacetic acid iron (III) complex) in a bleach-fixing bath is admixed inadvertently in the color developing solution at the time when a lack of an automatic development machine is handled, the color developing solution remains stabilized. Accordigly, the compound of formula (B-I) or (B-II) is preferred.

General formula (B-I):

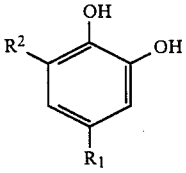

General formula (B-II):

-continued

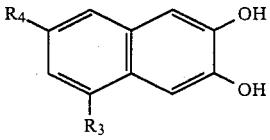

In formula (B-I) and (B-II), $R_1$, $R_2$, $R_3$, and $R_4$ each represent a hydrogen atom, a halogen atom, a sulfonic acid group, an alkyl group having 1 to 7 carbon atoms, $-OR_5$, $-COOR_6$,

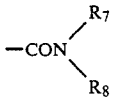

or a phenyl group. Further, $R_5$, $R_6$, $R_7$, and $R_8$ each represent a hydrogen atom or an alkyl group having 1 to 18 carbon atoms. Provided that, when $R_2$ represents —OH or a hydrogen atom, $R_1$ represents a halogen atom, a sulfonic acid group, an alkyl group having 1 to 7 carbon atoms, $-OR_5$, $-COOR_6$,

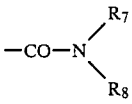

or a phenyl group.

As the alkyl group represented by $R_1$, $R_2$, $R_3$ and $R_4$, there may be mentioned, for example, a methyl group, an ethyl group, an isopropyl group, an n-propyl group, a t-butyl group, a hydroxymethyl group, a hydroxyethyl group, a methylcarboxylic acid group, a benzyl group and so on.

The alkyl group represented by $R_5$, $R_6$, $R_7$, and $R_8$ has the same meaning as in the alove and may further include an octyl group and the like.

The phenyl group represented by $R_1$, $R_2$, $R_3$, and $R_4$ includes a phenyl group, a 2-hydroxyphenyl group, a 4-aminophenyl group and so on.

Representative specific examples of the chelating agent as used in the present invention will be listed below, which should not however be construed to limit the present invention).

(B-I-1) 4-Isopropyl-1,2-dihydroxybenzene
(B-I-2) 1,2-Dihydroxybenzene-3,5-disulfonic acid
(B-I-3) 1,2,3-Trihydroxylbenzene-5-carboxylic acid
(B-I-4) 1,2,3-Trihydroxybenzene-5-carboxymethyl ester
(B-I-5) 1,2,3-trihydroxybenzene-5-carboxy-n-butyl ester
(B-I-6) 5-t-Butyl-1,2,3-trihydroxybenzene
(B-II-1) 2,3-Dihydroxynaphthalene-6-sulfonic acid
(B-II-2) 2,3,8-Trihydroxynaphthalene-6-sulfonic acid
(B-II-3) 2,3-Dihydroxynaphthalene-6-carboxylic acid
(B-II-4) 2,3-Dihydroxy-8-isopropylnaphthalene
(B-II-5) 2,3-Dihydroxy-8-chloronaphthalene-6-sulfonic acid Of the above-enumerated compound, which may particularly preferably be employed in the present invention is 1,2-dihydroxybenzene-3,5-disulfonic acid which may also be used in the form of an alkali metal salt such as a sodium salt on a potassium salt.

In he present invention, the compound represented by formula (B-I) or (B-II) may typically be used in an amount of 5 mg to 20 g, preferably 10 mg to 10 g, more preferably 20 mg to 3 g per one liter of the color developing solution, thus giving a satisfactory result.

The compound of formula (B-I) or (B-II) may be used alone or in combination, or it may be used in combination with other chelating agents such as an aminopolyphosphonic acid, e.g., aminotri (methylenephosphonic acid) and ethylenediaminetetraphophoric acid; an oxycarboxylic acid such as citric and gluconic acid; a phosphonocarboxylic acid such as 2-phosphonobutane-1,2,4-tricarboxylic acid; a polyphosphoric acid such as tripolyphosphoric acid and hexamethaphosphoric acid.

In the color developing solution used in the present invention, there may be used, as occasion demands, ethylene glycol, methyl cellosolve, methanol, acetone, dimethylformamide, β-cyclodextrin and other compounds described in KOKOKU Nos. 33378/1972 and 9505/1969 as organic solvents which enhance the solubility of the developing agent.

Moreover, an auxiliary developing agent may also be employed in combination with the developing agent. As the auxiliary developing agent, there have been known, for example, N-methyl-p-aminophenol hemisulfate (Metol), phenidone, N,N'-diethyl-p-aminophenol hydrochloride and N,N,N'N'-tetramethyl-p-phenylenediamine hydrochloride, which may preferably be added in an amount of 0.01 to 1.0 g/l. In addition, there may further be added, as occasion demands, a competitive coupler, a fogging agent, a colored coupler, a development-inhibitor-releasing coupler (so-called DIR coupler) or a development-inhibitor-releasing compound and so on.

Further, various additives such as other anti-staining agent than those mentioned above, an interlayer effect enhancing agent and so on may also be employed.

The color developing solution may be prepared by adding successively the above-mentioned various components to a predetermined amount of water followed by stirring. In this case, a component having poorer solubility in water may be added after mixed with the above-mentioned organic solvent such as triethanolamine and the like. In general, the color developing agent may be obtained by adding to water each component which has preliminarily been formulated, together with other compatible components, into a concentrated aqueous solution or a solid contained in a small vessel, followed by stirring.

In the present invention, the color developing solution may be used in optional pH range. However, the pH thereof may preferably be in the range of 9.5 to 13.0, more preferably 9.8 to 13.0, from the viewpoint of quick processing.

In the present invention, typical processing temperature for color development is not lower than 30° C. and not higher than 50° C. While higher temperature may be preferred on one hand since the higher the temperature is, the shorter the time required for processing is, not so higher temperature may be preferred on the other hand, from the viewpoint of the stability of an image during stroage. The temperature between 33° and 45° C. may be preferred for processing.

It has been that the development period of time is generally around 3 minutes and 30 seconds. In the present invention, however, it is enabled to carry out the development processing within 2 minutes, even in 30 seconds to 1 minutes and 30 seconds.

The bleaching agent, which may preferably be used in the bleach-fixing solution according to the present invention, is a metal complex of an organic acid. The complex includes those in which a metal ion such as a iron, cobalt and copper ions has coordinated with an organic acid such as an aminopolycarboxylic acid, oxalic acid, citric acid and the like. As the most preferred organic acid to be use for forming such a metal complex of an organic acid, there may be mentioned a polycarboxylic acid. The polycarboxylic acid or the aminopolycarboxylic acid may be in the form of an alkali metal salt, an ammonium salt or a water-soluble amine salt. Specific compounds therefor may includes the following.

1. Ethylenediaminetetraacetic acid
2. Diethylenetriaminepentaacetic acid
3. Ethylenediamine-N-(β-oxyethyl)-N,N',N'-triacetic acid
4. Propylenediaminetetraacetic acid
5. Nitrilotriacetic acid
6. Cyclohexanediaminetetraacetic acid
7. Iminodiacetic acid
8. Hydroxyethylglycinecitric acid
9. Ethyl-ether-diaminetetraacetic acid
10. Glycol-ether-diaminetetraacetic acid
11. Ethylenediaminetetrapropionic acid
12. Phenylenediaminetetraacetic acid
13. Ethylenediaminetetraacetic acid disodium salt
14. Ethylenediaminetetraacetic acid tetra(trimethylammonium) salt
15. Ethylenediaminetetraacetic acod tetraspdoi, salt
16. Diethylenetriaminepentaacetic acid pentasodium salt
17. Ethylenediamine-N-(β-oxyethyl)-N,N',N'-triacetic acid sodium salt
18. Propylenediaminetetraacetic acid sodium salt
19. Nitriloacetic acid sodium salt
20. Cyclohexanediaminetetraacetic acid sodium salt These bleaching agent may peferably be employed in an amount of 5 to 450 g/l, more preferably 20 to 250 g/l, most preferably 25 to 100 g/l.

The bleach-fixing solution according to the present invention may contain, in addition to the bleaching agent as mentioned above, a silver halide fixing agent and optionally a sulfite salt as a preservative. There may also be employed a bleach-fixing solution containing a small amount of a halogenide compound such as ammonium bromide in addition to a bleaching agent comprising an iron (III) complex salt of ethylenediaminetetraacetic acid and the above-mentioned silver halide fixing agent; a bleach-fixing solution incorporated, in contrast to the above, with a large amount of a halogenide compound such as ammonium bromide; a special bleach-fixing solution containing a combination of a bleaching agent comprising an iron (III) complex salt of ethylenediaminetetraacetic acid and a large amount of a halogenide compound such as ammonium bromide; and so on.

The above-mentioned halogenide compound includes, in addition to ammonium bromide, hydrochloric acid, hydrobromic acid, lithium bromide, sodium bromide, potassium bromide, sodium iodide, potassium iodide, ammonium iodide and the like.

As the above-mentioned silver halide fixing agent contained in the bleach-fixing solution, there may be mentioned a compound capable of reacting with such a silver halide as used in an ordinary bleach-fixing processing to form a water-soluble complex salt, the representative of which may include, for example, a thiosulfate salt such as potassium thiosulfate, sodium thiosulfate and ammonium thiosulfate; a thiocyanate salt such as potassium thiocyanate, sodium thiocyanate and ammonium thiocyanate; a thiourea, and a thioether.

These fixing agents may be used in an amount of not less than 5 g/l, a range which may be dissolved completely, generally of 70 to 250 g/l.

To the bleach-fixing solution, there may be added, alone or in combination, various pH buffering agents such as boric acid, borax, sodium hydroxide, potassium hydroxide, sodium carbonate, potassium carbonate, sodium bicarbonate, potassium bicarbonate, acetic acid, sodium acetate, ammonium hydroxide and the like. Furthermore, the bleach-fixing solution may also be incorporated with various fluoresent-brightening agents, anti-foaming agents or surface active agents. Further, it may optionally be incorporated with a preservative such as hydroxylamine, hydrazine and a bisulfite adduct of an aldehyde compound; san organic chelating agent such as an aminopolycarboxylic acid; a stabilizing agent such as a nitroalcohol and a nitrate salt; an organic solvent such as methanol, dimethylsulfonamide and dimethylsulfoxide.

To the bleach-fixing solution used in the present invention, there may be added various kinds of bleaching accelerators as described in KOKAI No. 280/1971, KOKOKU Nos. 8506/1970 and 556/1971, Belgian Pat. No. 770,910, KOKOKU Nos. 8836/1970 and 9854/1978, and KOKAI Nos. 71634/1979 and 42349/1974.

The bleach-fixing solution is used at a temperature of not higher than 80° C., which is lower than that of the color developing bath by 3° C. or more, preferably by 5° C. or more, with the preferred temperature being not higher than 55° C. to suppress evaporation.

In the light-sensitive halide color photographic material applied to the method according to the present invention, the silver halide in at least one layer of silver halide emulsion layers contain not less than 80 mole %, preferably not less than 90%, more preferably not less than 95 mole % of silver chloride.

The above-mentioned silver halide emulsion including silver halide grains which contain 80 mole % or more of silver chloride may contain, as a silver halide component, silver bromide and/or silver iodide in addition of silver chloride. In such a case the amount of silver bromide may typically be not more than 20 mole %, preferably not more than 10 mole %, more preferably not more than 5 mole %. If silver iodide exists, the amount thereof may be not more than 1 mole %, more preferably 0.5 mole % or less.

The crystals of the silver halide grains used in the present invention may be normal crystals, twinned crystals and others, of which the ratio of the face [100] and the face [111] may be optional. The silver halide crystal may take either a crystal structure which is uniform from the inner portion to the outer portion of the crystal or a crystal structure which takes a layered structure (core-shell type) in which the inner portion and the outer portion are not uniform. These silver halide grains may be either a type which forms a latent image mainly on the surface thereof or a type which form it mainly inside the grain.

Further, plate-like silver halide grains [see KOKAI No. 113934/1983 and KOKAI No. 47959/1986 (Japanese patent application No. 47959/1986) may also be employed.

The silver halide grains used in the present invention may be obtained by any method of the acidic process, the nutral process and the ammonia process.

They may also be prepared by way of, for example, a process in which seed grains are prepared by the acidic process and then grown by the ammonia process, which enables speedy growth thereof, to a predetermined crystal size.

In cases where the silver halide grains is to be grown, it is preferred to control the pH value, the pAg value and so on in the reaction vessel and to introduce and admix, successively or simultaneously, amounts of silver ions and halide ions proportional to the growth rate of the silver halide grains.

The preparation of the silver halide grains according to the present invention may preferably be conducted as mentioned above. The composition containing said silver halide grains is referred to as a silver halide emulsion hereinafter in this specification.

The silver halide emulsion may be sensitized chemically by using, alone or in combination, a sulfur sensitizer such as allylthiocarbamide, thiourea and cystine; a selenium sensitizer; a reduction sensitizer such as a stannous salt, thisurea dioxide and a polyamine; a noble metal sensitizer such as a gold sensitizer (specifically, potassium auriothiocyanate, potassium chloroaurate, 2-aurothio-3-methylbenzothiazolium chloride and the like and a sensitizer of a water-soluble salt such as of ruthenium, palladium, platinum, rhodium, irridium and the like (specifically, ammonium chloropalladate, potassium chloroplatinate and potassium chloropalladate) (of which a certain kind thereof functions as a sensitizer or an antifogging agent depending upon the amount thereof to be used). The combination of these sensitizers may be, for example, a combination of a gold sensitizer and a sulfur sensitizer and a combination of a gold sensitizer and a selenium sensitizer.

While the silver halide emulsion according to the present invention may be subjected to chemical ripening after a sulfur-containing compound is added, the emulsion may be incorporated further with at least one kind of hydroxytetraazaindenes and at least one kind of nitrogen-containing heterocyclic compounds having a mercapto group, either before the ripening, during the ripening or after the ripening.

The silver halide used in the present invention may be subjected to optical sensitization (spectral sensitization), in order to afford sensitivity to the desired wave-length region, after an appropriate sensitizing dye is added in an amount of $5\times10^{-3}$ to $3\times10^{-3}$ mole per one mole of the silver halide. The sensitizing dye includes various kinds thereof which may be employed alone or in combination of one or more kinds thereof.

As the sensitizing dye which may advantageously be used in the present invention, there may be mentioned the following.

Namely, the sensitizing dye which may be used for a blue-sensitive silver halide emulsion includes those as disclosed in, for example, German Pat. No. 929,080; U.S. Pat. Nos. 2,231,658, 2,493,748, 2,503,776, 2,519,001, 2,912,329, 3,656,959, 3,672,897, 3,694,217, 4,025,349 and 4,046,572; British Pat. No. 1,242,588; and KOKOKU Nos. 14030/1969 and 24844/1977. The sensitizing dye to be used for a green-sensitive silver halide emulsion includes, as the representative dyes, cyanine dyes, morocyanine dyes and complex cyanine dyes as disclosed in, for example, U.S. Pat. Nos. 1,939,201, 2,072,808, 2,739,149 and 2,945,763; and British Pat. No.

505,979. The sensitizine dye to be used for a red-sensitive silver halide emulsion includes, as the representative dyes, cyanine dyes, merocyanine dyes and complex cyanine dyes as disclosed in, for example, U.S. Pat. Nos. 2,269,234, 2,270,378, 2,442,710, 2,454,6229 and 2,776,280. Further, the cyanine dyes, the merocyanine dyes and the complex cyanine dyes as disclosed in U.S. Pat. Nos. 2,213,995, 2,493,748 and 2,519,001; and German Pat. No. 929,080 may advantageously be employed for the green-sensitive silver halide emulsion or the red-sensitive silver halide emulsion.

These dyes may be used alone or in combination.

The light-sensitive silver halide color photographic material according to the present invention may optionally be optically sensitized to the desired wavelength region by the spectral sensitization using a cyanine dye or a merocyanine dye alone or in combination thereof.

Representative method for spectral sensitization, which is particularly preferred, includes the method described in, for example, KOKOKU Nos. 4936/1968, 22884/1968, 18433/1970, 37443/1972, 28293/1973, 51932/1974 and 12375/1978, and KOKAI Nos. 23931/1977, 51932/1977, 80118/1979, 153926/1983, 116646/1984 and 116647/1984, which relates to a combination of a benzimidazolocarbocyanine and a benzoxazolocarbocyanine.

Inventions relating to a combination of a carbocyanine having a benzimidazole nucleus with other cyanines or mercocyanines includes those as disclosed in KOKOKU Nos. 25831/1970, 11114/1972, 25379/1972, 38406/1973, 38407/1973, 34535/1079 and 1569/1980; and KOKAI Nos. 33220/1975, 38526/1975, 107127/1976, 115820/1976, 135528/1976, 104916/1977, 104917/1977 and so on.

Inventions relating to a combination of a benzoxazolocarbocyanine(oxa.carbocyanine) with other carbocyanines includes those as disclosed in, for example, KOKOKU Nos. 32753/1969 and 11627/1971; and KOKAI No. 1483/1982, and those relating to a merocyanine are disclosed in, for example, KOKOKU Nos. 38408/1973, 41204/1973 and 40662/1975; and KOKAI Nos. 25728/1971, 107503/1983, 91445/1983, 116645/1983 and 33828/1975.

Inventions relating to a combination of a thiacarbocyanine with other carbocyanines includes those disclosed in, for example, KOKOKU Nos. 4932/1968, 4933/1968, 26470/1970, 18107/171 and 8741/1972; and KOKAI Nos. 114533/1974.

Further, the methods using a zeromethine or dimethine merocyanine, a monomethine or trimethine cyanine and a styryl dye, which is disclosed in KOKOKU No. 6207/1974, may advantageously be employed in the present invention.

These sensitizing dyes may be added to the silver halide emulsion according to the present invention as a dye solution in a hydrophilic organic solvent such as methyl alcohol, ethyl alcohol, acetone, dimethylformamide or a fluorinated alcohol disclosed in KOKOKU No. 40659/1975.

The sensitizing dye may be added at any time i.e., either at the beginning of the chemical ripening, during the ripening or after completion of the ripening, of the silver halide emulsion. If desired, it may be added at the step immediately before the coating of the emulsion.

The layer constituting the light-sensitive silver halide color photographic material of the present invention may be incorporated with a water-soluble dye or a dye capable of being decolored (AI dye). The AI dye includes an oxonol dye, a hemioxonol dye, a merocyanine dye and an azo dye, among which an oxonol dye, a hemioxonol dye and a merocyanine dye are particularly useful.

As examples for the AI dye to be employed, there may be mentioned those described in British Patent Nos. 584,609 and 1,277,429; KOKAI Nos. 85130/1973, 99620/1974, 114420/1974, 129537/1974, 108115/1977, 25845/1984, 111640/1984 and 111641/1984; U.S. Pat. Nos. 2,274,782, 2,533,472, 2956,079, 3,125,448, 3,148,187, 3,177,078, 3,247,127, 3,260,601, 3,540,887, 3,575,704, 3,653,905, 3,718,472 4,071,312 and 4,070,352.

The AI dye may preferably be used in an amount of $2\times10^{-3}$ to $5\times10^{-1}$ mole, more preferably $1\times10^{-2}$ to $1\times10^{-1}$ mole, per one mole of silver in the emulsion layer.

The photographic material, which is particularly preferred in carrying out the method of the present invention, is one which contains, in at least one layer of the silver halide emulsion layer thereof, a magenta coupler represented by the following formula (M)

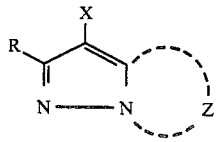

(M)

wherein Z represents a group of non-metallic atoms necessary for forming a nitrogen-containing heterocyclic ring which may be unsubstituted or substituted; X represents a group capable of being released by the reaction with an oxidized product of a color developing agent; and R represents a hydrogen atom or a substituent.

The magenta dye as mentioned above can provide the light-sensitive silver halide color photographic material containing the same therein with an excellent effect particularly when a lower concentration (not more than $2\times10^{-2}$ mole/l, preferably not more than $4\times10^{-3}$ mole/l) of sulfite ions is contained in the color developing solution.

While R is formula(M) represents a hydrogen atom or a substituent, as the substituent represented by R in formula (M), there may be mentioned, for example, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclyloxy group, a siloxy group, an acyloxy group, a carbamoyloxy group, an amino group, an acylamino group, a sulfonamide group, an imide group, an ureido group, a sulfamouylamino group, a alkoxyarbonylamino group, an aryloxycarbonylamino group, an alkoxycarbonyl group, an aryloxycarbonyl group, an alkylthio group, an arylthio group and a heterocyclicthio group.

As halogen atoms, for example, chlorine atom, bromine atom may be used, particularly preferably chlorine atom.

The alkyl group represented by R may include preferably those having 1 to 32 carbon atoms, the alkenyl group or the alkynyl group those having 2 to 32 carbon atoms and the cycloalkyl group or the cycloalkenyl group those having 3 to 12 carbon atoms, particularly 5 to 7 carbon atoms. The alkyl group, alkenyl group or alkynyl group may be either straight or branched.

These alkyl group, alkenyl group, alkynyl group, cycloalkyl group and cycloalkenyl group may also have substituents [e.g. an aryl group, a cyano group, a halogen atom, a heterocyclic ring, a cycloalkyl group, a cycloalkenyl group, a spiro ring compound residual group, a bridged hydrocarbon compound residual group; otherwise those substituted through a carbonyl group such as an acyl group, a carboxy group, a carbamoyl group, an alkoxycarbonyl group and an aryloxycarbonyl group; further those substituted through a hetero atom, specifically those substituted through an oxygen atom such as of a hydroxy group, an alkoxy group, an aryloxy group, a heterocyclicoxy group, a siloxy group, an acyloxy group, a carbamoyloxy group, etc.; those substituted through a nitrogen atom such as of a nitro group, an amino (including a dialkylamino group, etc.), a sulfamoylamino group, an alkoxycarbonylamino group, an aryloxycarbonylamino group, an acylamino group, a sulfonamide group, an imide group, an ureido group, etc.; those substituted through a sulfur atom such as of an alkylthio group, an arylthio group, a heterocyclicthio group, a sulfonyl group, a sulfinyl group, a sulfamoyl group, etc.; and those substituted through a phosphorus atom such as of a phosphonyl group, etc.].

More specifically, there may be included, for example, a methyl group, an ethyl group, an isopropyl group, a t-butyl group, a pentadecyl group, a heptadecyl group, a 1-hexynonyl group, a 1,1'-dipentylnonyl group, a 2-chloro-t-butyl group, a trifluoromethyl group, a 1-ethoxytridecyl group, a 1-methoxyisopropyl group, a methanesulfonylethyl group, a 2,4-di-t-amylphenoxymethyl group, an anilino group, a 1-phenylisopropyl group, a 3-m-butanesulfoneaminophenoxypropyl group, a 3,4'-{α-[4''-(p-hydroxybenzenesulfonyl)-phenoxy]dodecanoylamino} phenylpropyl group, a 3-{4'-[α-(2'',4''-di-t-amylphenoxy)butaneamido]phenyl} propyl group, a 4-[α-(o-chlorophenoxy)tetradecaneamidophenoxy]propyl group, an allyl group, a cyclopentyl group, a cyclohexyl group, and so on.

The aryl group represented by R may preferably be a phenyl group, which may also have a substituent (e.g. an alkyl group, an alkoxy group, an acylamino group, etc.).

More specifically, there may be included a phenyl group, a 4-t-butylphenyl group, a 2,4-di-t-amylphenyl group, a 4-tetradecanemidophenyl group, a hexadecyloxyphenyl group, a 4'-[α-(4''-t-butylphenoxy)tetradecaneamido]phenyl group and the like.

The heterocyclic group represented by R may preferably be a 5- to 7-membered ring, which may either be substituted or fused. More specifically, a 2-furyl group, a 2-thienyl group, a 2-pyrimidinyl group, a 2-benzothiazolyl group, etc. may be mentioned.

The acyl group represented by R may be, for example, an alkylcarbonyl group such as an acetyl group, a phenylacetyl group, a dodecanoyl group, an α-2,4-di-t-amylphenoxybutanoyl group and the like; an arylcarbonyl group such as a benzoyl group, a 3-pentadecyloxybenzoyl group, a p-chlorobenzoyl group and the like.

The sulfonyl group represented by R may include alkylsulfonyl groups such as methylsulfonyl group, a dodecylsulfonyl group and the like; arylsulfonyl groups such as a benzenesulfonyl group, a p-toluenesulfonyl group and the like.

Examples of the sulfinyl group represented by R are alkylsulfinyl groups such as an ethylsulfinyl group, an octylsulfinyl group, a 3-phenoxybutylsulfinyl group and the like; arylsulfinyl groups such as a phenylsulfinyl groups, a m-pentadecylphenylsulfinyl group and the like.

The phosphonyl group represented by R may be exemplified by alkylphosphonyl groups such as a butyloctylphosphonyl group and the like; alkoxyphosphonyl groups such as an octyloxyphosphonyl group and the like; ryloxyphosphonyl groups such as a phenoxyphosphonyl group and the like; and arylphosphonyl groups such as a phenylphosphonyl group and the like.

The carbamoyl group represented by R may be substituted by an alkyl group, an aryl group (preferably a phenyl group), etc., including, for example, an N-methylcarbamoyl group, an N,N-dibutylcarbamoyl group, an N-(2-pentadecyloctylethyl)carbamoyl group, an N-ethyl-N-dodecylcarbamoyl group, an N-{3-(2,4-di-t-amylphenoxy)-propyl}carbamoyl group and the like.

The sulfamoyl group represented by R may be substituted by an alkyl group, an aryl group (preferably a phenyl group), etc., including, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group and the like.

The spiro compound residue represented by R may be, for example, spiro[3.3]heptan-1-yl and the like.

The bridged hydrocarbon residual group represented by R maybe, for example, bicyclo[2.2.1]heptan-1-yl, tricyclo-[3.3.1.1$^{3,7}$]decan-1-yl, 7,7-dimethylbicyclo[2.2.1]heptan-1-yl and the like.

The alkoxy group represented by R may be substituted by those as mentioned above as substituents for alkyl groups, including a methoxy group, a propoxy group, a 2-ethoxyethoxy group, a pentadecyloxy group, a 2-dodecyloxyethoxy group, a phenethyloxyethoxy group and the like.

The aryloxy group represented by R may preferably be a phenyloxy group of which the aryl nucleus may be further substituted by those as mentioned above as substituents or atoms for the aryl groups, including, for example, a phenoxy group, a p-t-butylphenoxy group, a m-pentadecylphenoxy group and the like.

The heterocyclyloxy group represented by R may preferably be one having a 5- to 7-membered hetero ring, which hetero ring may further have substituents, including a 3,4,5,6-tetrahydropyranyl-2-oxy group, a 1-phenyltetrazole-5-oxy group and the like.

The siloxy group represented by R may further be substituted by an alkyl group, etc., including a siloxy group, a trimethylsiloxy group, a triethylsiloxy group, a dimethylbutylsiloxy group and the like.

The acyloxy group represented by R may be exemplified by an alkylcarbonyloxy group, an arylcarbonyloxy group, etc., which may further have substituents, including specifically an acetyloxy group, an α-chloroacetyloxy group, a benzoyloxy and the like.

The carbamoyloxy group represented by R may be substituted by an alkyl group, an aryl group, etc., including an N-ethylcarbamoyloxy group, an N,N-diethylcarbamoyloxy group, an N-ethylcarbamoyloxy group, an N,N-diethylcarbamoyloxy group, an N-phenylcarbamoyloxy group and the like.

The amino group represented by R may be substituted by an alkyl group, an aryl group (preferably a phenyl group), etc., including an ethylamino group, an anilino group, a m-chloroanilino group, a 3-pentadecyloxycarbonylanilino group, a 2-chloro-5-hexadecaneamidoanilino group and the like.

The acylamino group represented by R may include an alkylcarbonylamino group, an arylcarbonylamino group (preferably a phenylcarbonylamino group), etc., which may further have substituents, specifically an acetamide group, an α-ethylpropaneamide group, an N-phenylacetamide group, a dodecaneamide group, a 2,4-di-t-amylphenoxyacetoamide group, an α-3-t-butyl-4-hydroxyphenoxybutaneamide group and the like.

The sulfonamide group represented by R may include an alkylsulfonylamino group, an arylsulfonylamino group, etc., which may further have substitutents, specifically a methylsulfonylamino group, a pentadecylsulfonylamino group, a benzenesulfonamide group, a p-toluenesulfonamide group, a 2-methoxy-5-t-amylbenzenesulfonamide and the like.

The imide group represented by R may be either open-chained or cyclic, which may also have substituents, as exemplified by a succinimide group, a 3-hetpadecylsuccinimide group, a phthalimide group, a glutarimide group and the like.

The ureido group represented by R may be substituted by an alkyl group, an aryl group (preferably a phenyl group), etc., including an N-ethylureido group, an N-methyl-N-decylureido group, an N-phenylureido group, an N-p-tolylureido group and the like.

The sulfamoylamino group represented by R may be substituted by an alkyl group, an aryl group (preferably a phenyl group), etc., including an N,N-dibutylsulfamoylamino group, an N-methylsulfamoylamino group, an N-phenylsulfamoylamino group and the like.

The alkoxycarbonylamino group represented by R may further have substituents, including a methoxycarbonylamino group, a methoxyethoxycarbonylamino group, an octadecyloxycarbonylamino group and the like.

The aryloxycarbonylamino group represented by R may have substituents, and may include a phenoxycarbonylamino group, a 4-methylphenoxycarbonylamino group and the like.

The alkoxycarbonyl group represented by R may further have substituents, and may include a methoxycarbonyl group, a butyloxycarbonyl group, a dodecyloxycarbonyl group, an octadeyloxycarbonyl group, an ethoxymethoxycarbonyloxy group, an benzyloxycarbonyl group and the like.

The aryloxycarbonyl group represented by R may further have substituents, and may include a phenoxycarbonyl grup, a p-chlorophenoxycarbonyl group, a m-pentadecyloxyphenoxycarbonyl group and the like.

The alkylthio group represented by R may further have substituents, and may include an ethylthio group, a dodecylthio group, an octadecylthio group, a phnethylthio group, a 3-phenoxypropylthio group and the like.

The arylthio group represented by R may preferably be a phenylthio group, which may further have substituents, and may include, for example, a phenylthio group, a p-methoxyphenylthio group, a 2-t-octylphenylthio group, a 3-octadecylphenylthio group, a 2-carboxyphenylthio group, a p-acetaminophenylthio group and the like.

The heterocyclicthio group represented by R may preferably be a 5- to 7-membered heterocyclicthio group, which may further have a fused ring or have substituents, including, for example, a 2-pyridylthio group, a 2-benzothiazolylthio group, a 2,4-di-phenoxy-1,3,5-triazole-6-thio group and the like.

The atom eliminable through the reaction with the oxidized product of a color developing agent represented by X may include halogen atoms (e.g. a chlorine atom, a bromine atom, a fluorine atom, etc.) and also groups substituted through a carbon atom, an oxygen atom, a sulfur atom or a nitrogen atom.

The group substituted through a carbon atom may include the groups represented by the formula:

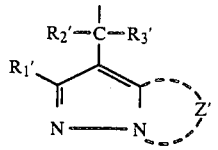

wherein $R_1'$ has the same meaning as the above R, Z' has the same meaning as the above Z, $R_2'$ and $R_3'$ each represent a hydrogen atom, an aryl group, an alkyl group or a heterocyclic group, a hydroxymethyl group and a triphenylmethyl group.

The group substituted through an oxygen atom may include an alkoxy group, an aryloxy, a heterocyclicoxy group, an acyloxy group, a sulfonyloxy group, an alkoxycarbonyloxy group, an aryloxycarbonyloxy group, an alkyloxyalyloxy group, an alkoxyoxalyloxy groups.

Said alkoxy group may further have substituents, including an ethoxy group, a 2-pheoxyethoxy group, a 2-cyanoethoxy group, a phenethyloxy group, a p-chlorobenzyloxy group and the like.

Said aryloxy group may preferably be a phenoxy group, which aryl group may further have substituents. Specific examples may include a phenoxy group, a 3-methylphenoxy group, a 3-dodecylphenoxy group, a 4-methanesulfonamidophenoxy group, a 4-[α-(3'-pentadecylphenoxy)butaneamido]phenoxy group, a hexadecylcarbamoylmethoxy group, a 4-cyanopheoxy group, a 4-methanesulfonylphenoxy group, a 1-naphthyloxy group, a p-methoxyphenoxy group and the like.

Said heterocyclyloxy group may preferably be a 5- to 7-membered heteroxyclicoxy group, which may be a fused ring or have substituents. Specifically, a 1-phenyltetrazol- yloxy group, a 2-benzothiazolyloxy group and the like may be included.

Said acyloxy group may be exemplified by an alkylcarbonyloxy group such as an acetoxy group, a butanoyloxy group, etc.; an alkenylcarbonyloxy group such as a cinnamoyloxy group, an arylcarbonyloxy group such as a benzoyloxy group.

Said sulfonyloxy group may be, for example, a butanesulfonyloxy group, a methanesulfonyloxy group and the like.

Said alkoxycarbonyloxy group may be, for example, an ethoxycarbonyloxy group, a benzyloxycarbonyloxy group and the like.

Said aryloxycarbonyl group may be, for example, a phenoxycarbonyloxy group and the like.

Said alkyloxalyloxy group may be, for example, a methyloxalyloxy group.

Said alkoxyoxalyloxy group may be, for example, an ethoxyoxalyloxy group and the like.

The group substituted through a sulfur atom may include an alkylthio group, an arylthio group, a heterocyclicthio group, an alkyloxythiocarbonylthio groups.

Said alkylthio group may include a butylthio group, a 2-cyanoethylthio group, a phenethylthio group, a benzylthio group and the like.

Said arylthio group may include a phenylthio group, a 4-methanesulfonamidophenylthio group, a 4-dodecylphenethylthio group, a 4-nonafluoropentaneamidophenethylthio group, a 4-carboxyphenylthio group, a 2-ethoxy-5-t-butylphenylthio group and the like.

Said heterocyclicthio group may be, for example, a 1-phenhyl-1,2,3,4-tetrazolyl-5-thio group, a 2-benzothiazolylthio group and the like.

Said alkyloxythiocarbonylthio group may include a dodecyloxythiocarbonylthio group and the like.

The group substituted through a nitrogen atom may include, for example, those represented by the formula:

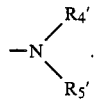

Here, $R_4'$ and $R_5'$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group. $R_4'$ and $R_5'$ may be bonded to each other to form a hetero ring. However, $R_4'$ and $R_5'$ cannot both be hydrogen atoms.

Said alkyl group may be either straight or branched, having preferably 1 to 22 carbon atoms. Also, the alkyl group may have substitutents such as an aryl group, an alkoxy group, an aryloxy group, an alkylthio group, an arylthio group, an alkylamino group, an arylamino group, an acylamino group, a sulfonamide group, an imino group, an acyl group, an alkylsulfonyl group, an arylsulfonyl group, a carbamoyl group, a sulfamoyl group, an alkoxycarbonyl group, an aryloxycarbonyl group, an alkyloxycarbonylaminio group, an aryloxycarbonylamino group, a hydroxyl group, a carboxyl group, a cyano group, halogen atoms, etc. Typical examples of said alkyl group may include an ethyl group, an octyl group, a 2-ethylhexyl group, a 2-chloroethyl group and the like.

The aryl group represented by $R_4'$ or $R_5'$ may preferably have 6 to 32 carbon atoms, particularly a phenyl group or a naphthyl group, which aryl group may also have substituents such as those mentioned above for substituents on the alkyl group represented by $R_4'$ or $R_5'$ and alkyl groups. Typical examples of said aryl group may be, for example, a phenyl group, a 1-naphtyl group, a 4-methylsulfonylphenyl group and the like.

The heterocyclic group represented by $R_4'$ or $R_5'$ may preferably a 5- or 6-membered ring, which may be a fused ring or have substituents. Typical examples may include a 2-furyl group, a 2-quinolyl group, a 2-pyrimidyl group, a 2-benzothiazolyl group, a 2-pyridyl group and the like.

The sulfamoyl group represented by $R_4'$ or $R_5'$ may include an N-alkylsulfamoyl group, an N,N-dialkylsulfamoyl group, an N-arylsulfamoyl group, an N,N-diarylsulfamoyl group and the like, and these alkyl and aryl group may have substituents as mentioned above for the alkyl groups and aryl groups. Typical examples of the sulfamoyl group are, for example, an N,N-diethylsulfamoyl group, an N-methylsulfamoyl group, an N-dodecylsulfamoyl group, an N-p-tolylsulfamoyl group and the like.

The carbamoyl group represented by $R_4'$ or $R_5'$ may include an N-alkylcarbamoyl group, an N,N-dialkylcarbamoyl group, an N-arylcarbamoyl group, an N,N-diarylcarbamoyl group and the like, and these alkyl and aryl groups may have substituents as mentioned above for the alkyl groups and aryl groups. Typical examples of the carbamoyl groups are an N,N-diethylcarbamoyl group, an N-methylcarbamoyl group, an N-dodecylcarbamoyl group, an N-p-cyanocarbamoyl group, an N-p-tolylcarbamoyl group and the like.

The acyl group represented by $R_4'$ or $R_5'$ may include an alkylcarbonyl group, an arylcarbonyl group, a heterocyclic carbonyl group, which alkyl group, aryl group and heterocyclic group may have substituents. Typical examples of the acyl group are a hexafluorobutanoyl group, a 2,3,4,5,6-pentafluorobenzoyl group, an acetyl group, a benzoyl group, a naphthoyl group, a 2-furylcarbonyl group and the like.

The sulfonyl group represented by $R_4'$ or $R_5'$ may be, for example, an alkylsulfonyl group, an arylsulfonyl group or a heterocyclic sulfonyl group, which may also have substituents, including specifically an ethanesulfonyl group, a benzenesulfonyl group, an octanesulfonyl group, a naphthalenesulfonyl group, a p-chlorobenzenesulfonyl group and the like.

The aryloxycarbonyl group represented by $R_4'$ or $R_5'$ may have substituents as mentioned for the above aryl group, including specifically a phenoxycarbonyl group and the like.

The alkoxycarbonyl group represented by $R_4'$ or $R_5'$ may have substituents as mentioned for the above alkyl group, and its specific examples are a methoxycarbonyl group, a dodecyloxycarbonyl group, a benzyloxycarbonyl group and the like.

The heterocyclic ring formed by bonding between $R_4'$ and $R_5'$ may preferably be a 5- or 6-membered ring, which may be either saturated or unsaturated, either has aromaticity or not, or may also be a fused ring. Said heterocyclic ring may include, for example, an N-phthalimide group, an N-succinimide group, a 4-N-urazolyl group, a 1-N-hydantoinyl group, a 3-N-2,4-dioxooxazolidinyl group, a 2-N-1,1-dioxo-3-(2H)-oxo-1,2-benzthiazolyl group, a 1-pyrrolyl group, a 1-pyrrolidinyl group, a 1-pyrazolyl group, a 1-pyrazolidinyl group, a 1-piperidinyl group, a 1-pyrrolinyl group, a 1-imidazolyl group, a 1-imidazolinyl group, a 1-indolyl group, a 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pyrridone group, a phthaladione group, a 2-oxo-1-piperidinyl group, etc. These heterocyclic groups may be substituted by an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, an ureido group, an alkoxycarbonyl group, an aryloxycarbonyl group, an imide group, a nitro group, a cyano group, a carboxyl group or halogen atoms.

The nitrogen-containing heterocyclic ring formed by Z and Z' may include a pyrazole ring, a imidazole ring, a triazole ring or a tetrazole ring, and the substituents which may be possessed by the above rings may include those as mentioned for the above R.

When the substituent (e.g. R, $R_1$ to $R_8$) on the heterocyclic ring in the formula (M) and the formulae (M1) to (M6) as hereinafter described has a moiety of the formula:

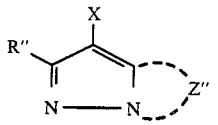

(wherein R'', X and Z'' have the same meanings as R, X and Z in the formul (M)), the so-called bis-form type coupler is formed, which is of course included in the present invention. The ring formed by Z, Z', Z'' and $Z_1$ as hereinafter described may also be fused with another ring (e.g. a 5- to 7-membered cycloalkene). For example, $R_5$ and $R_6$ in the formula (M4), $R_7$ and $R_8$ in the formula (M5) may be bonded to each other to form a ring (e.g. a 5- to 7-membered rings).

The compounds represented by the formula (M) can be also represented specifically by the following formulae (M1) through (M6).

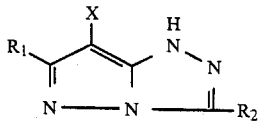

(M1)

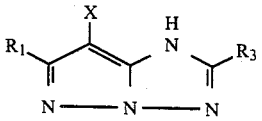

(M2)

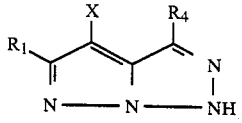

(M3)

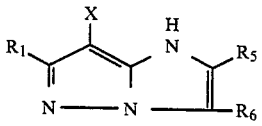

(M4)

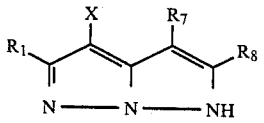

(M5)

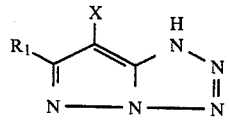

(M6)

In the above formulae (M1) to (M6), $R_1$ to $R_8$ and X have the same meanings as the above R and X.

Of the compounds represented by the formula (M), those represented by the following formula (M7) are preferred.

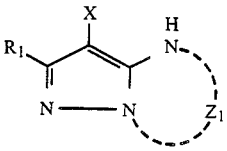

(M7)

wherein $R_1$, X and $Z_1$ have the same meanings as R, X and Z in the formula (M).

Of the magenta couplers represented by the formulae (M1) to (M6), the magenta coupler represented by the formula (M1) is particularly preferred.

To describe about the substituents on the heterocyclic ring in the formulae (M) and (M1) to (M7), R in the formula (M) and $R_1$ in the formulae (M1) to (M7) should preferably satisfy the following condition 1, more preferably satisfy the following conditions 1 and 2, and particularly preferably satisfy the following conditions 1, 2 and 3:

Condition 1: a root atom directly bonded to the heterocyclic ring is a carbon atom, Condition 2: only one of hydrogen atom is bonded to said carbon atom or no hydrogen atom is bonded to it, and Condition 3: the bondings between the root atom and adjacent atoms are all single bonds.

Of the substituents R and $R_1$ on the above heterocyclic ring, most preferred are those represented by the formula (M8) shown below:

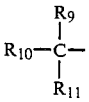

(M8)

In the above formula, each of $R_9$, $R_{10}$ and $R_{11}$ represents a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group.

Also, at least two of said $R_9$, $R_{10}$ and $R_{11}$, for example, $R_9$ and $R_{10}$ may be bonded together to form a saturated or unsaturated ring (e.g. cycloalkane ring, cycloalkene ring or heterocyclic ring), and further to form a bridged hydrocarbon compound residual group by bonding $R_{11}$ to said ring.

The groups represented by $R_9$ to $R_{11}$ may have substituents, and examples of the groups represented by $R_9$ to $R_{11}$ and the substituents which may be possessed by said groups may include examples of the substituents which may be possessed by the R in the above formula (M), and substituents which may be possessed by said substituents.

Also, examples of the ring formed by bonding between $R_9$ and $R_{10}$, the bridged hydrocarbon compound residual group formed by $R_9$ to $R_{11}$ and the substituents which may be possessed thereby may include examples of cycloalkyl, cycloalkenyl and heterocyclic groups as mentioned for substituents on the R in the aforesaid formula (M) and substituents thereof.

Of the groups of the formula (M8), preferred are:

(i) the case where two of $R_9$ to $R_{11}$ are alkyl groups; and (ii) the case where one of $R_9$ to $R_{11}$, for example, $R_{11}$ is a hydrogen atom and two of the other $R_9$ and $R_{10}$ are bonded together with the root carbon atom to form a cycloalkyl group.

Further, preferred in (i) is the case where two of $R_9$ to $R_{11}$ are alkyl groups and the other one is a hydrogen atom or an alkyl group.

Here, said alkyl and said cycloalkyl may further have substituents, and examples of said alkyl, said cycloalkyl and subsituents thereof may include those of alkyl, cycloalkyl and substituents thereof as mentioned for the substituents on the R in the formula (M) and the substituents thereof.

The magenta coupler represented by formula (M) may include the specific compound enumerated below.

M-1

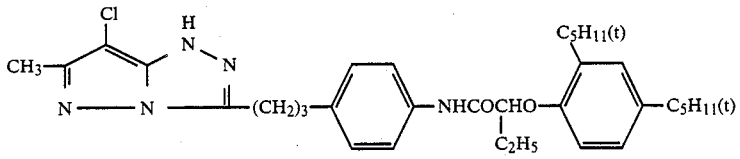

M-2

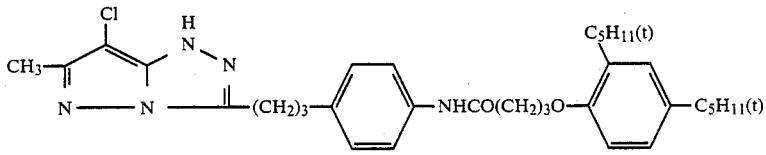

M-3

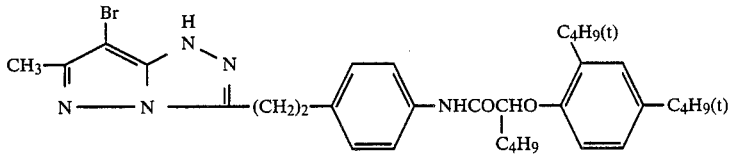

M-4

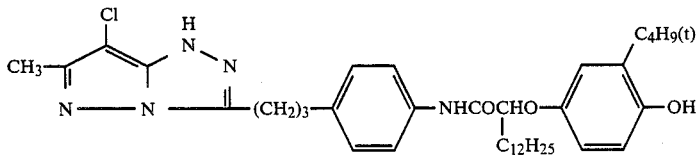

M-5

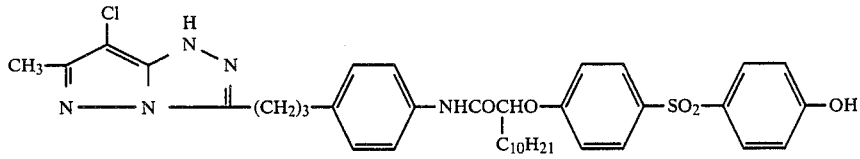

M-6

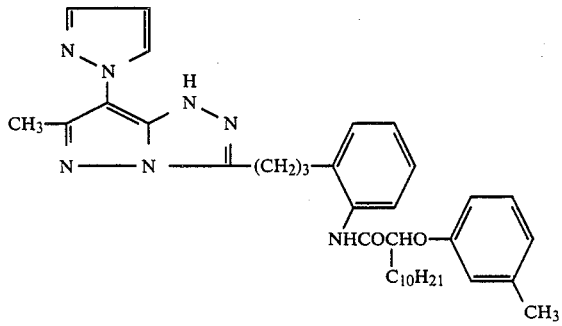

M-7

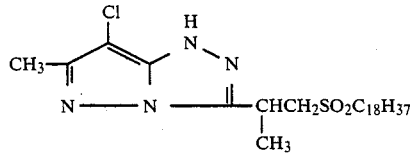

-continued
M-8
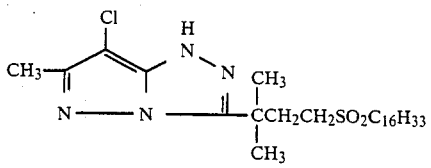
M-9
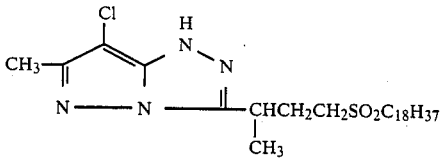
M-10
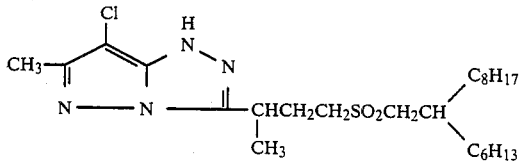
M-11
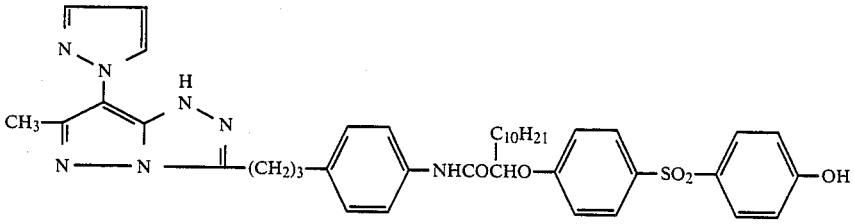
M-12
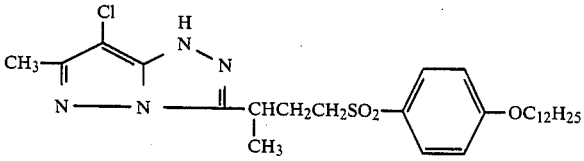
M-13
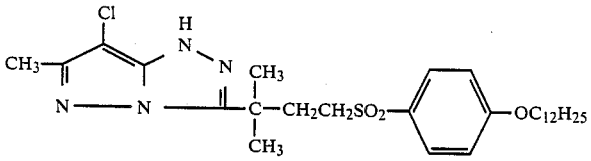
M-14
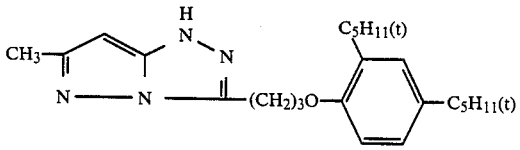
M-15
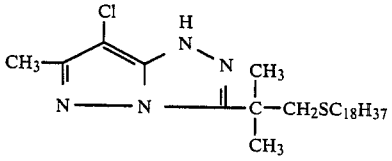
M-16
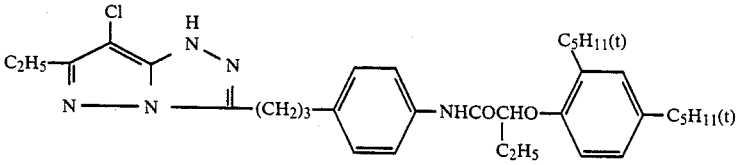

-continued
M-17
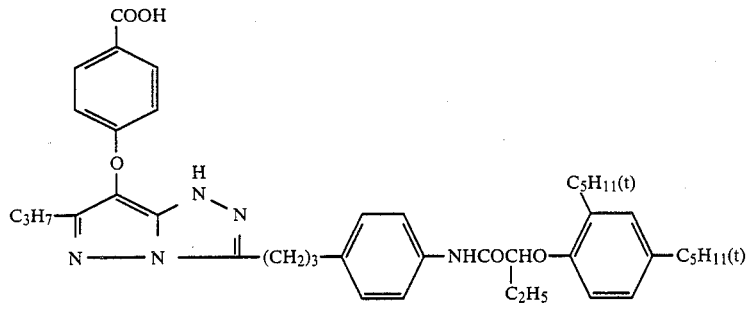
M-18
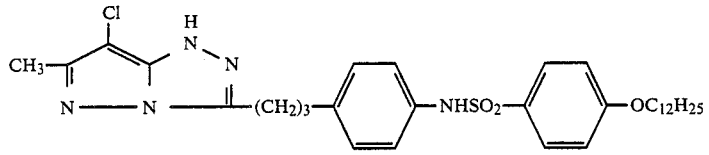
M-19
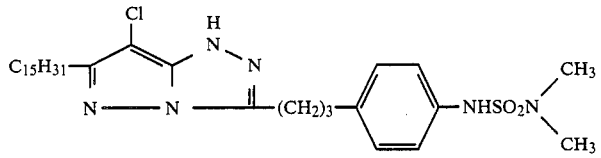
M-20
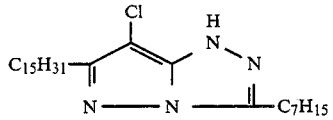
M-21
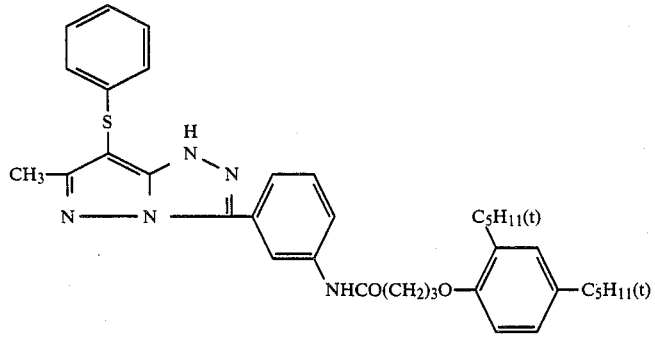
M-22
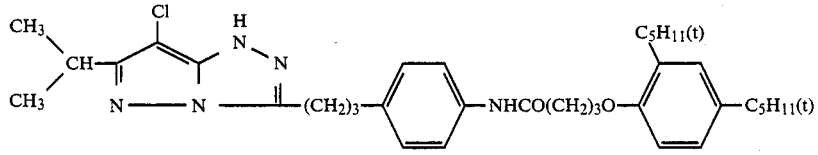
M-23
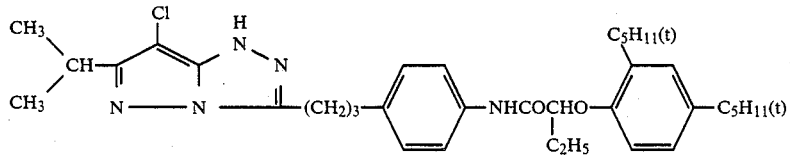
M-24
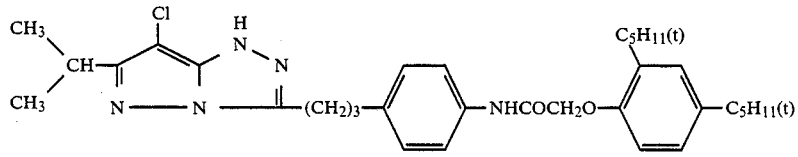

-continued
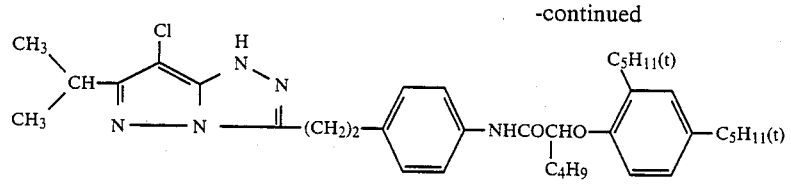
M-25
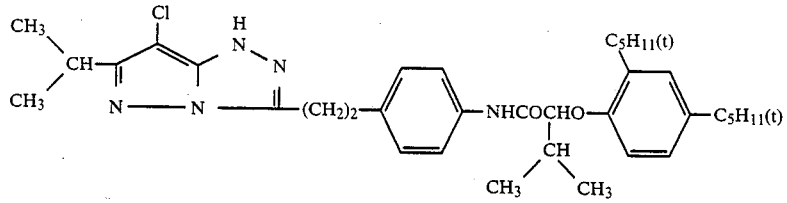
M-26
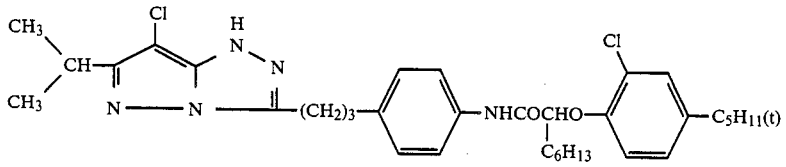
M-27
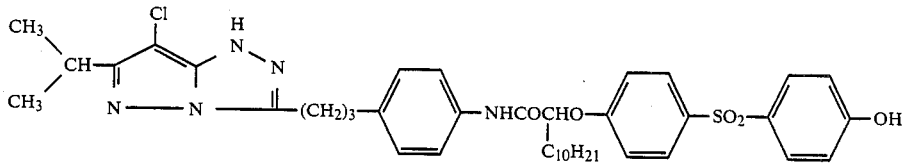
M-28
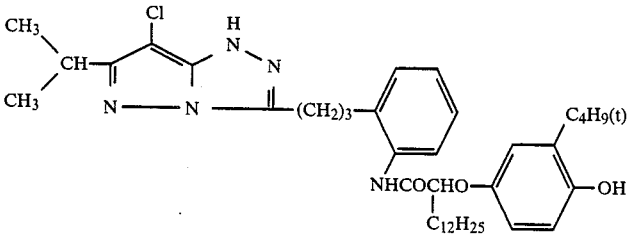
M-29
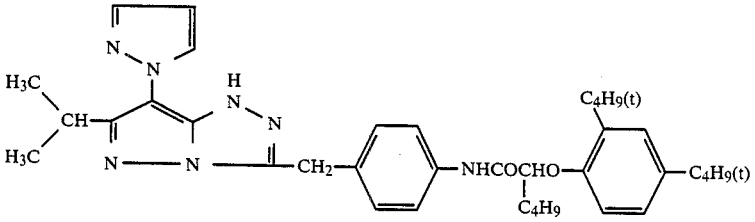
M-30
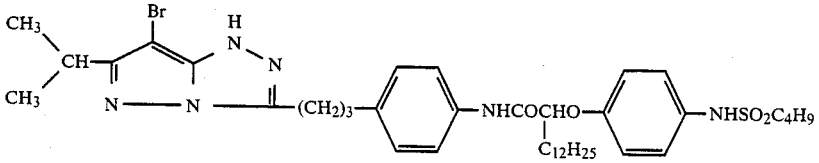
M-31
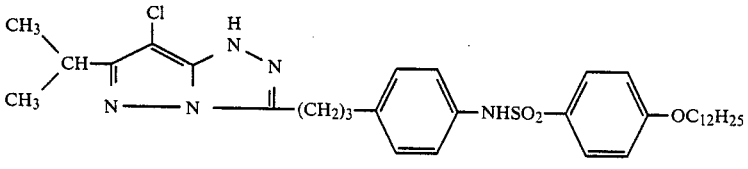
M-32
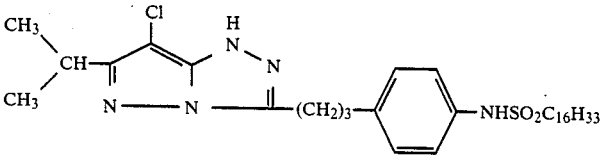
M-33

-continued
M-34
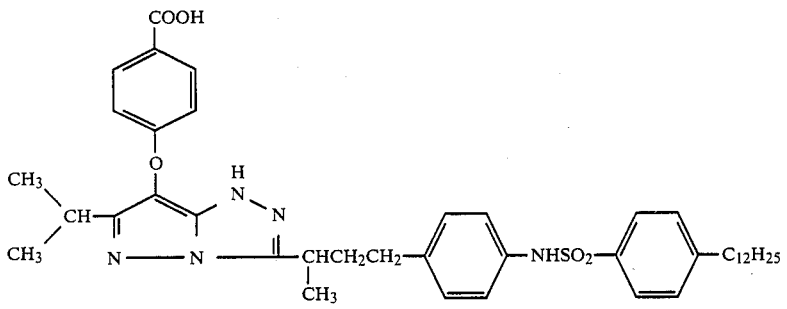
M-35
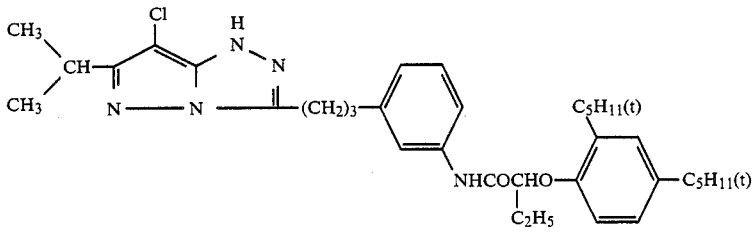
M-36
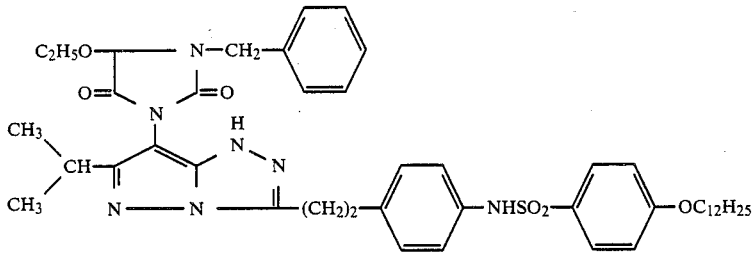
M-37
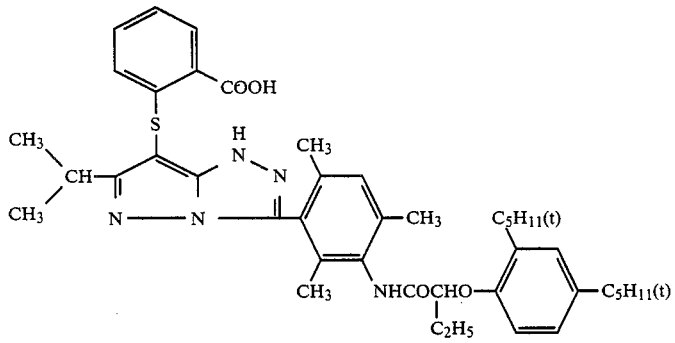
M-38
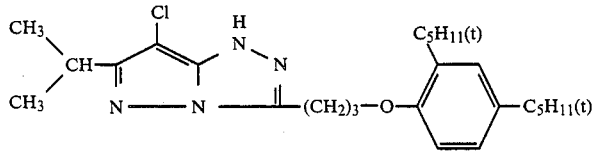
M-39
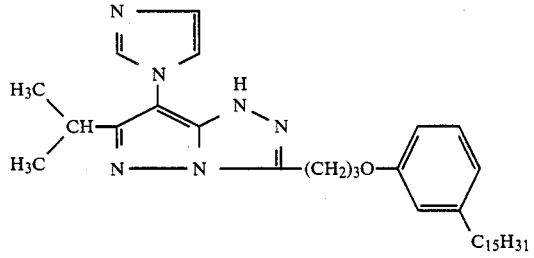

-continued
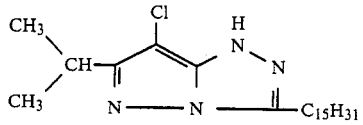
M-40
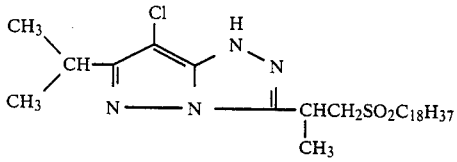
M-41
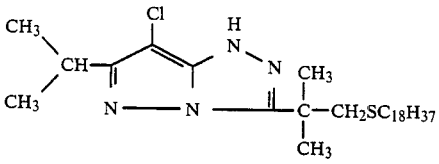
M-42
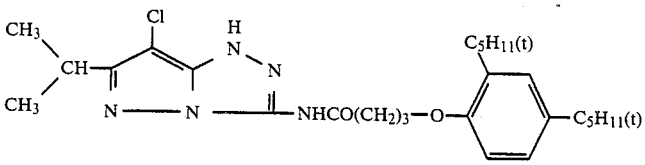
M-43
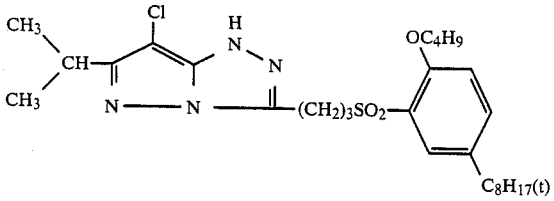
M-44
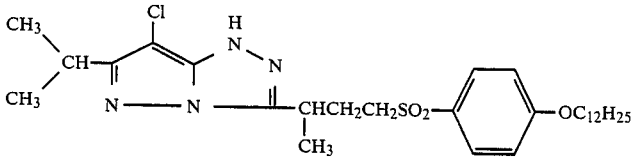
M-45
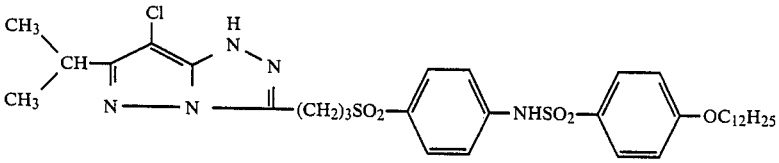
M-46
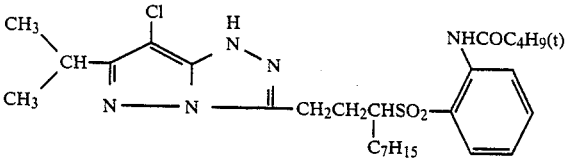
M-47
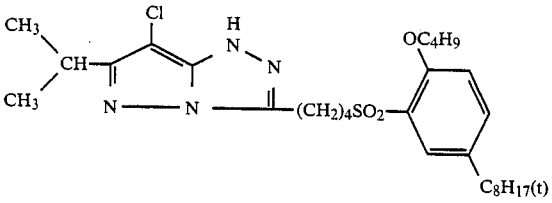
M-48

-continued
M-49
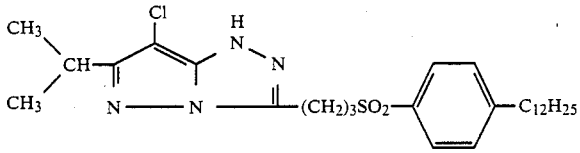
M-50
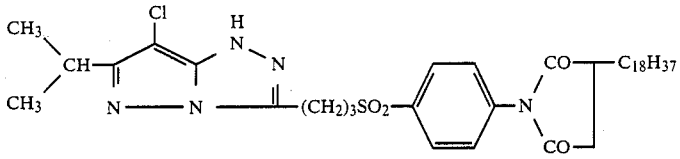
M-51
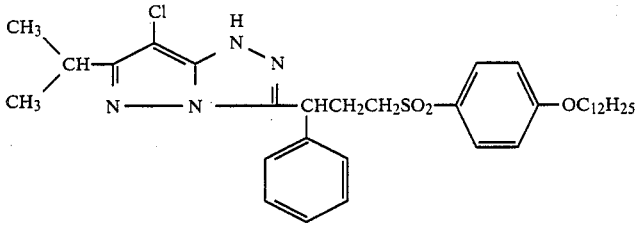
M-52
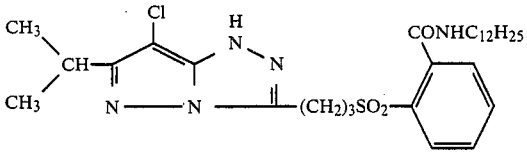
M-53
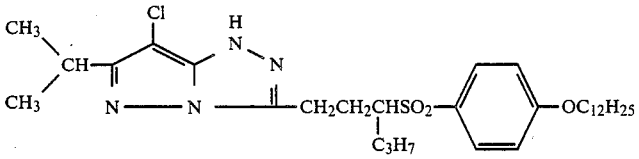
M-54
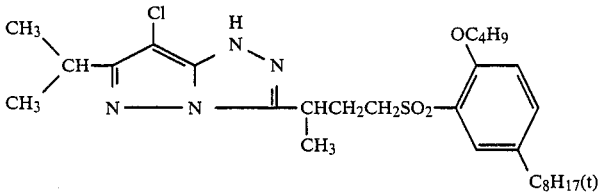
M-55
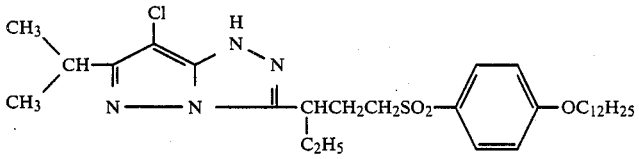
M-56
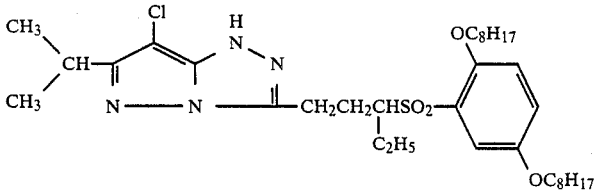
M-57
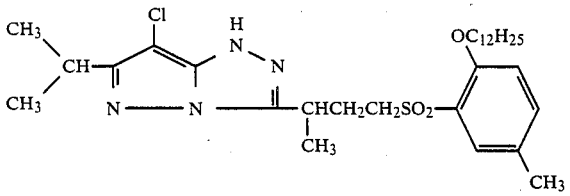

-continued
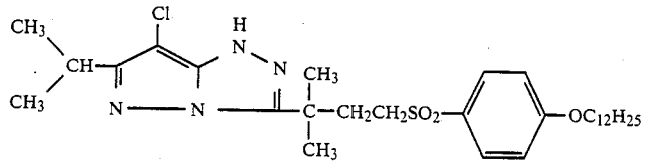
M-58
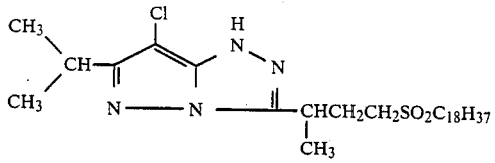
M-59
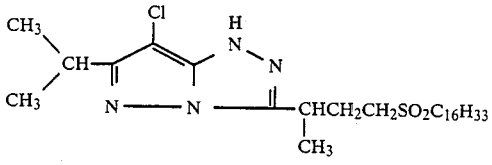
M-60
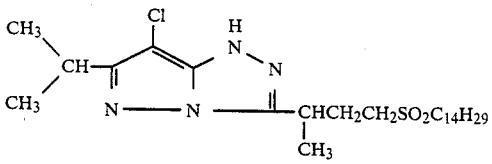
M-61
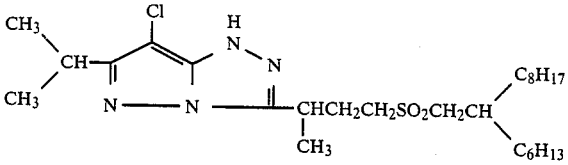
M-62
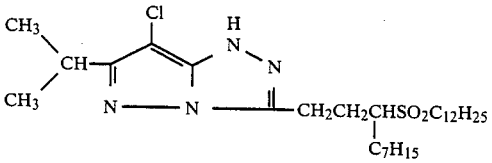
M-63
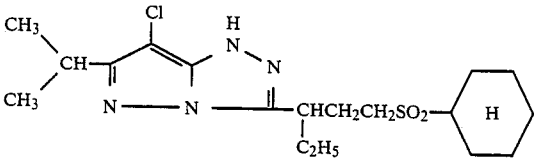
M-64
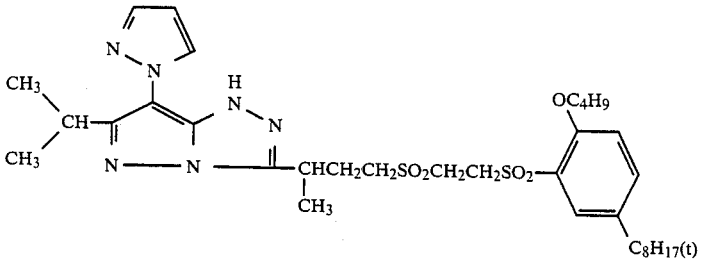
M-65
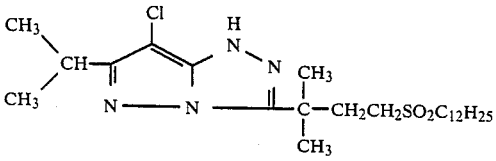
M-66

-continued
M-67
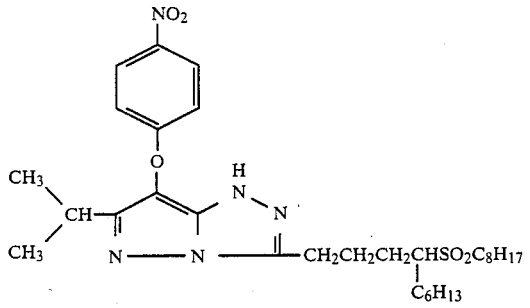
M-68
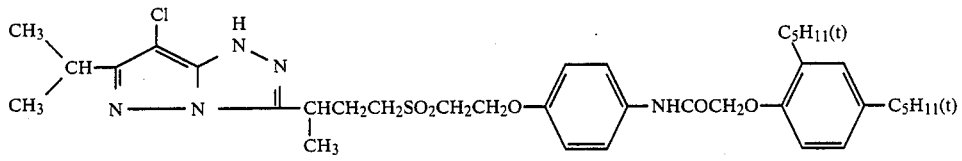
M-69
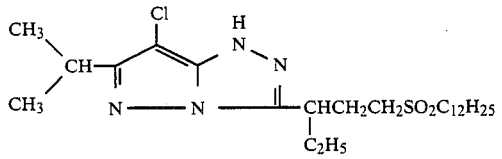
M-70
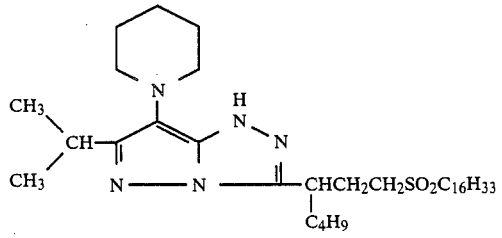
M-71
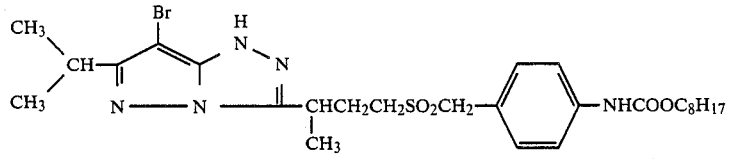
M-72
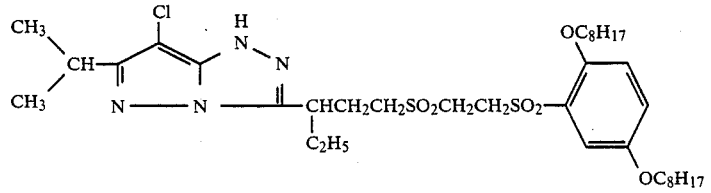
M-73
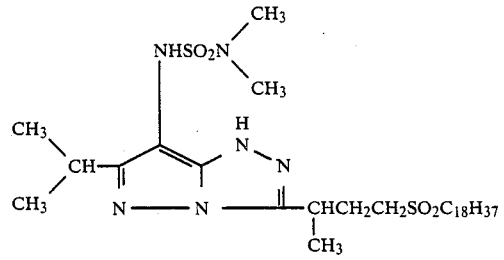

-continued
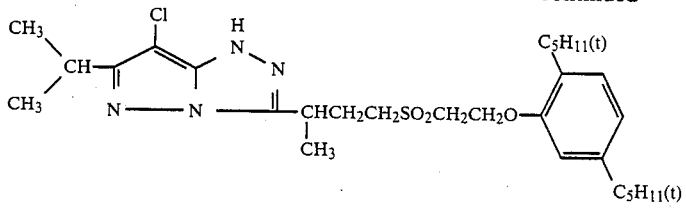
M-74
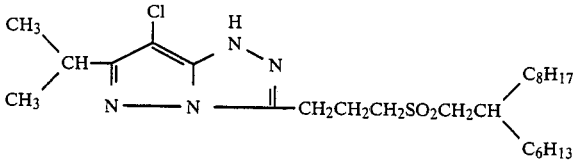
M-75
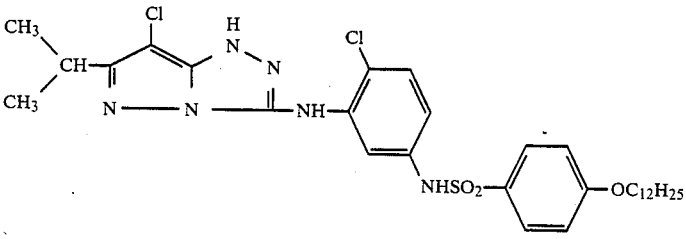
M-76
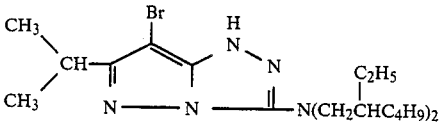
M-77
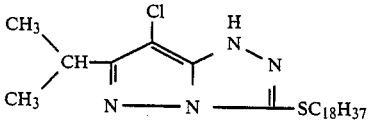
M-78
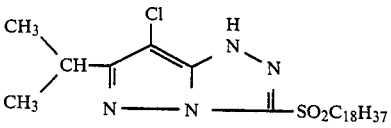
M-79
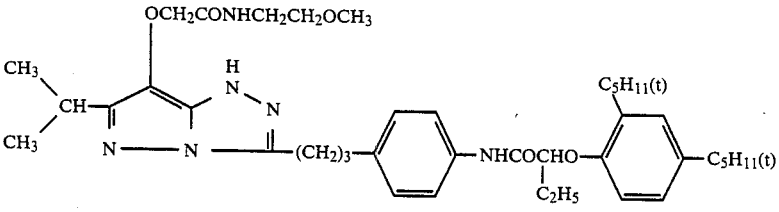
M-80
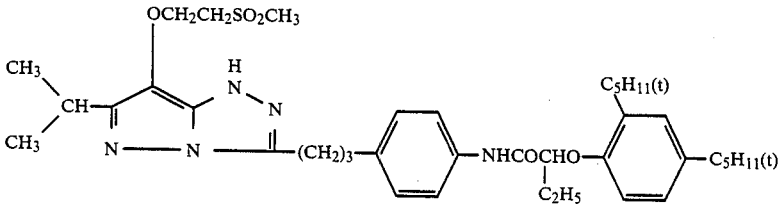
M-81
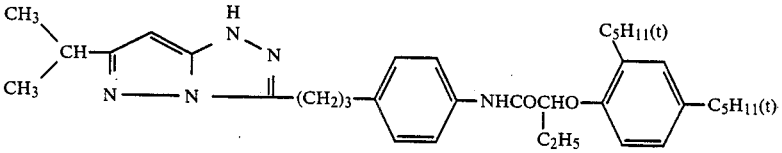
M-82

-continued
M-83
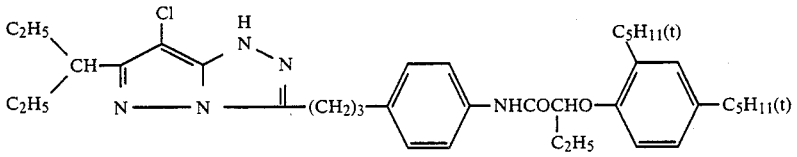
M-84
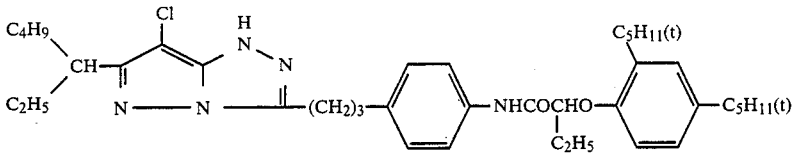
M-85
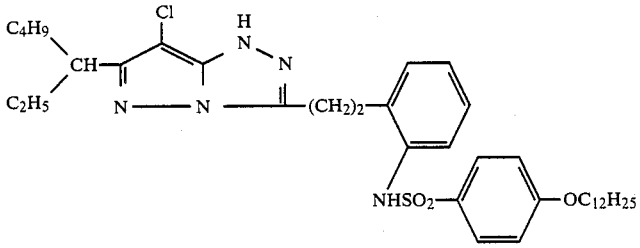
M-86
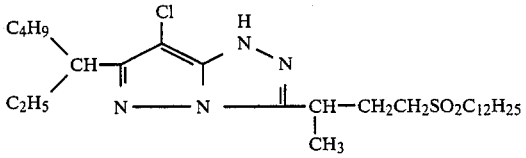
M-87
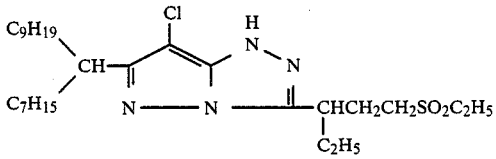
M-88
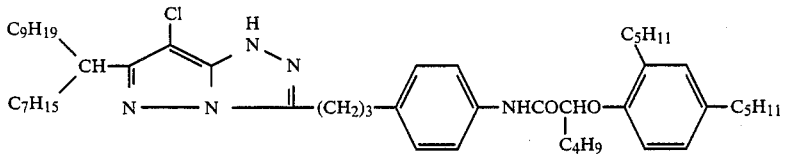
M-89
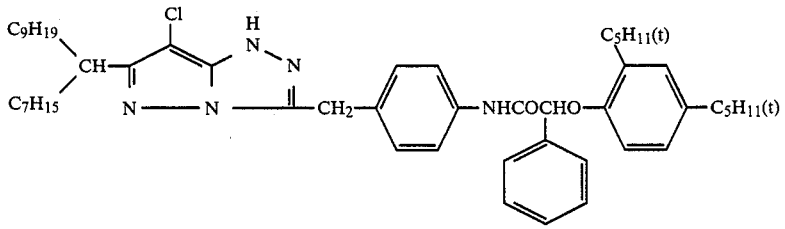
M-90
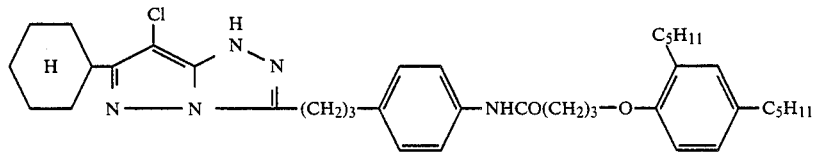

-continued
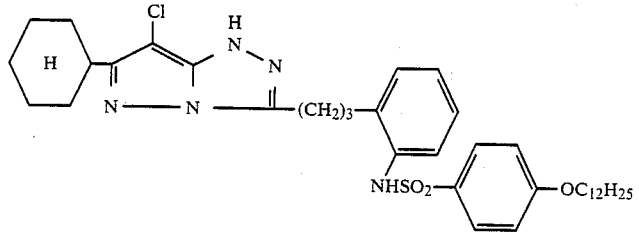
M-91
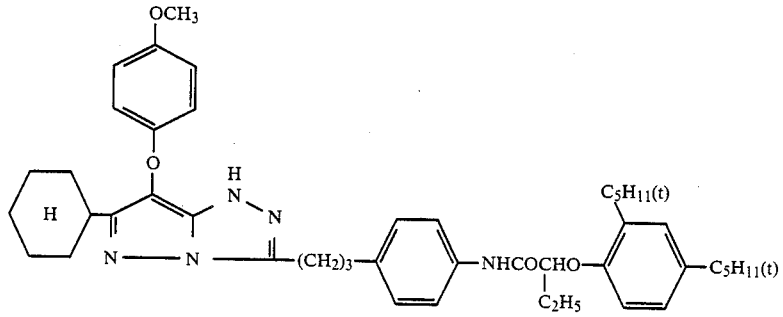
M-92
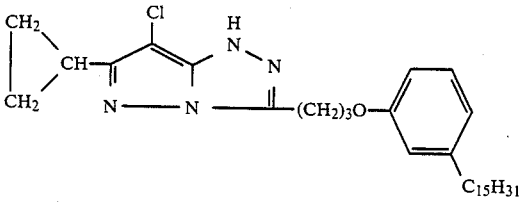
M-93
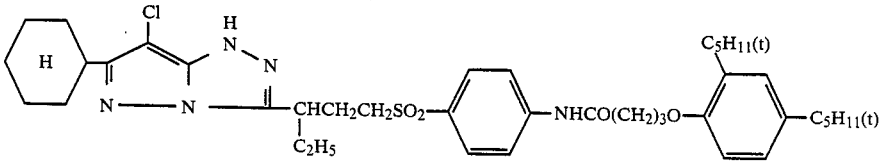
M-94
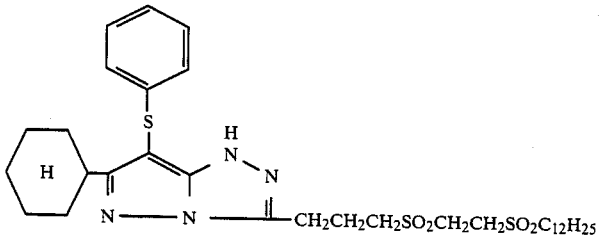
M-95
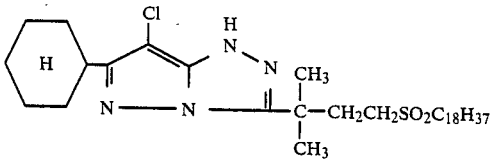
M-96
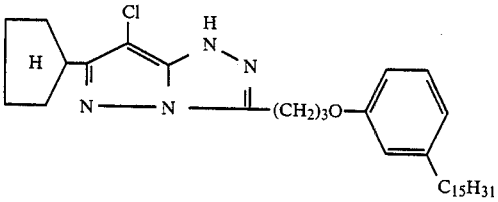
M-97

-continued
M-98
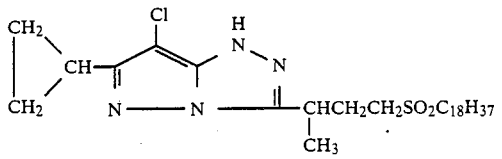
M-99
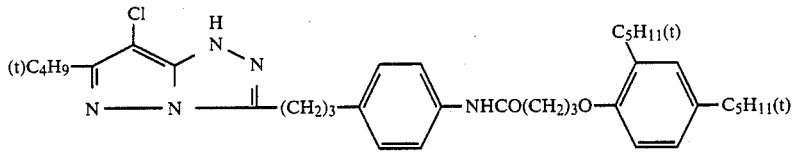
M-100
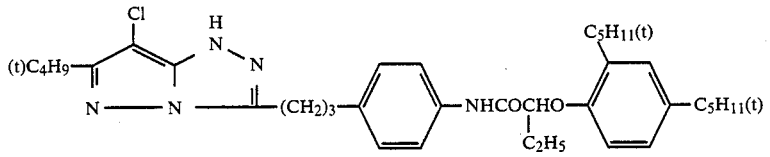
M-101
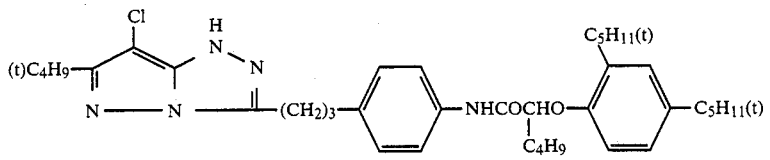
M-102
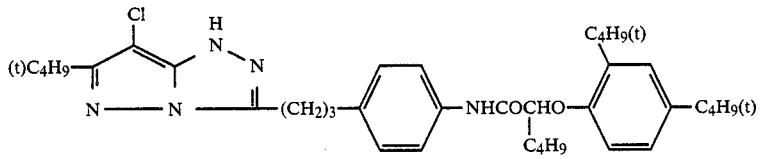
M-103
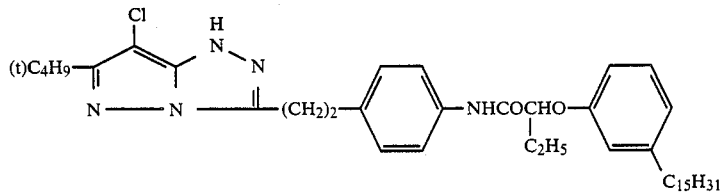
M-104
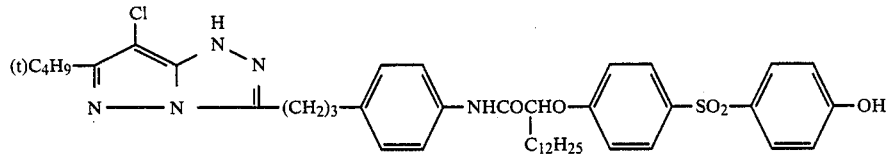
M-105
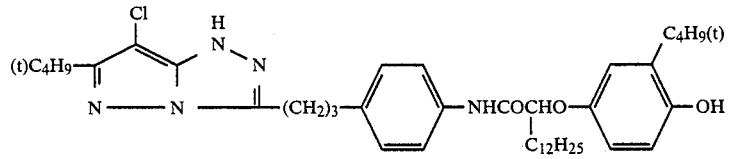
M-106
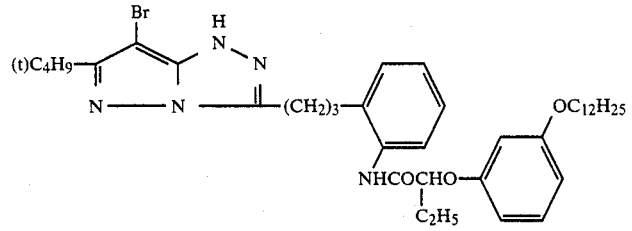

-continued
M-107
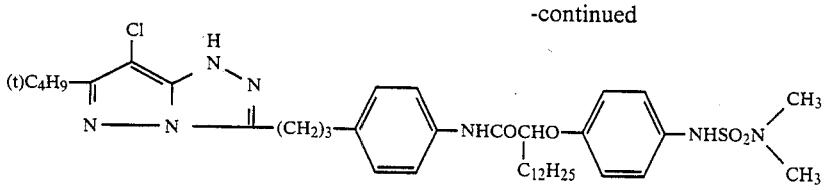
M-108
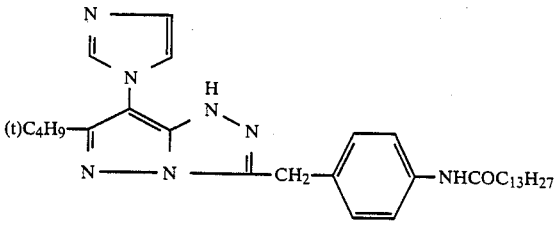
M-109
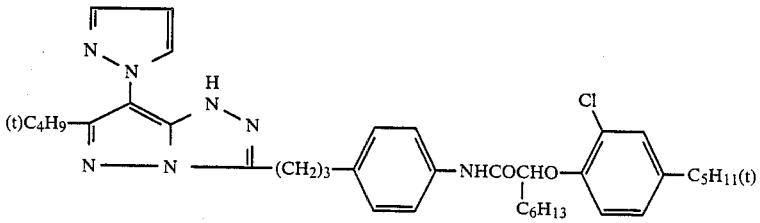
M-110
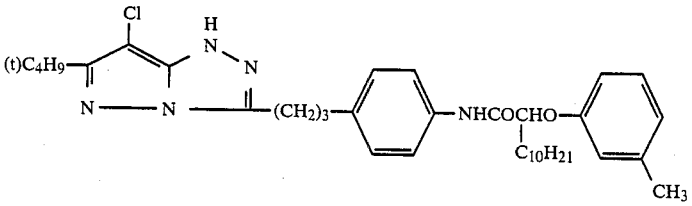
M-111
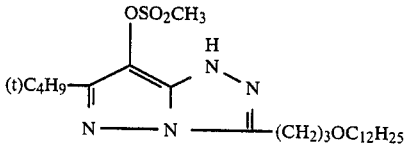
M-112
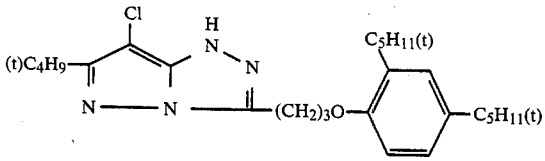
M-113
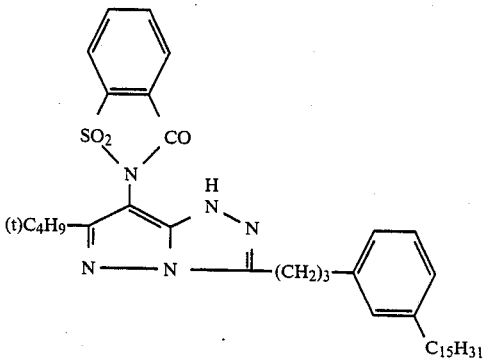
M-114
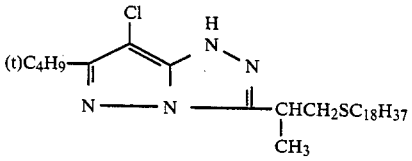

-continued
M-115
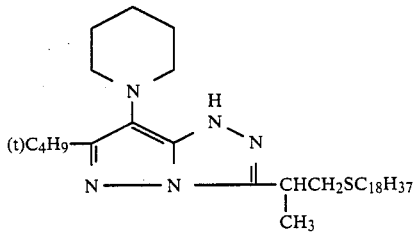
M-116
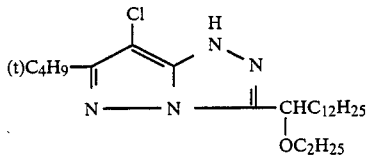
M-117
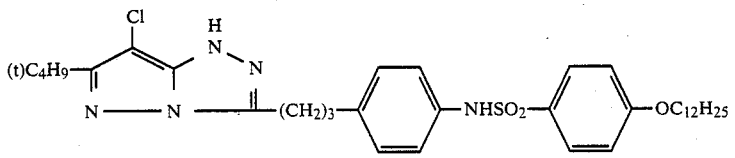
M-118
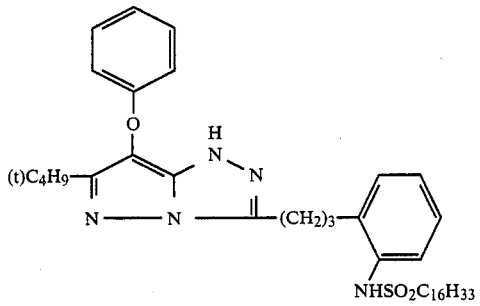
M-119
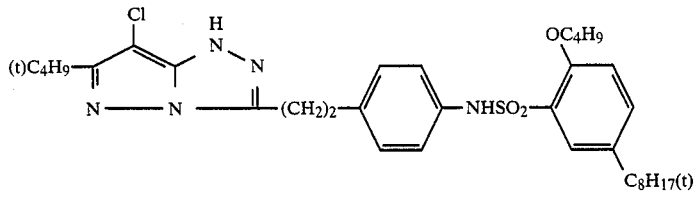
M-120
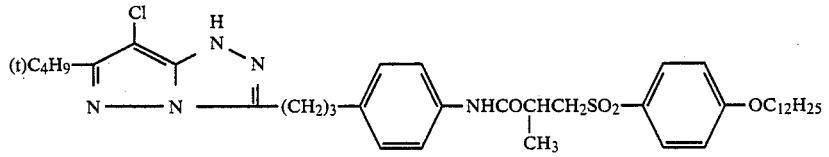
M-121
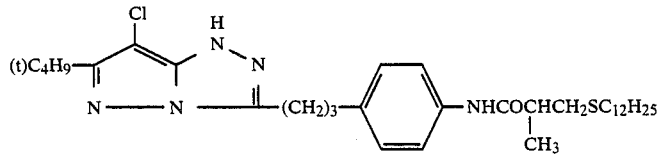
M-122
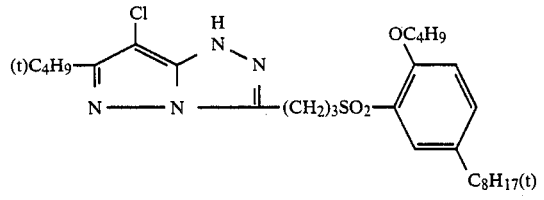

-continued
M-123
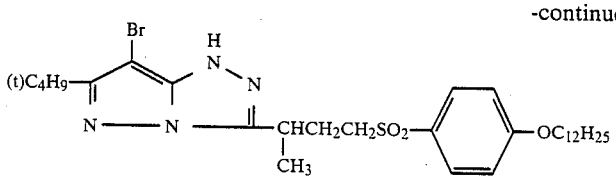
M-124
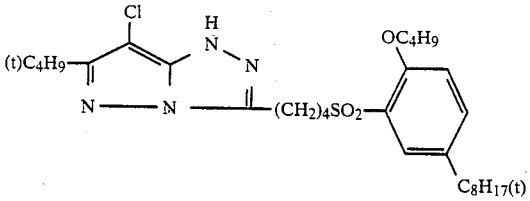
M-125
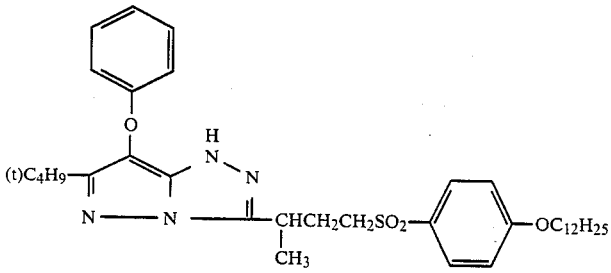
M-126
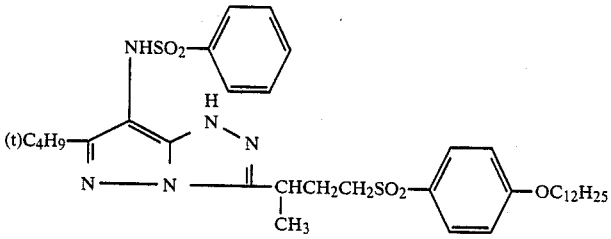
M-127
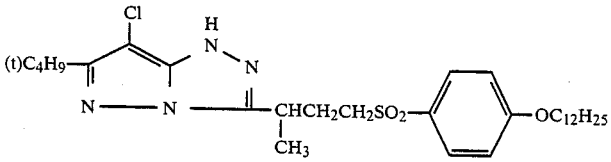
M-128
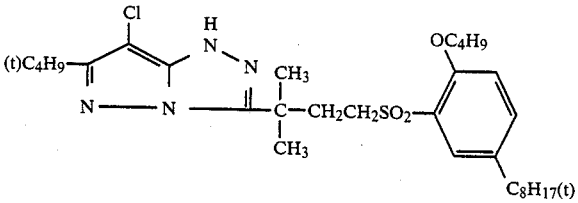
M-129
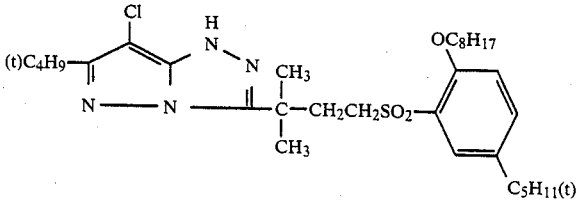

-continued
M-130
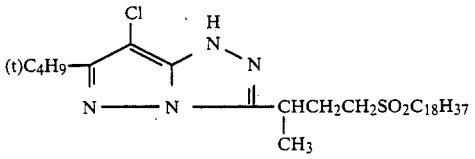
M-131
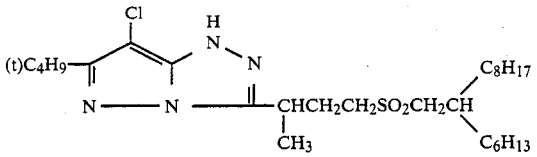
M-132
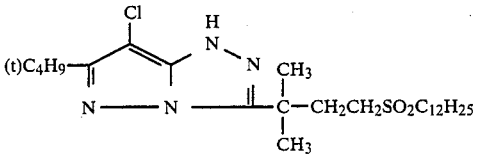
M-133
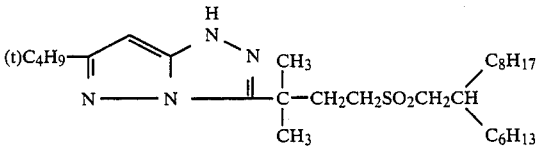
M-134
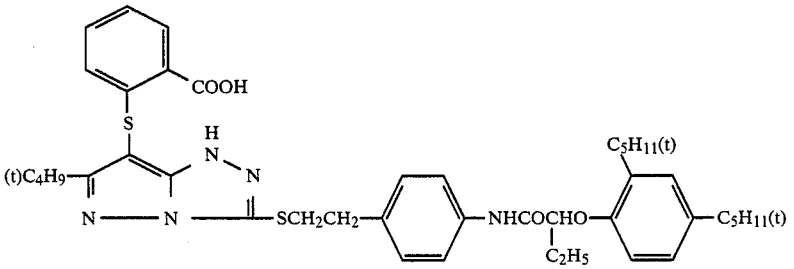
M-135
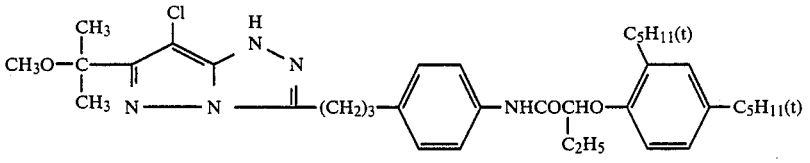
M-136
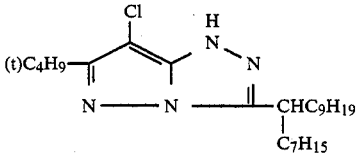
M-137
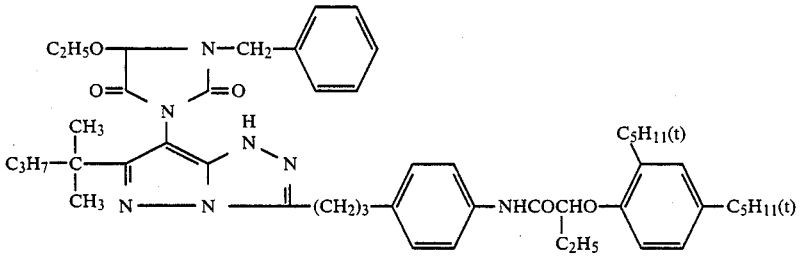

-continued
M-138
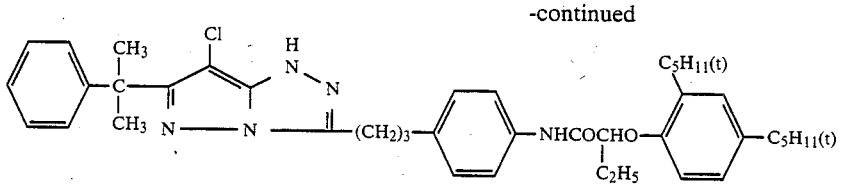
M-139
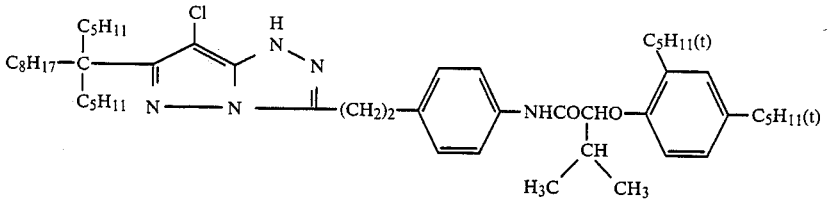
M-140
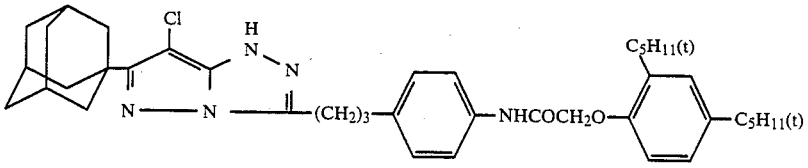
M-141
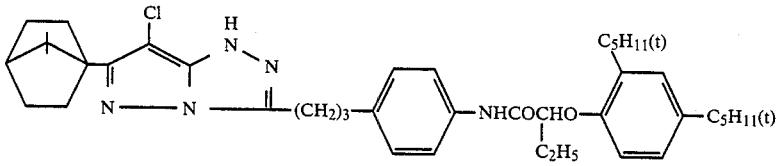
M-142
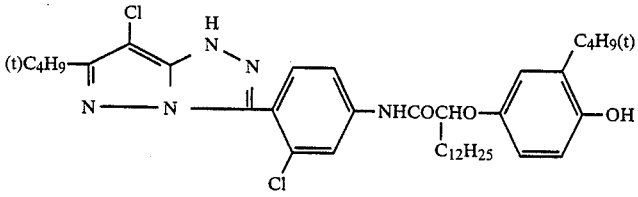
M-143
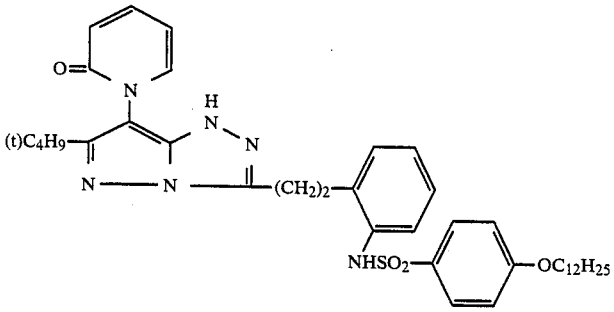
M-144
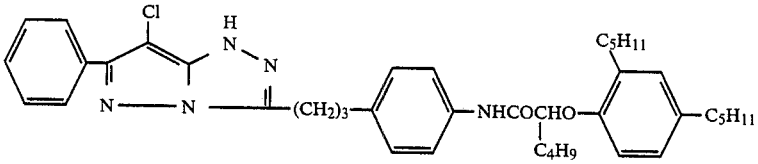
M-145
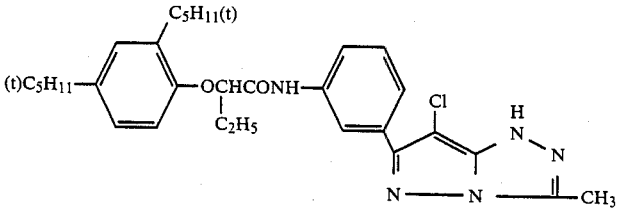

-continued
M-146
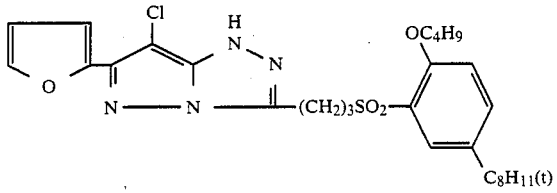
M-147
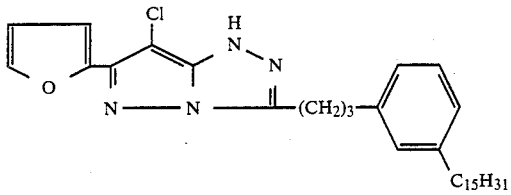
M-148
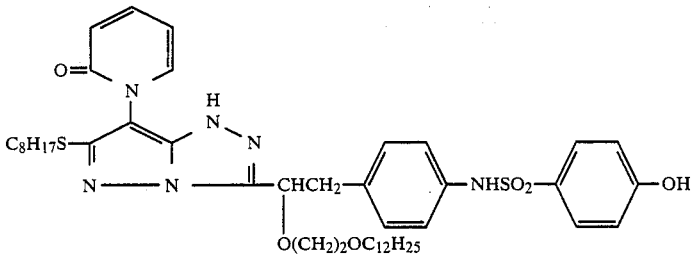
M-149
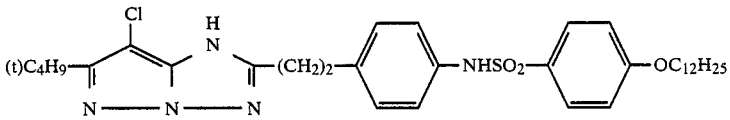
M-150
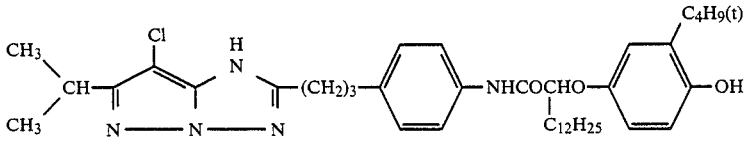
M-151
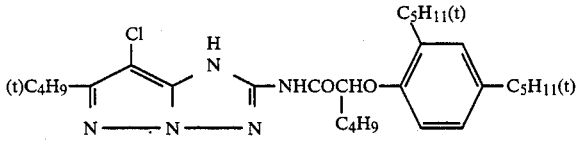
M-152
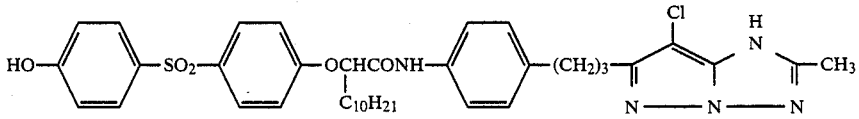
M-153
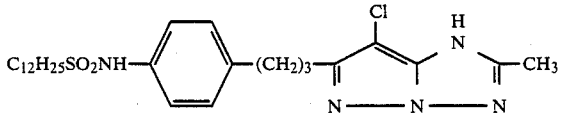
M-154
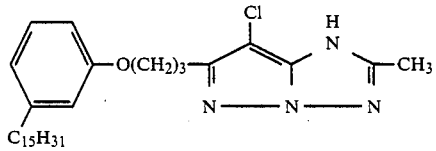

-continued
M-155
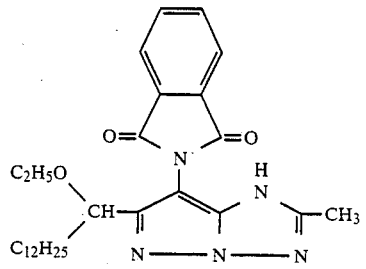
M-156
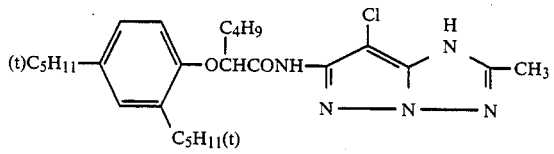
M-157
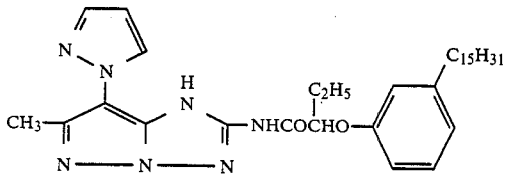
M-158
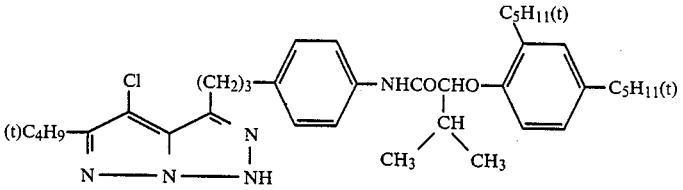
M-159
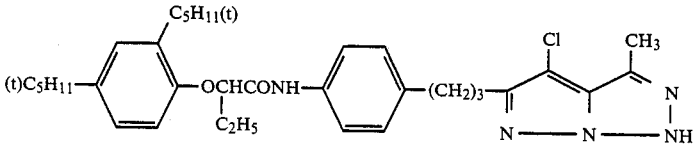
M-160
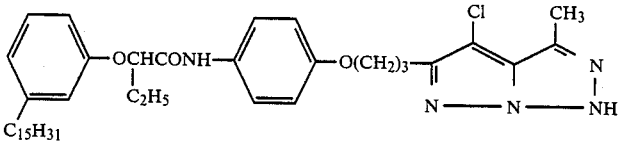
M-161
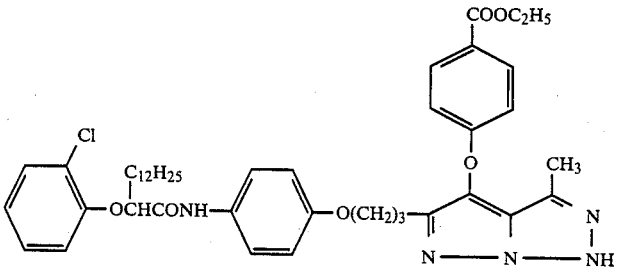
M-162
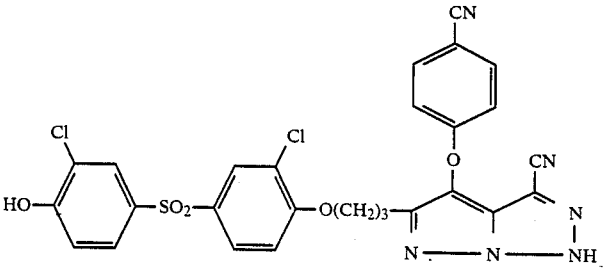

-continued
M-163
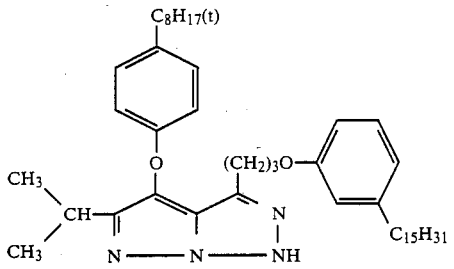
M-164
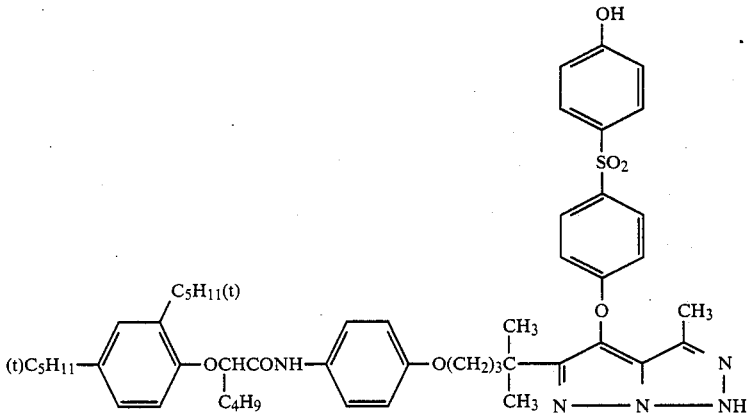
M-165
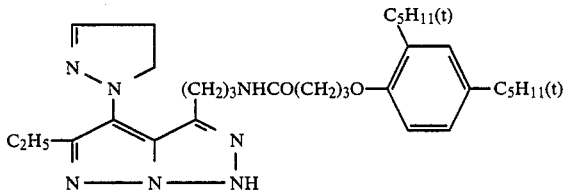
M-166
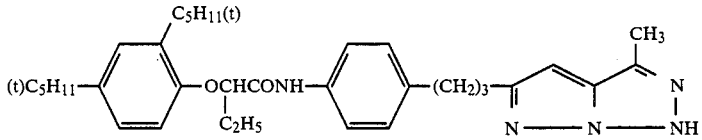
M-167
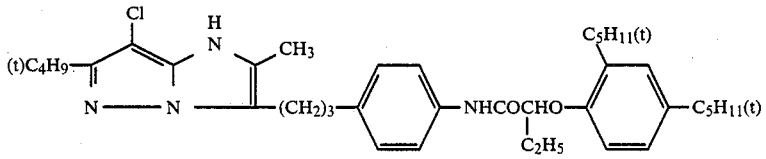
M-168
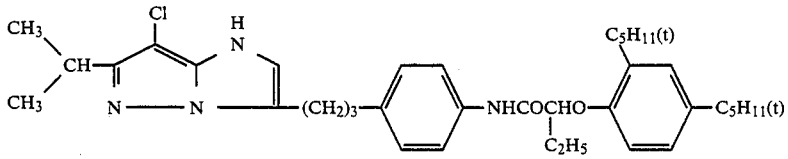
M-169
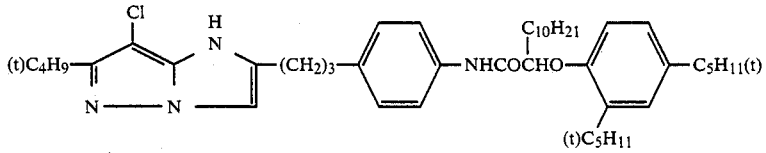

-continued
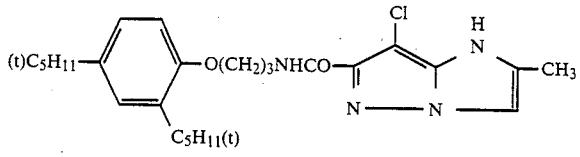
M-170
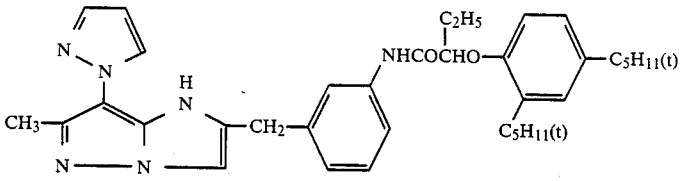
M-171
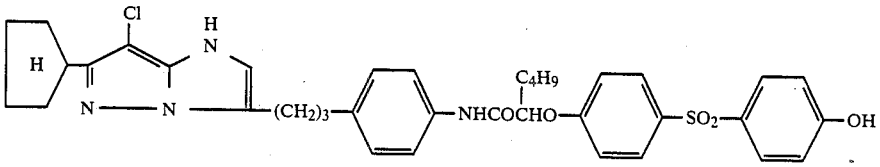
M-172
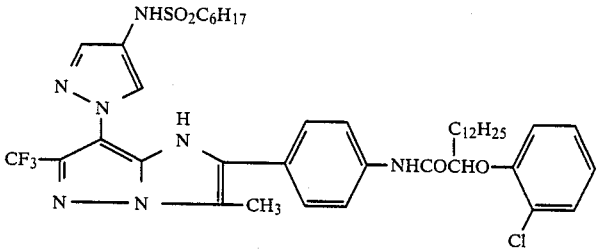
M-173
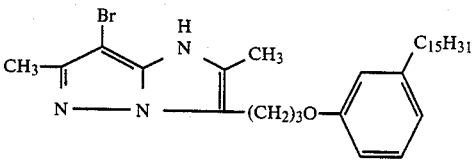
M-174
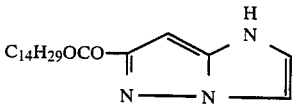
M-175
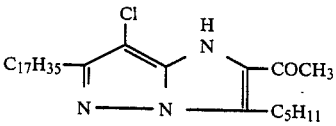
M-176
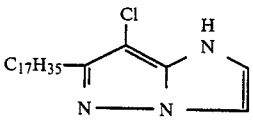
M-17
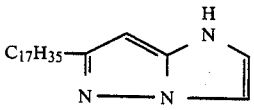
M-178
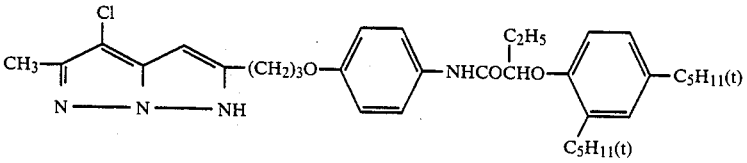
M-179

-continued
M-180
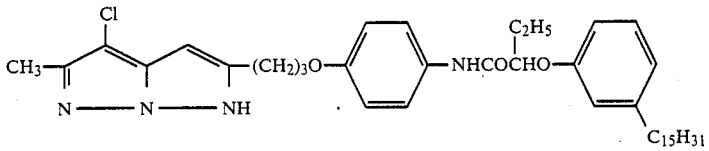
M-181
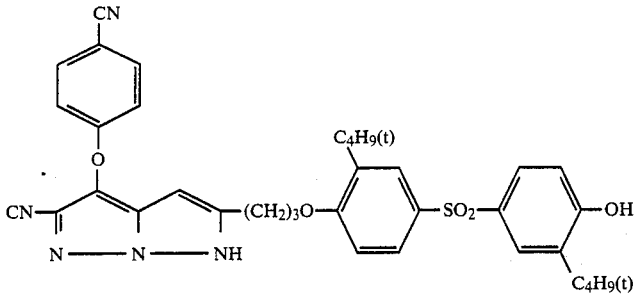
M-182
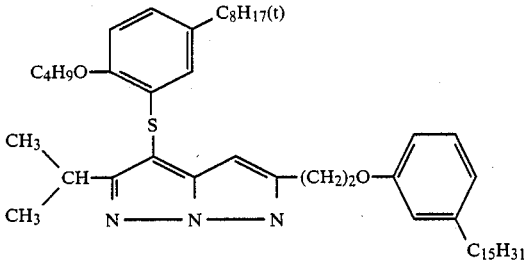
M-183
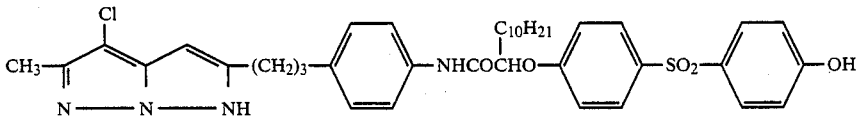
M-184
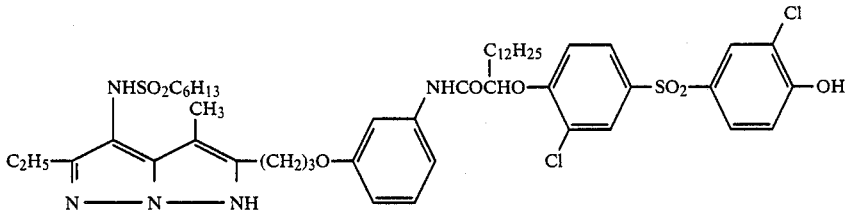
M-185
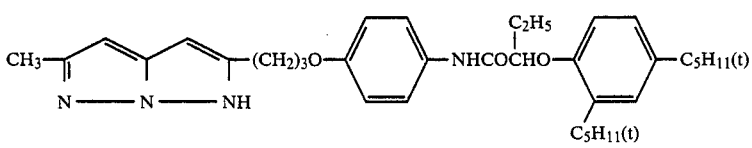
M-186
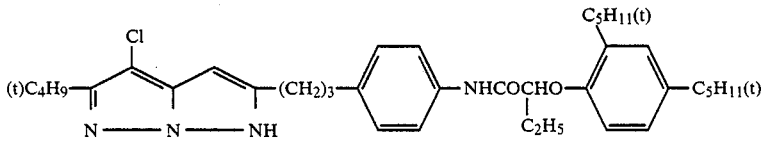
M-187
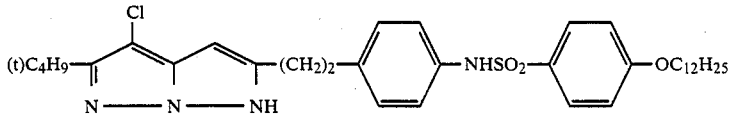

-continued
M-188
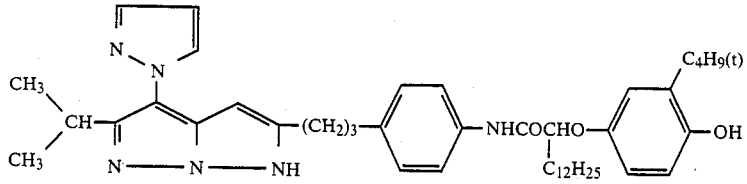
M-189
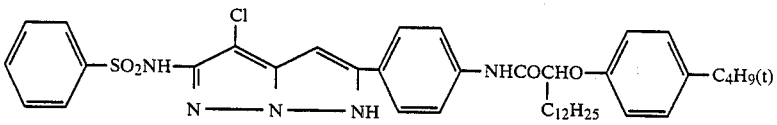
M-190
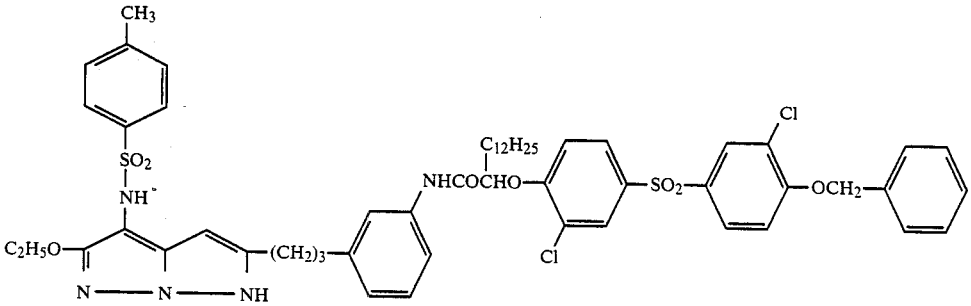
M-191
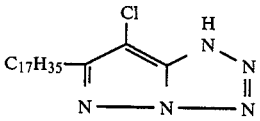
M-192
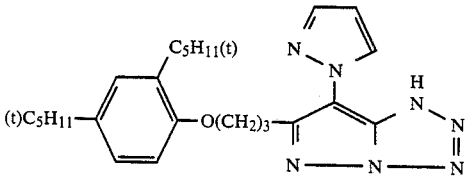
M-193
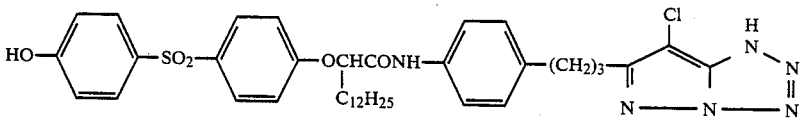
M-194
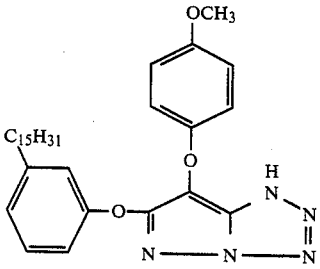

-continued

M-195

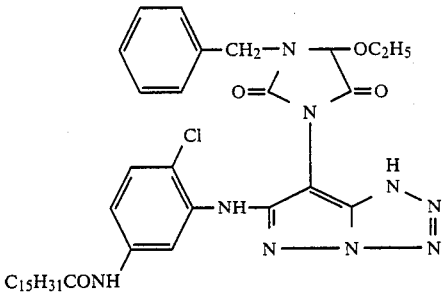

M-196

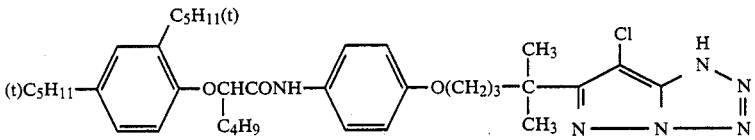

M-197

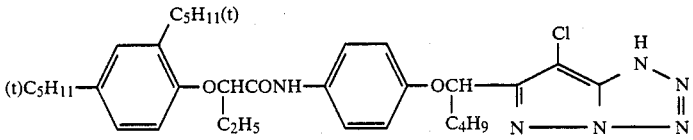

M-198

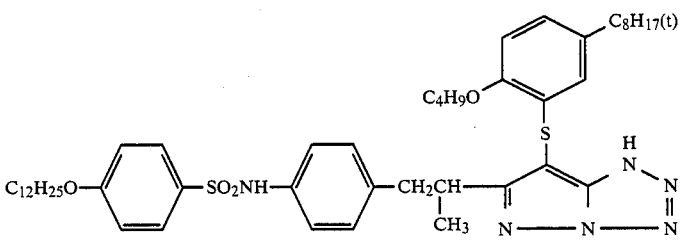

M-199

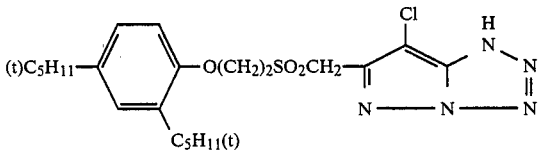

The above couplers were synthesized by referring to Journal of the Chemical Society, Perkin I (1977), pp. 2047-2052, U.S. Pat. No. 3,725,067, KOKAI Nos. 99437/1984 and 42045/1984.

The coupler of the present invention can be used in an amount generally within the range of from $1\times10^{-3}$ mole to 1 mole, preferably from $1\times10^{-2}$ to $8\times10^{-1}$ mole, per mole of the silver halide.

In practicing the processing method according to the present invention, preferred light-sensitive photographic materials are ones in which are least one layer of the silver halide emulsion layers contains one of the following cyan couplers represented by formulae (C), (C-I) and (C-II), respectively.

(C)

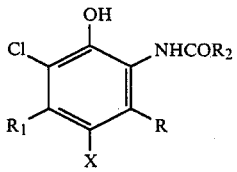

In formula (C), one of R and $R_1$ represents a hydrogen atom and the other is a straight or branched alkyl group having 2 to 12 carbon atoms; X represents a hydrogen atom or a group eliminable through the coupling reaction with an oxidized product of an aromatic primary amine series color developing agent; and $R_2$ represents a ballast group.

(C-I)

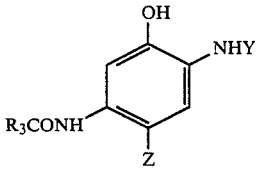

(C-II)

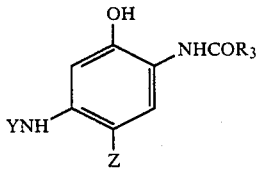

In formulae (C-I) and (C-II), Y represents

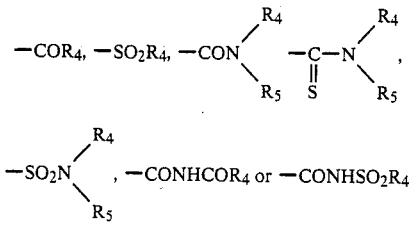

(where $R_4$ represents an alkyl group, an alkenyl group, a cycloalkyl group, an aryl group or a heterocyclic group; $R_5$ represents a hydrogen atom, an alkyl group, an alkenyl group, a cycloalkyl group, an aryl group or a heterocyclic group; and $R_4$ and $R_5$ may be bonded with each other to form a 5- or 6-membered ring); $R_3$ represents a ballast group; and Z represents a hydrogen atom or a group eliminable through the coupling reaction with the oxidized product of an aromatic primary amine series color developing agent.

While the cyan color forming coupler in accordance with the present invention can be represented by the above formulae (C), (C-1) and (C-2), the coupler of formula (C) will further be explained in the following.

In the present invention, the straight or branched alkyl group having2 to 12 carbon atoms represented by $R_1$ and R of the above formula (C) are, for example, an ethyl group, a propyl group, a butyl group.

In the formula (C), the ballast group represented by $R_2$ is an organic group having a size and form which affords a coupler molecule bulkiness sufficient to substantially prevent the coupler from diffusing from the layer in which it has been contained to the other layers. As the representative ballast group, there may be mentioned an alkyl group or an aryl group each having total carbon atoms of 8 to 32, preferably those having total carbon atoms of 13 to 28. As the substituent for the alkyl group and the aryl group, there may be mentioned, for example, an alkyl group, an aryl group, an alkoxy group, an aryloxy group, a carboxy group, an acyl group, an ester group, a hydroxy group, a cyano group, a nitro group, a carbamoyl group, a carbonamide group, an alkylthio group, an arylthio group, a sulfonyl group, a sulfonamide group, a sulfamoyl group, a halogen atom and the like, and as the substituent for the alkyl group, those as mentioned for the above aryl group except for the alkyl group.

Preferred ballast groups are represented by the following formula:

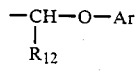

$R_{12}$ represents an alkyl group having 1 to 12 carbon atoms; and Ar represents an aryl group such as a phenyl group, etc. and the aryl group may have a substituent. As the substituent, an alkyl group, a hydroxy group, a halogen atom, an alkylsulfonamido group, etc. may be mentioned and the most preferred is a branched alkyl group such as a t-butyl group, etc.

The group represented by x in the above formula (C), which is capable of being released through the coupling reaction, determines not only the equivalence number of the coupler but also the reactivity thereof, as known well to one skilled in the art.

The representative examples for x includes halogen represented by chlorine and fluorine, an aryloxy group, a substituted or unsubstituted alkoxy group, an acyloxy group, a sulfonamido group, an arylthio group, a heteroylthio group, a heteroyloxy group, a sulfonyloxy group, a carbamoyloxy group and the like. As specific examples for x, there may be mentioned the groups as disclosed in KOKAI Nos. 10135/1975, 120334/1975, 130414/1975, 48237/1979, 146828/1976, 14736/1979, 37425/1972, 123341/1975 and 95346/1983, KOKOKU No. 36894/1973; and U.S. Pat. Nos. 3,476,563, 3,737,316 and 3,227,551.

Next, exemplary compounds of the cyan coupler represented by formula (C) are shown below, but the present invention is not limited by these compounds.

(Exemplary compounds)

| Coupler No. | $R_1$ | X | $R_2$ | R |
|---|---|---|---|---|
| C-1 | $-C_2H_5$ | $-H$ | 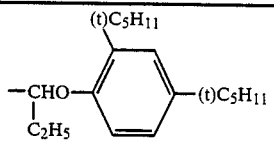 | $-H$ |
| C-2 | $-C_2H_5$ | $-Cl$ | 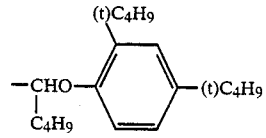 | $-H$ |
| C-3 | $-C_2H_5$ | $-H$ | 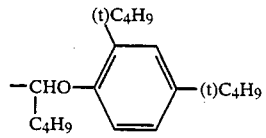 | $-H$ |
| C-4 | $-C_2H_5$ | $-Cl$ | 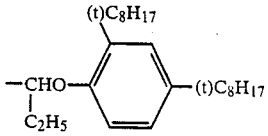 | $-H$ |

-continued
(Exemplary compounds)
| Coupler No. | $R_1$ | X | $R_2$ | R |
|---|---|---|---|---|
| C-5 | $-C_2H_5$ | $-Cl$ | 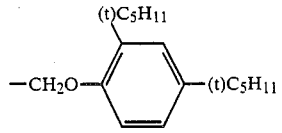 | $-H$ |
| C-6 | $-C_2H_5$ | 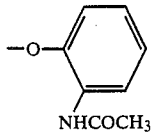 | 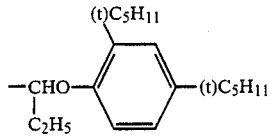 | $-H$ |
| C-7 | 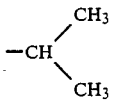 | $-Cl$ | 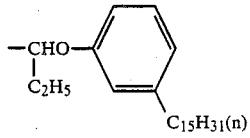 | $-H$ |
| C-8 | $-C_2H_5$ | $-Cl$ | 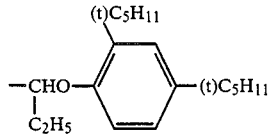 | $-H$ |
| C-9 | $-C_2H_5$ | $-Cl$ | 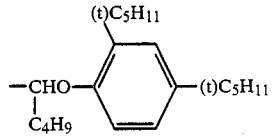 | $-H$ |
| C-10 | $-C_4H_9$ | $-F$ | 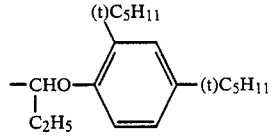 | $-H$ |
| C-11 | $-C_2H_5$ | $-F$ | 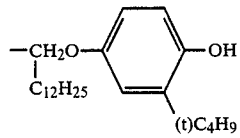 | $-H$ |
| C-12 | $-C_2H_5$ | $-Cl$ | 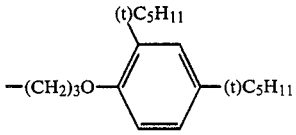 | $-H$ |
| C-13 | $-C_2H_5$ | $-F$ | 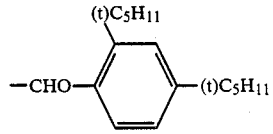 | $-H$ |
| C-14 | $-C_4H_9$ | $-Cl$ | 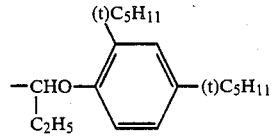 | $-H$ |

-continued
(Exemplary compounds)
| Coupler No. | $R_1$ | X | $R_2$ | R |
|---|---|---|---|---|
| C-15 | $-C_2H_5$ | $-Cl$ | 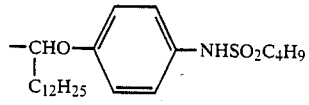 | $-H$ |
| C-16 | $-C_2H_5$ | $-Cl$ | 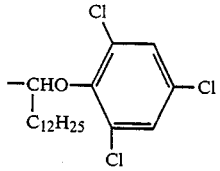 | $-H$ |
| C-17 | 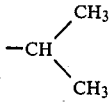 | $-Cl$ | $-C_{18}H_{37}$ | $-H$ |
| C-18 | $-C_2H_5$ | 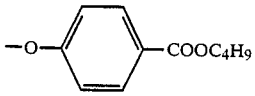 | 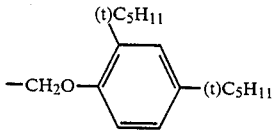 | $-H$ |
| C-19 | $-C_2H_5$ | $-F$ | 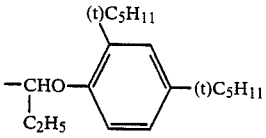 | $-H$ |
| C-20 | $-C_2H_5$ | $-Cl$ | 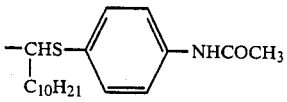 | $-H$ |
| C-21 | $-C_3H_7$ | $-Cl$ | 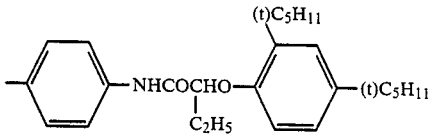 | $-H$ |
| C-22 | $-C_3H_7$ | $-Cl$ | 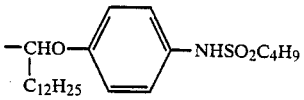 | $-H$ |
| C-23 | $-C_2H_4NHCOCH_3$ | $-Cl$ | 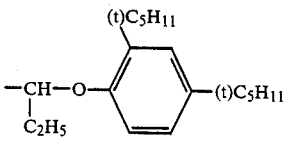 | $-H$ |
| C-24 | $-C_3H_6OCOH_3$ | $-Cl$ | 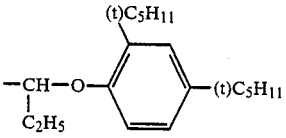 | $-H$ |
| C-25 | $-H$ | $-Cl$ | 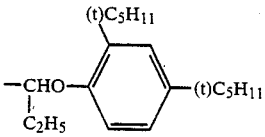 | $-C_2H_5$ |

-continued (Exemplary compounds)

| Coupler No. | $R_1$ | X | $R_2$ | R |
|---|---|---|---|---|
| C-26 | —H | —Cl | 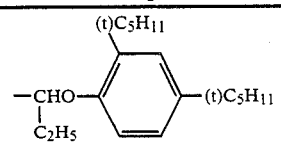 | $-C_3H_7$ |
| C-27 | —H | —Cl | 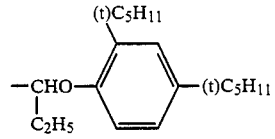 | $-C_5H_{11}$ |
| C-28 | $-C_2H_5$ | —Cl | 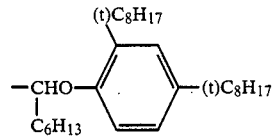 | —H |

In the following, the synthesis method for obtaining some of the exemplary compounds are shown, but the other exemplary compounds can also be synthesized similarly.

SYNTHESIS OF EXEMPLARY COMPOUND C-5

[(1)-a] Synthesis of 2-nitro-4,6-dichloro-5-ethylphenol

In 150 ml of glacial acetic acid were dissolved 33 g of 2-nitro-5-ethylphenol, 0.6 g of iodine and 1.5 g of ferric chloride. To the mixture was added dropwise 75 ml of sulfuryl chloride at 40° C. over 3 hours. After completion of the dropwise addition of the sulfuryl chloride, precipitates formed during the dropwise addition reacted and dissolved by heating under reflux.

It took about 2 hours for the heating under reflux. Then, the reaction mixture was poured into water and the formed crystals were purified by recrystallization from methaol. Confirmation of (1)-a was carried out by the nuclear magnetic resonance spectrum and the elemental analysis.

[(1)-b] Synthesis of 2-amino-4,6-dichloro-5-ethylphenol

In 300 ml of alcohol was dissolved 21.2 g of the above compound [(1)-a], and to the solution was added a catalytic amount of Raney nickel and hydrogen was passed therethrough under ambient pressure until no hydrogen absorption was observed. After the reaction, the Raney nickel was removed and the alcohol was distilled out under reduced pressure. The resulting residue was employed in the next acylation step without purification.

[(1)-c] Synthesis of 2-[(2,4-di-tert-acylphenoxy)acetamido]-4,6-dichloro-5-ethylphenol In a mixed solution comprising 500 ml of glacial acetic acid and 16.7 g of sodium acetate was dissolved a crude amino derivative obtained in [(1)-b], and to the resulting solution was added dropwise at room temperature an acetic acid solution which had dissolved 28.0 g of 2,4-di-tert-aminophenoxyacetic acid chloride in 50 ml of acetic acid. The acetic solution was added dropwise for 30 minutes, and after further stirring for 30 minutes, the reaction mixture was poured into ice-cold water. After the formed precipitates were collected by iltration and dried, recrystallized twice from acetnitrile to obtain the title compound. Identification of the title compound was carried out by the elemental analysis and the nuclear magnetic resonance spectrum.

| | $C_{21}H_{35}NO_3Cl_2$ | | | |
|---|---|---|---|---|
| | C | H | N | Cl |
| Calculated (%) | 65.00 | 7.34 | 2.92 | 14.76 |
| Observed (%) | 64.91 | 7.36 | 2.99 | 14.50 |

Next, the cyan coupler represented by the formulae (C-I) or (C-II) to be used in the present invention will be explained. In the above formulae (C-I)) and (C-II)), Y is a group represented by

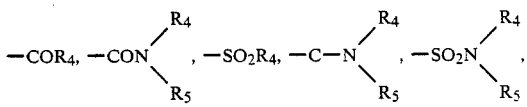

$-CONHCOR_4$ or $-CONHSO_2R_4$.

In these formulae, $R_4$ represents an alkyl group, preferably an alkyl group having 1 to 20 carbon atoms (e.g. a methyl group, an ethyl group, a t-butyl group, a dodecyl group, etc.), an alkenyl group, preferably an alkenyl group having 2 to 20 carbon atoms (e.g. an allyl group, a heptadecenyl group, etc.), a cycloalkyl group, preferably that of 5 to 7-membered ring (e.g. a cyclohexyl group, etc.), an aryl group (e.g. a phenyl group, a tolyl group, a naphthyl group, etc.), or a heterocyclic group, preferably a 5-membered or 6-membered heterocyclic ring containing 1 to 4 nitrogen atoms, oxygen atoms or sulfur atoms (e.g. a furyl group, a thienyl group, a benzothiazolyl group, etc.). $R_5$ represents a hydrogen atom or a group represented by $R_4$. $R_4$ and $R_5$ may be bound to each other to form a 5- or 6-membered heterocyclic ring containing a nitrogen atom. $R_4$ and $R_5$ may optionally have a substituent or substituents including, for example, an alkyl group having 1 to 10 carbon atom (e.g. ethyl, i-propyl, i-butyl, t-butyl, t-oxtyl, etc.), an aryl group (e.g. phenyl, naphthyl, etc.), a halogen atom (fluorine, chlorine, bromine, etc.), a cyano group, a nitro group, a sulfonamido group (e.g. methansulfonamido, butansulfonamido, p-toluenesulfonamido, etc.), a sulfamoyl group (e.g. methylsulfamoyl, phenylsulfamoyl, etc.), a sulfonyl group (e.g. methansulfonyl, p-toluenesulfonyl, etc.), a fluorosulfonyl group, a carbamoyl group (e.g. dimethylcarbamoyl, phenylcarbamoyl, etc.), an oxycarbonyl group (e.g. ethoxycarbonyl, phenoxycarbonyl, etc.), an acyl group (e.g. acetyl, benzoyl, etc.), a heterocyclic group (e.g. a pyridyl group, a pyrazolyl group, etc.), an alkoxy group, an aryloxy group, an acyloxy group and the like.

In formulae (C-I) and (C-II), $R_3$ represents a ballast group necessary for providing a diffusion resistance to the cyan coupler represented by formulae (C-I) and (C-II)) and a cyan dye derived from said cyan coupler. Preferably, $R_3$ may be an alkyl group having 4 to 30 carbon atoms, an aryl group or a heterocyclic group. For example, $R_3$ may include a straight or branched alkyl group (e.g. t-butyl, n-octyl, t-octyl, n-dodecyl, etc.), an alkenyl group, a cycloalkyl group, a 5-membered or 6-membered heterocyclic group and the like.

In formulae (C-I) and (C-II), Z represents a hydrogen atom or a group eliminable through the coupling reaction with an aromatic primary amine color developing agent. For example, z may include a halogen atom (e.g. chlorine, bromine, fluorine, etc.), a substituted or unsubstituted alkoxy, aryloxy, heterocyclyloxy, acyloxy, carbamoyloxy, sulfonyloxy, alkylthio, arylthio, heterocyclicthio or sulfonamido group, and more specifically, those as disclosed in U.S. Pat. No. 3,741,563, KOKAI No. 37425/1972, KOKOKU No. 36894/1973, KOKAI Nos. 10135/1975, 117422/1975, 130441/1975, 108841/1976, 120343/1975, 18315/1977, 105226/1978, 14736/1980, 48237/1979, 32071/1980, 65957/1980, 1938/1981, 12643/1981, 27147/1981, 146050/1984, 166956/1984, 24547/1985, 35731/1985 and 37557/1985.

In the present invention, of the cyan couplers represented by the above formulae (C-I) or (C-II), the cyan couplers represented by the following formula (C-III), (C-IV) or (C-V) are more preferred.

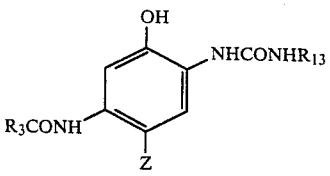

(C-III)

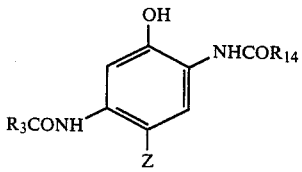

(C-IV)

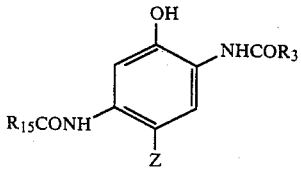

(C-V)

In formula (C-III), $R_{13}$ is a substituted or unsubstituted aryl group (particularly preferred is a phenyl group). As the substituent for said aryl group represented by $R_{13}$, they may be mentioned at least one substituent selected from $-SO_2R_{16}$, a halogen atom (e.g. fluorine, bromine, chlorine, etc.), $-CF_3$, $-NO_2$, $-CN$, $-COR_{16'}$ $-COOR_{16'}$ $-SO_2OR_{16'}$

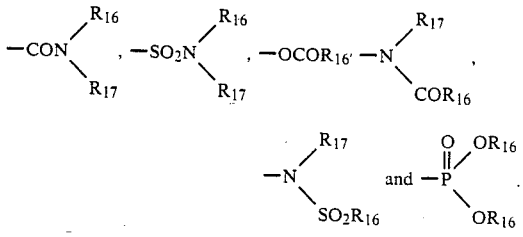

In the above, $R_{16}$ represents an alkyl group, preferably an alkyl group having 1 to 20 carbon atoms (e.g. methyl, ethyl, tert-butyl, dodecyl, etc.), an alkenyl group, preferably an alkenyl group having 2 to 20 carbon atoms (e.g. an aryl group, a heptadecenyl group, etc.), a cycloalkyl group, preferably 5 to 7-membered ring group (e.g. a cyclohexyl group, etc.), an aryl group (e.g. a phenyl group, a tolyl group, a naphthyl group, etc.); and $R_{17}$ is a hydrogen atom or a group represented by the above $R_{16}$.

The preferred compounds of the phenol type cyan coupler represented by (C-III) includes a compound in which $R_{13}$ is a substituted or unsubstituted phenyl group, and the substituent for the phenyl group includes a cyano group, a nitro group, $-SO_2R_{18}$ (in which $R_{18}$ is an alkyl group), a halogen atom or a trifluoromethyl group.

In the formulae (C-III) and (C-V), $R_{14}$ and $R_{15}$ each represent an alkyl group, preferably an alkyl group having 1 to 20 carbon atoms (e.g. methyl, ethyl, tert-butyl, dodecyl, etc.), an alkenyl group, preferably an alkenyl group having 2 to 20 carbon atoms (e.g. allyl, oleyl, etc.), a cycloalkyl group, preferably a 5 to 7-membered cyclic group (e.g. cyclohexyl, etc.), an aryl group (e.g. a phenyl group, a tolyl group, a naphthyl group, etc.), a heterocyclic group (preferably a hetero ring of 5-membered or 6 membered ring having 1 to 4 hetero atoms or a nitrogen atom, an oxygen atom or a sulfur atom, such as a furyl group, a thienyl group, a benzothiazolyl group, etc.), and the like.

In the aforesaid $R_{16}$ and $R_{17}$, and $R_{14}$ and $R_{15}$ of formulae (C-III) and (C-V), optional substituents may be introduced therein, and such substituents may be those which may be introduced in $R_4$ and $R_5$ in formulae (C-I) and (C-II) as mentioned abofe. As the substituents, a halogen atom (a chlorine atom, a fluorine atom, etc.) is particularly preferred.

In the above formulae (C-III), (C-IV) and (C-V), Z and $R_3$ each have the same meanings as in formulae (C-I) and (C-II). Preferred examples of the ballast group represented by $R_3$ is a group represented by the following formula (C-VI):

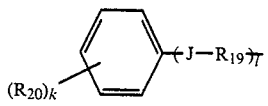

(C-VI)

In the formula, J represents an oxygen atom, a sulfur atom or a sulfonyl group; k represents an integer of 0 to 4; l represents 0 or 1; provided that k is 2 or more, 2 or more of $R_{20}$ may be the same or different from each other; $R_{19}$ represents a straight or branched alkylene group having 1 to 20 carbon atoms which may be substituted by an aryl group, etc.; $R_{20}$ represents a monovalent group, preferably a hydrogen atom, a halogen atom (e.g., chlorine, bromide, etc.), an alkyl group, preferably a straight or branched alkyl group having 1 to 20 carbon atoms (e.g. methyl, t-butyl, t-pentyl, t-octyl, dodecyl, pentadecyl, benzyl, phenethyl, etc.), an aryl group (e.g. a phenyl group), a heterocyclic group (preferably a nitrogen containing heterocyclic group), an alkoxy group, preferably a straight or branched alkoxy group having 1 to 20 carbon atoms (e.g. methoxy, ethoxy, t-butyloxy, octyloxy, decyloxy, dodecyloxy, etc.), an aryloxy group (e.g. a phenoxy group), a hydroxy group, an acyloxy group, preferably an alkylcarbonyloxy group, an arylcarbonyloxy group (e.g. an acetoxy group, a benzoyloxy group), a carboxy group, an alkyloxycarbonyl group, preferably a straight or branched alkyloxycarbonyl group having 1 to 20 carbon atoms, an aryloxycarbonyl group, preferably a phenoxycarbonyl group, an alkylthio group preferably having 1 to 20 carbon atoms, an acyl group, a straight or branched alkylcarbonyl group which may preferably having 1 to 20 carbon atoms, an acylamino group, a straight or branched alkylcarboamide group which may preferably having 1 to 20 carbon atoms, a benzenecarboamido group, a sulfonamido group, preferably a straight or branched alkylsulfonamido group which may preferably have 1 to 20 carbon atoms or a benzenesulfonamido group, a carbamoyl group, a straght or branched alkylaminocarbonyl group which may preferably have 1 to 20 carbon atoms or a phenylaminocarbonyl group, a sulfamoyl group, a straight or branched alkylaminosulfonyl group which may preferably have 1 to 20 carbon atoms or a phenylaminosulfonyl group, and the like.

Next, representative exemplary compounds of the cyan coupler represented by formula (C-I) or (C-II) will be shown below, but the present invention is not limited by these compounds.

C'-1

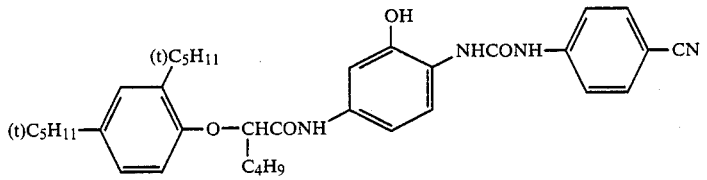

C'-2

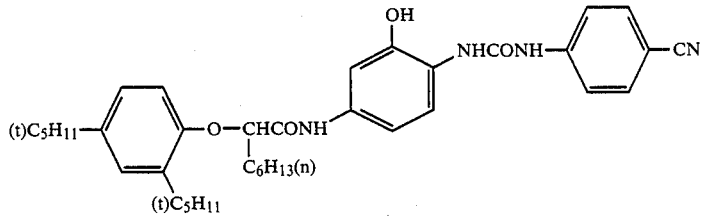

C'-3

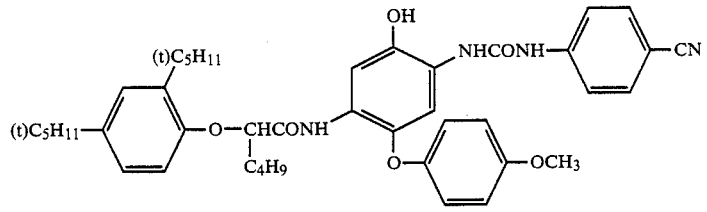

C'-4

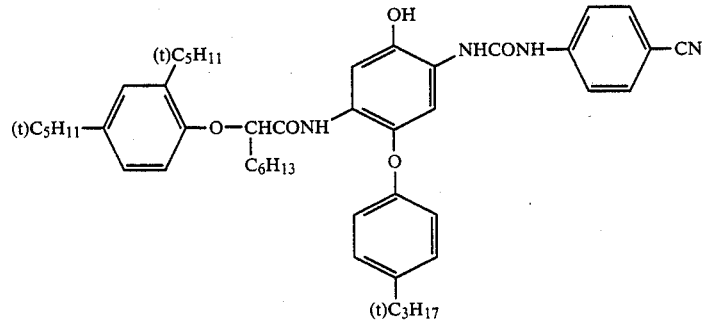

C'-5

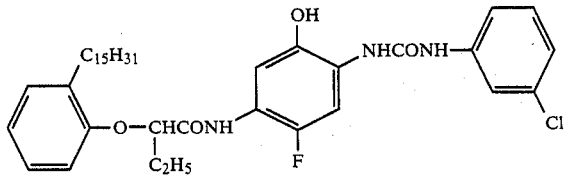

-continued
C'-6
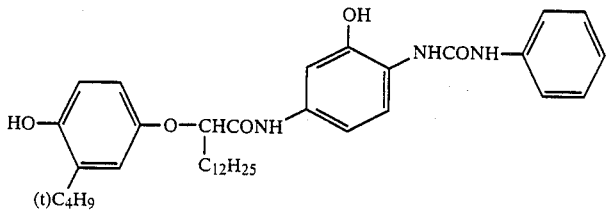
C'-7
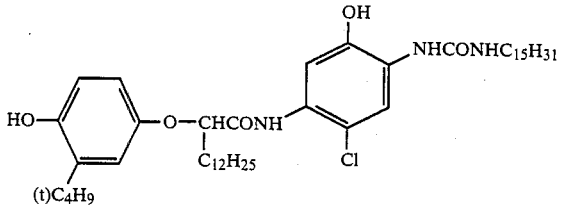
C'-8
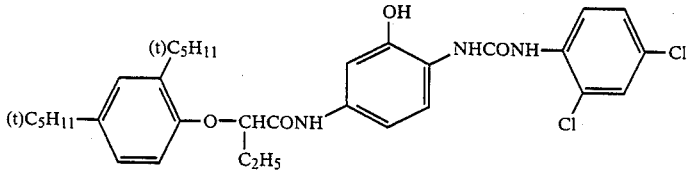
C'-9
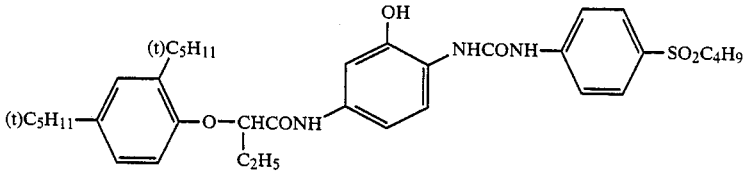
C'-10
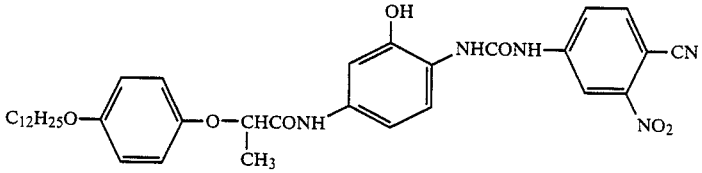
C'-11
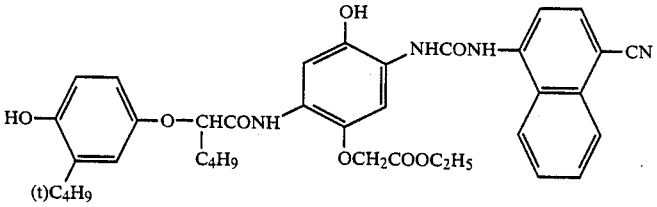
C'-12
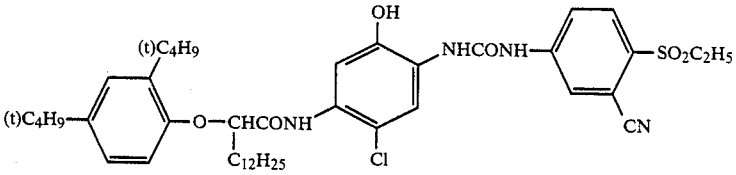
C'-13
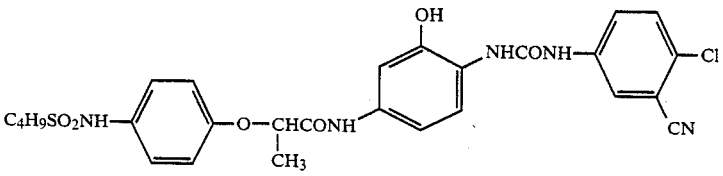

-continued
C'-14
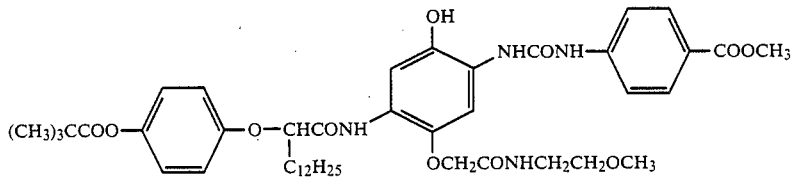
C'-15
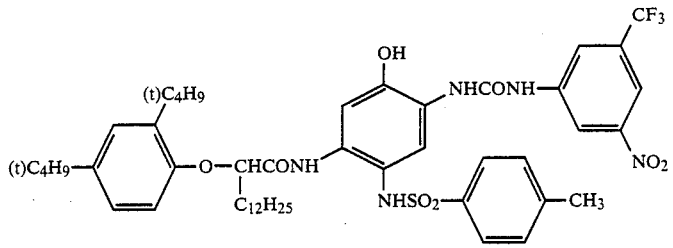
C'-16
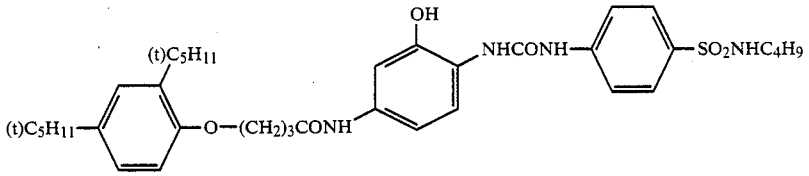
C'-17
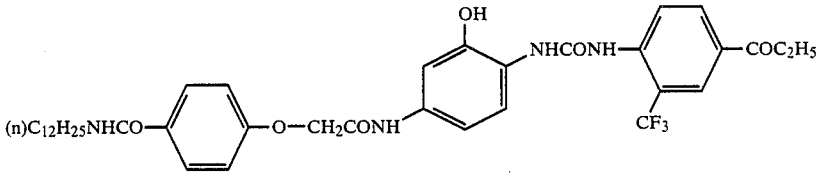
C'-18
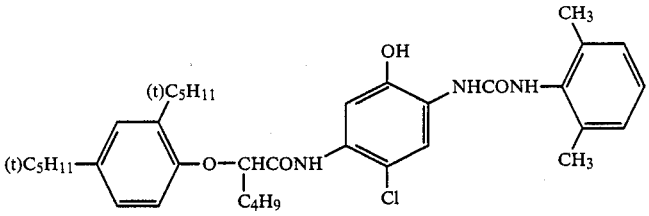
C'-19
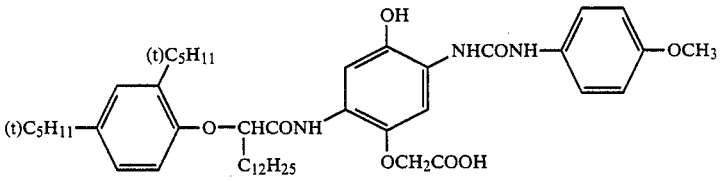
C'-20
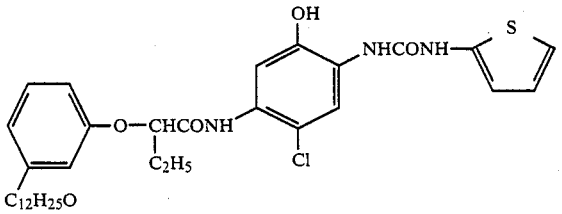

-continued
C'-21
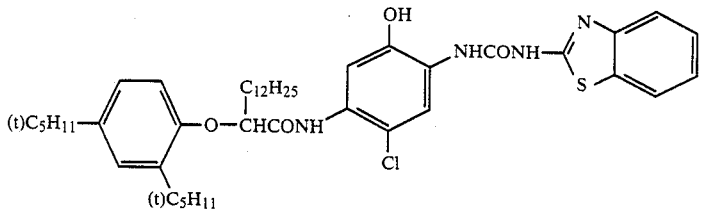
C'-22
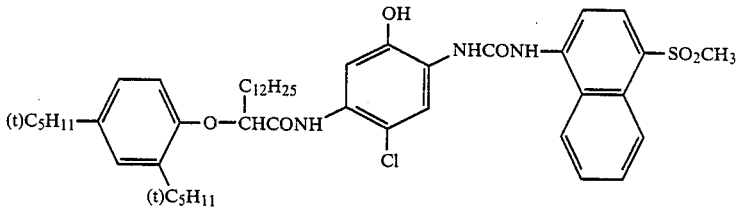
C'-23
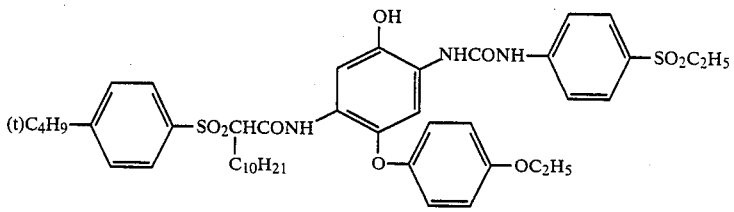
C'-24
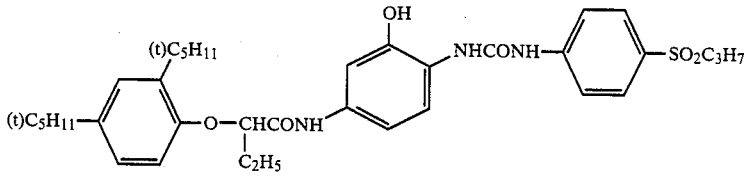
C'-25
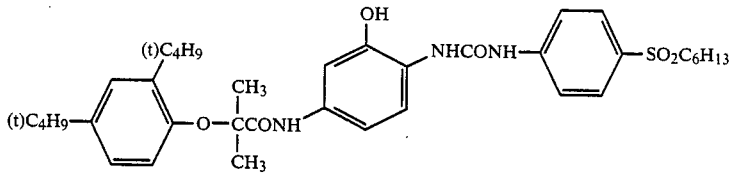
C'-26
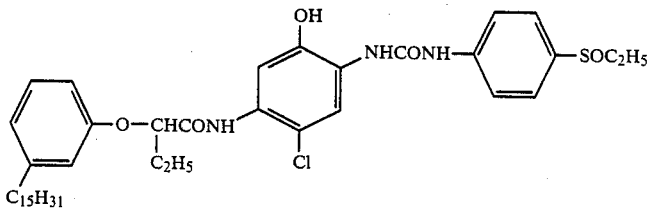
C'-27
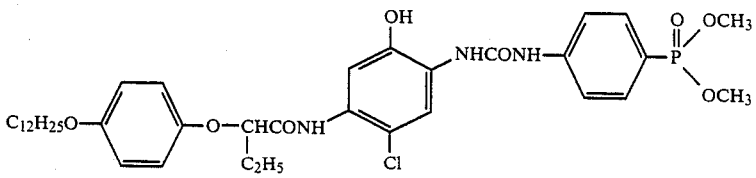

-continued
C'-28
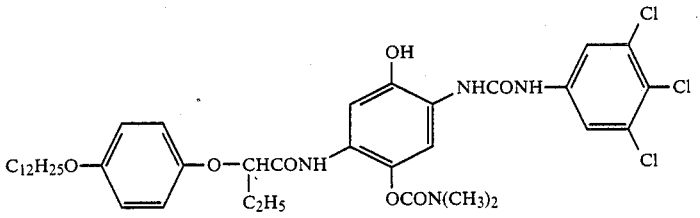
C'-29
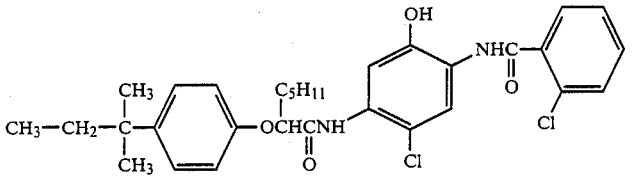
C'-30
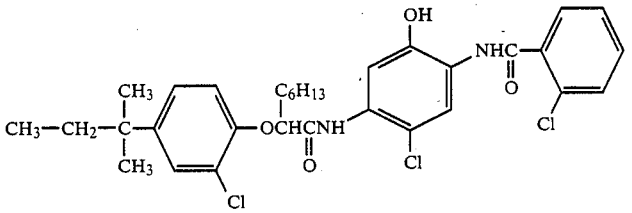
C'-31
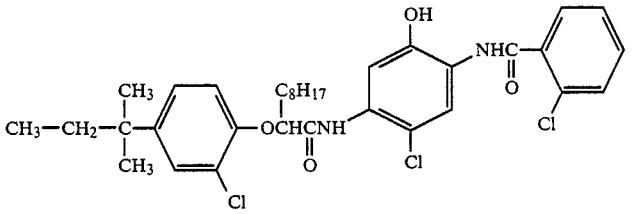
C'-32
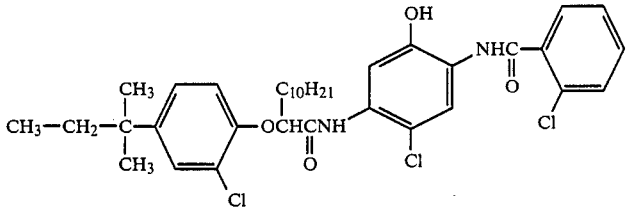
C'-33
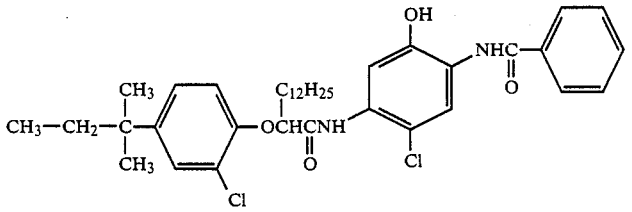
C'-34
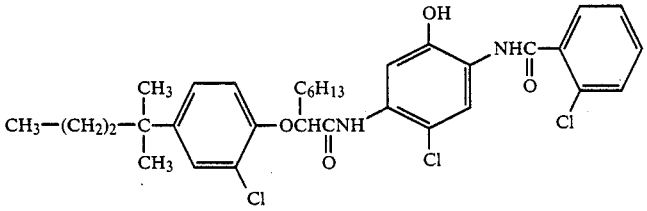

-continued
C'-35
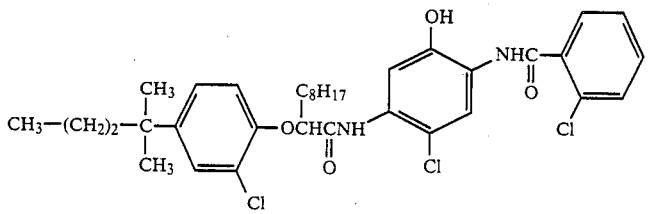
C'-36
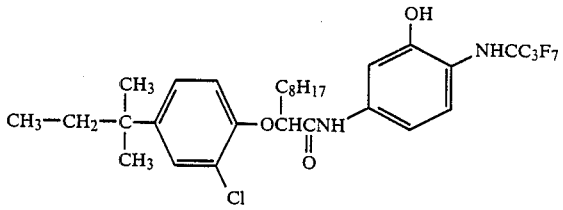
C'-37
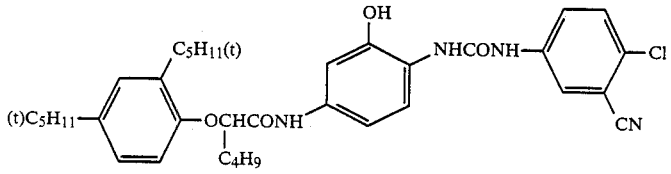
C'-38
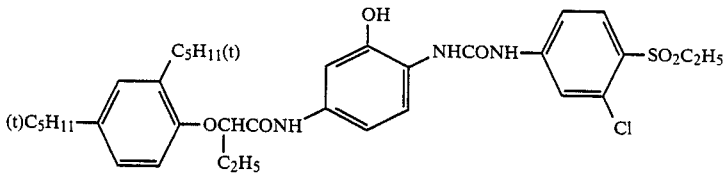
C'-39
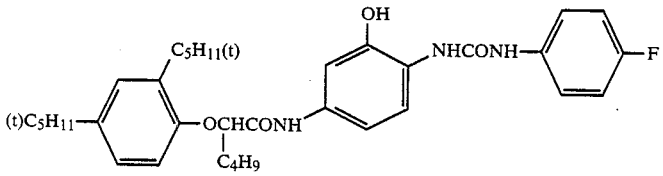
C'-40
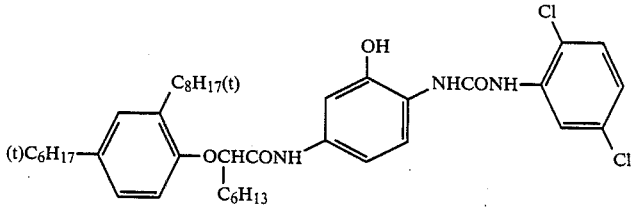
C'-41
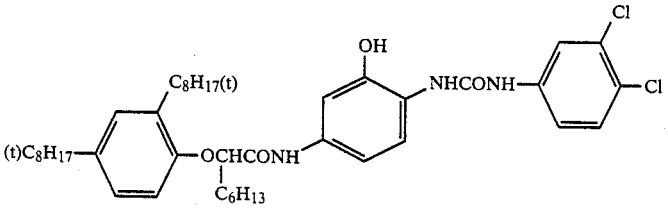
C'-42
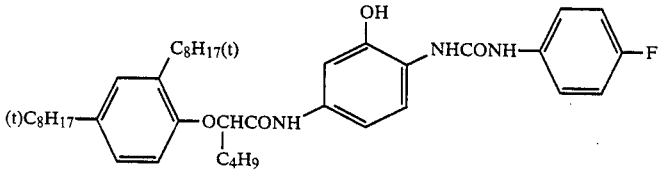

-continued
C'-43
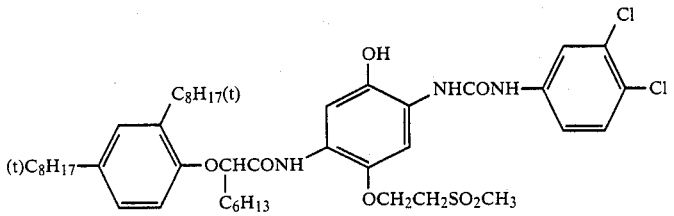
C'-44
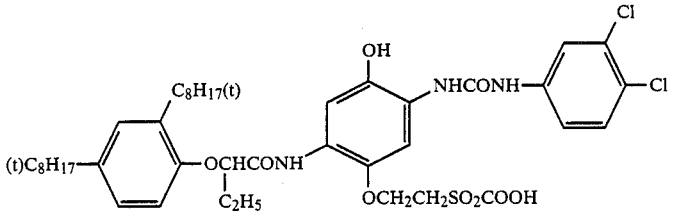
C'-45
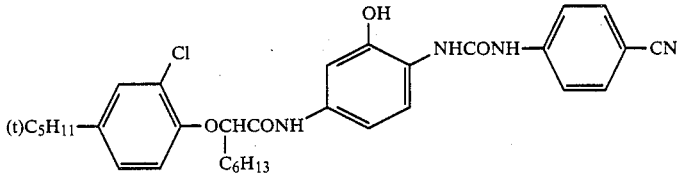
C'-46
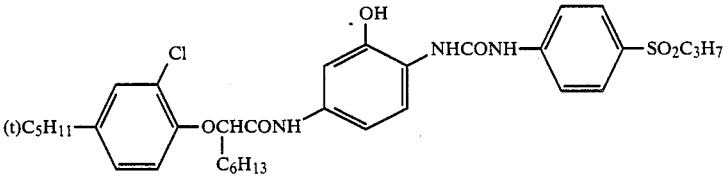
C'-47
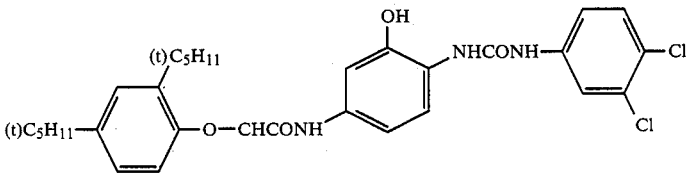
C'-48
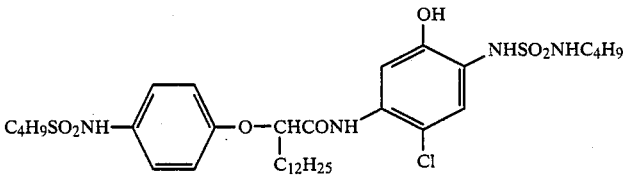
C'-49
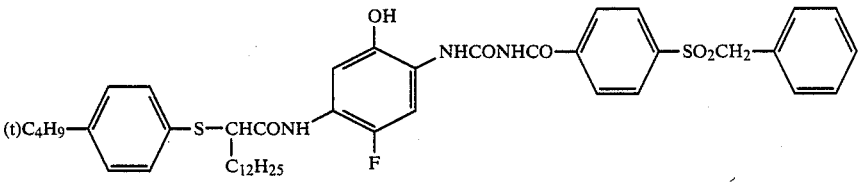
C'-50
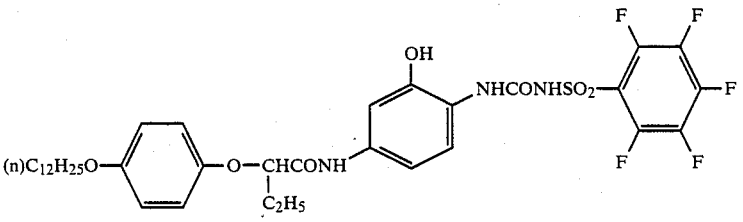

-continued
C'-51
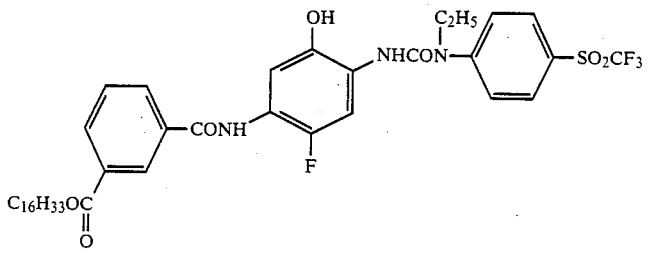
C'-52
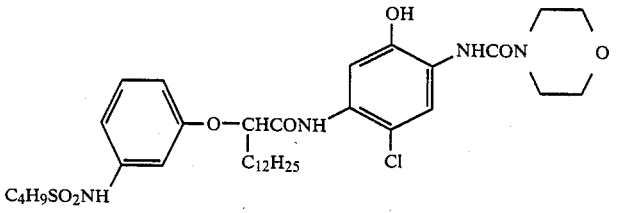
C'-53
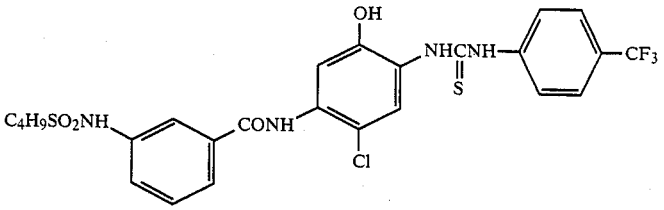
C'-54
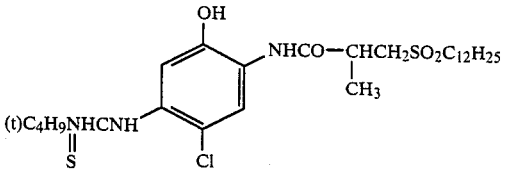
C'-55
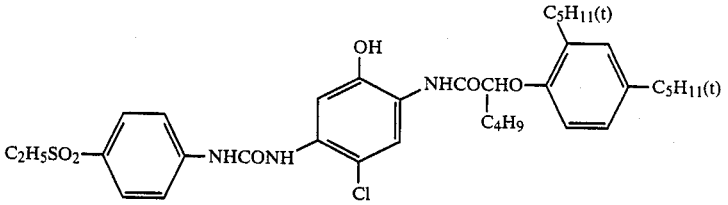
C'-56
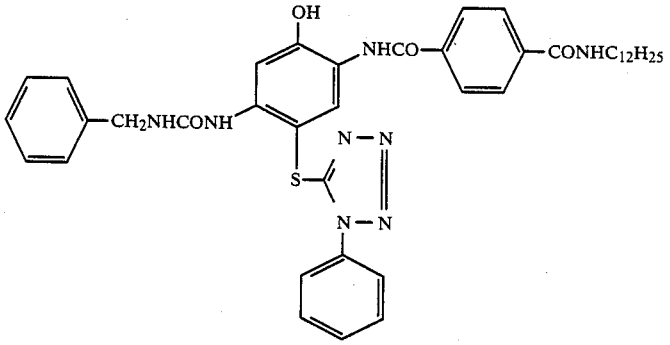
C'-57
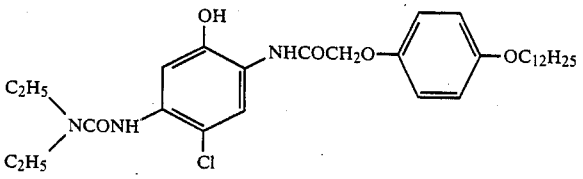

-continued
C'-58
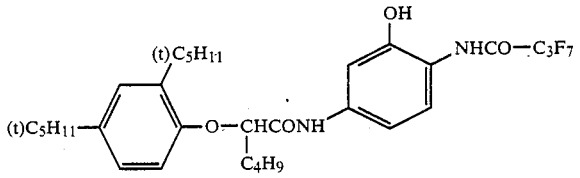
C'-59
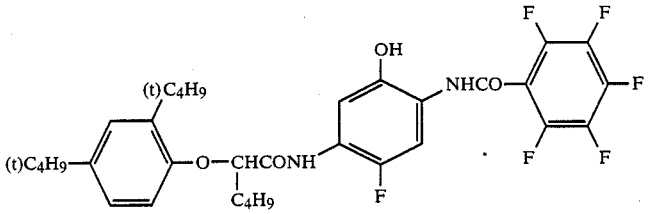
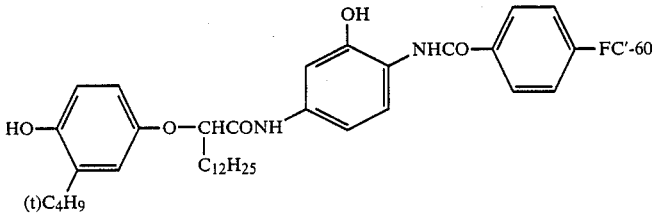
C'-61
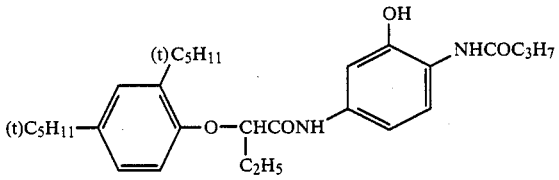
C'-62
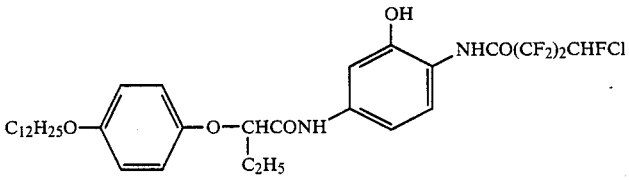
C'-63
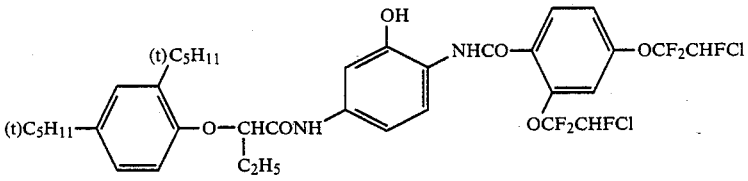
C'-64
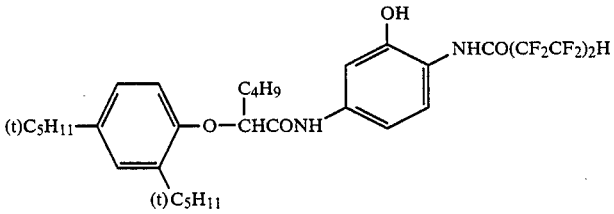
C'-65
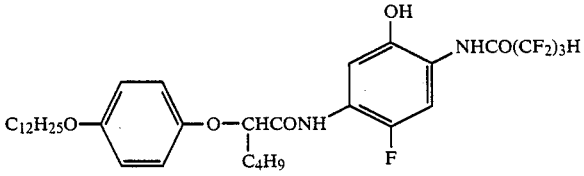

-continued
C'-66
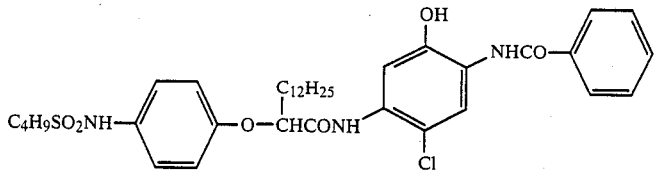
C'-67
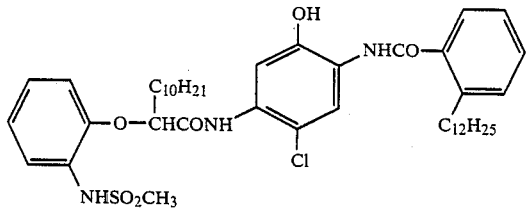
C'-68
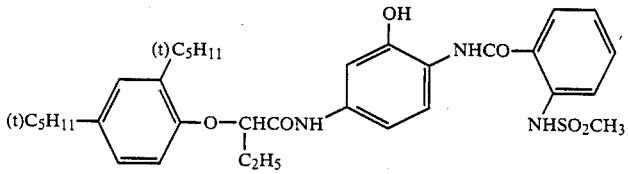
C'-69
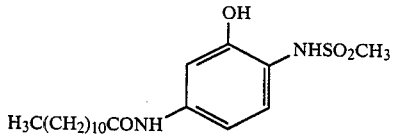
C'-70
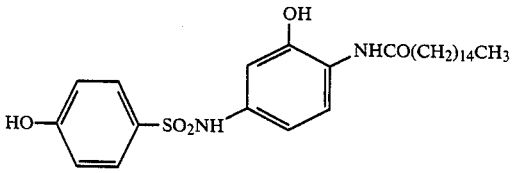
C'-71
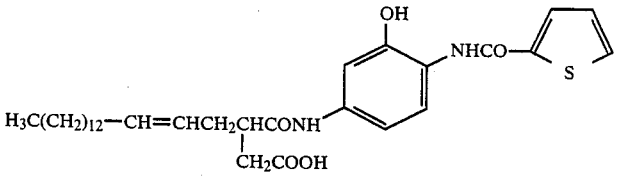
C'-72
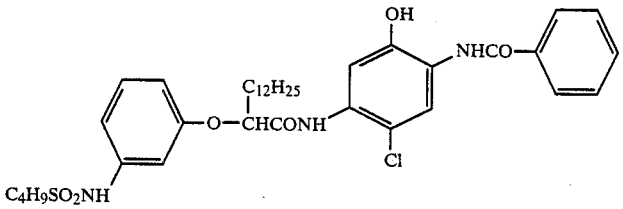
C'-73
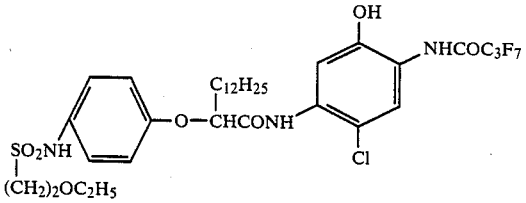

-continued
C'-74
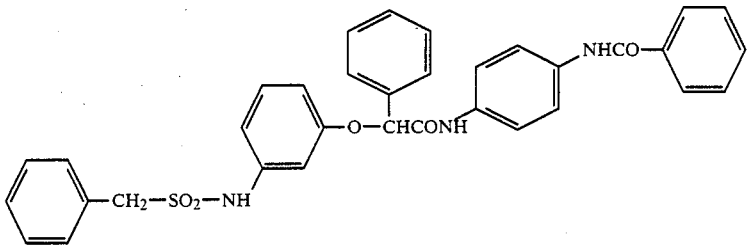
C'-75
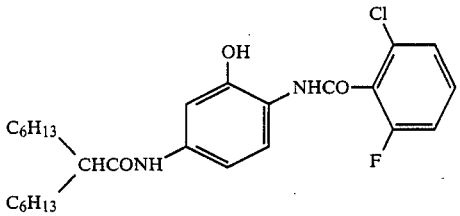
C'-76
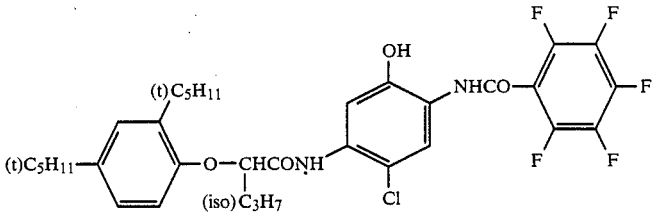
C'-77
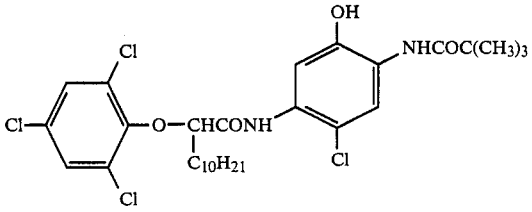
C'-78
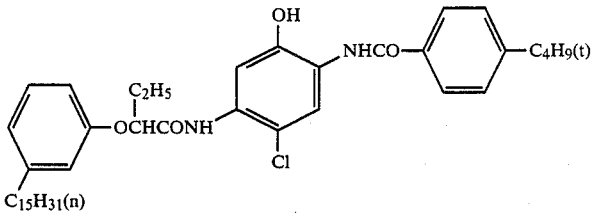
C'-79
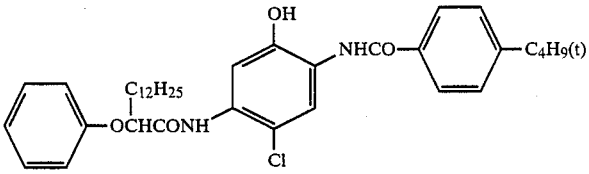
C'-80
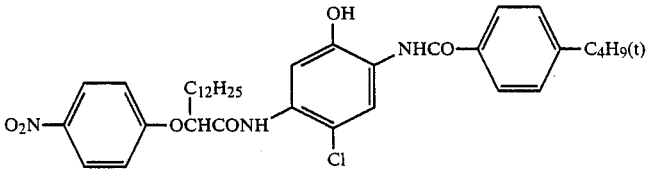

-continued
C'-81
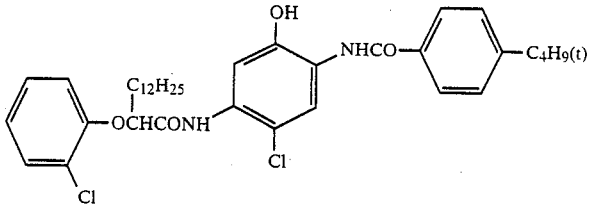
C'-82
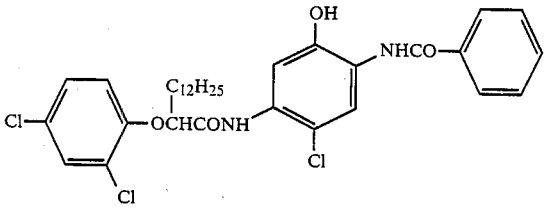
C'-83
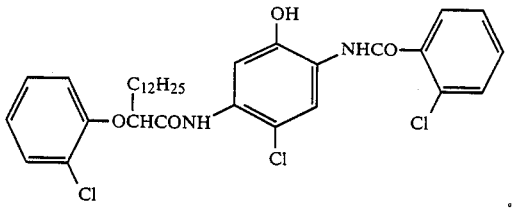
C'-84
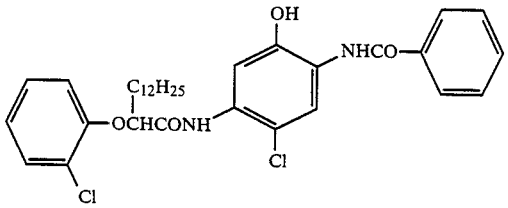
C'-85
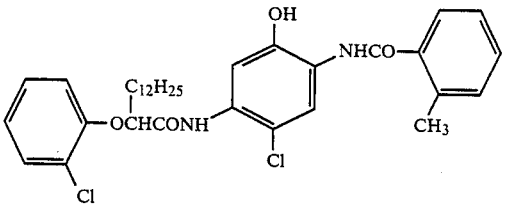
C'-86
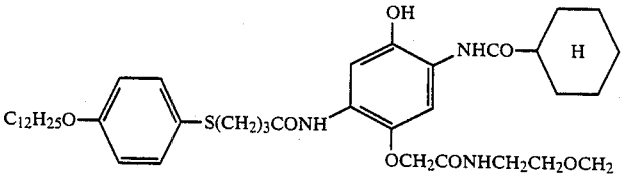
C'-87
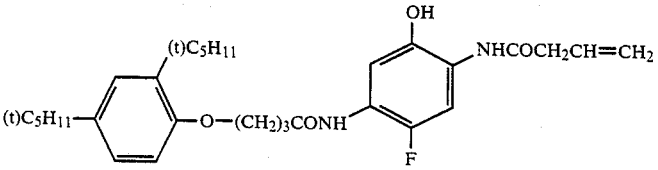

-continued
C'-88
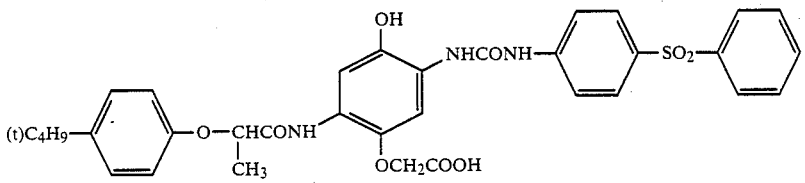
C'-89
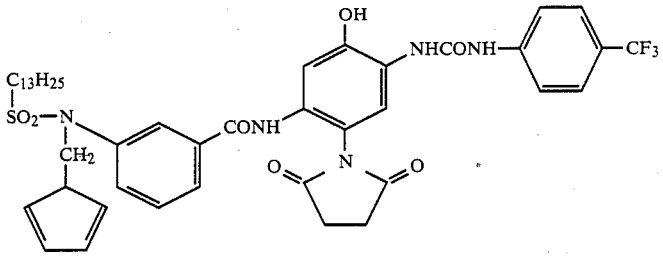
C'-90
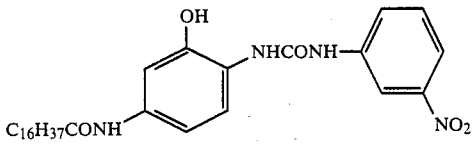
C'-91
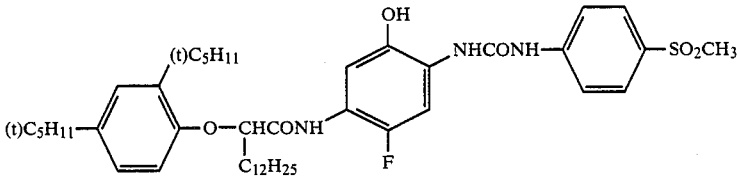
C'-92
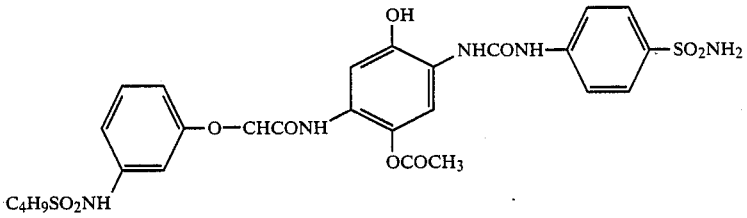
C'-93
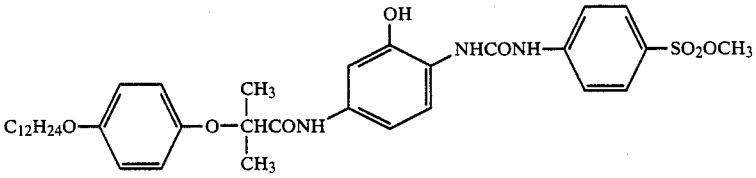
C'-94
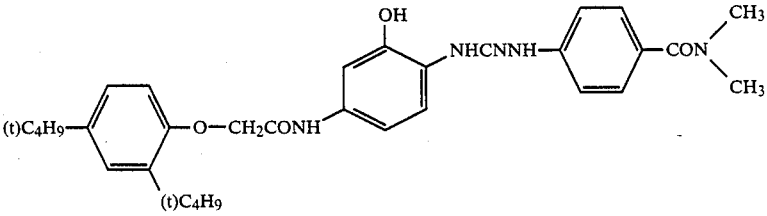

-continued

C'-95

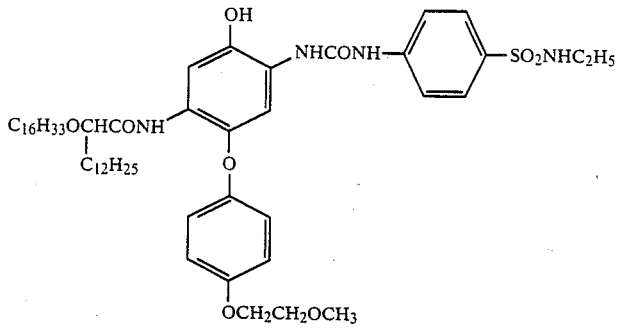

C'-96

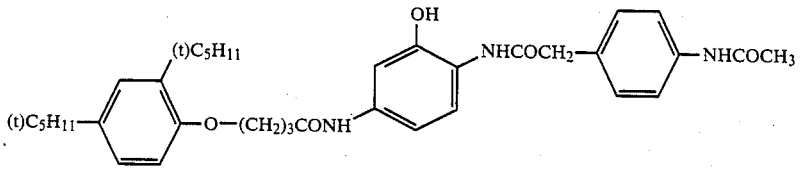

C'-97

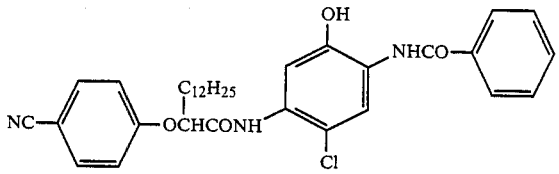

C'-98

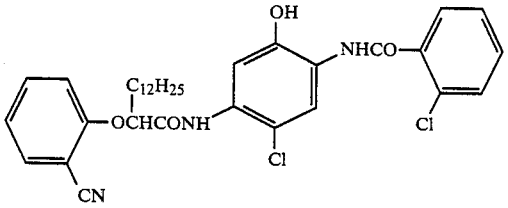

C'-99

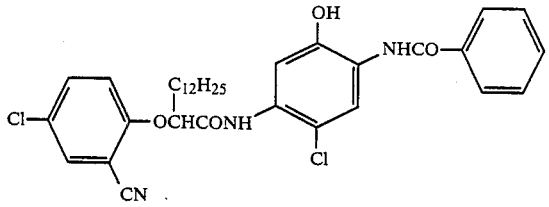

C'-100

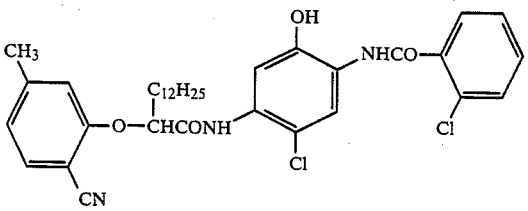

These cyan couplers can be synthesized by the known method, and for example, they can be synthesized by the methods as disclosed in U.S. Pat. Nos. 2,772,162, 3,758,308, 3,880,661, 4,124,396, 3,222,176, 975,773, 8,016,93 and 8,011,694; KOKAI Nos. 21139/1972, 112038/1975, 163537/1980, 29235/1981, 99341/1980, 116030/1981, 69329/1977, 55945/1981, 80045,1981 and 134644/1975; British Pat. Nos. 975,775 and 1,011,940; U.S. Pat. Nos. 3,446,622 and 3,996,253; KOKAI Nos. 131312/1981, 131313/1981, 131314/1981, 131309/1981, 131311/1981, 149791/1982, 130459/1981, 146050/1984, 19650/1984, 24547/1985, 35731/1985, 37557/1985 and so on.

In the present invention, the cyan couplers represented by the formula (C), (C-I) or (C-II) may be used in combination with the conventionally known cyan couplers so long as it does not contradict to the object of the present invention. Further, the cyan couplers represented by formulae (C), (C-I) and (C-II) may be used in combination therewith.

The cyan couplers represented by formulae (C) to (C-III) in accordance with the present invention is typically used in an amount of about 0.005 to 2 moles, preferably 0.01 to 1 mole per one mole of silver.

The other cyan couplers than those represented by formula (C), (C-I) or (C-II), which other cyan couplers may optionally be used as photographic couplers, may preferably by phenol series compounds and naphthol compounds, e.g., those as disclosed in U.S. Pat. Nos. 2,369,929, 2,434,272, 2,474,293, 2,895,826, 3,253,924, 3,034,892, 3,311,476, 3,386,301, 3,419,390, 3,458,315, 3,476,563, 3,531,383 and so on. Synthesis methods for these compounds have also been described in these references.

As other photographic magenta couplers than those represented by formula (M), there may be mentioned a pyrazolone series compound, a pyrazolotriazole series compound, a pyrazolinobenzimidazole series compound, on indazolone series compound and so on.

As the pyrazolone series magenta couplers, there may be mentioned the compounds descrebed in U.S. Pat. Nos. 2,600,788, 3,062,653, 3,127,269, 3,311,476, 3,419,391, 3,519,429, 3,558,318, 3,684,514 and 3,888,680; KOKAI Nos. 29639/1974, 111631/1974, 129538/1974 and 13041/1975; KOKOU Nos. 47167/1978, 10491/1979 and 30615/1980.

As the pyrazolotriazole series magenta coupler, there may be mentioned the couplers as described in U.S. Pat. No. 1,247,493; and Belgium Pat. No. 792,525.

As the non-diffusable colored magenta coupler, there may generally be employed a compound which possesses an arylazo substituent at the coupling site of a colorless magenta coupler. As such compounds, there may be mentioned those as disclosed in, for example, U.S. Pat. Nos. 2,801,171, 2,983,608, 3,005,712 and 3,684,514; British Patent No. 937,621; KOKAI Nos. 123625/1974 and 31448/1974.

Further, there may also be used a colored magenta coupler of the type of which the dye elutes out in the processing solution by the reaction with an oxidized product of the color developing agent, as described in U.S. Pat. No. 3,419,391.

As the photographic yellow coupler, while there have conventionally been used open-chain ketomethine compounds, a benzoylacetanilide type yellow coupler and a pynaloylacetanilide type yellow coupler, which have generally and widely been employed, may be used in the present invention. There may advantageously be employed a two equivalent type yellow coupler in which the carbon atom at the coupling site has been substituted by a substituent which is eliminable at the time of coupling reaction. These examples have been described, together with their synthesis methods, in U.S. Pat. Nos. 2,875,057, 3,265,506, 3,664,841, 3,408,194, 3,277,155, 3,447,928 and 3,415,652; KOKOU NO. 13576/1974; KOKAI Nos. 29432/1973, 68834/1973, 10736/1974, 122335/1974, 28834/1975 and 132926/1975.

The amount of the above-mentioned non-diffusible to be used in the present invention may generally be in the range of 0.05 to 2.0 moles per one mole of silver in the light-sensitive silver halide emulsion.

In the present invention, besides the above mentioned non-diffusible coupler, a DIR compound may preferably be employed.

Further, in addition to the DIR compound, there may also be used in the present invention a compound capable of releasing a development inhibitor in the course of the development, which includes, for example, those described in, for example, U.S. Pat. Nos. 3,297,445 and 3,379,529; German Offenlegungsschrift No. 24 17 914; KOKAI Nos. 15271/1977, 9116/1978, 123838/1984 and 127038/1984.

The DIR compound to be used in the present invention is a compound capable of releasing a development inhibitor by the reaction with an oxidized product of a color developing agent.

As a representative compound for such DIR compounds, there may be mentioned a DIR coupler having introduced, at the active site of the coupler, a group capable of forming a compound having development inhibiting effect when it is eliminated from the active site. Such compounds have been described in, for example, British Pat. No. 935,454; U.S. Pat. Nos. 3,227,554, 4,095,984 and 4,149,886.

The above-mentioned DIR coupler has such properties that the coupler nucleus forms a dye and, on the other hand, the coupler releases a development inhibitor, at the time when the coupler has undergone coupling reaction with an oxidized product of a color developing agent.

Furthermore, in the present invention, there may also be used a compound which releases a development inhibitor and does not form any dye when it has undergone coupling reaction with an oxidized product of a color developing agent, as described in U.S. Pat. Nos. 3,652,345, 3,928,041, 3,958,993, 3,961,959 and 4,052,213; KOKAI Nos. 110529/1978, 13333/1979 and 161237/1980.

Moreover, so-called DIR compound, as disclosed in KOKAI Nos. 145135/1979, 114946/1981 and 154234/1982, of which the nucleus forms a dye or a colorless compound when it has reacted with an oxidized product of a color developing agent and the eliminated timing group releases a development inhibitor through the intramolecular nucleophilic substitution reaction or the elimination reaction, may also be employed in the present invention.

The present invention may also include a timing DIR compound having the above-mentioned timing group connected with the coupler nucleus which forms a completely deffusible dye when it has reacted with an oxidezed product of a color developing agent.

The DIR compound contained in the light-sensitive material according to the present invention may preferably be used in an amount of $1\times10^{-4}$ to $1\times10^{-1}$ mole per one mole of silver.

The light-sensitive silver halide color photographic material according to the present invention may be incorporated with other various kinds of photographic additives. For instance, there may be used, as such additives, an antifogging agent, a stabilizer, a ultraviolet absorber, an anti-staining agent, a fluorescent-brightening agent, an antifading agent, an antistatic agent, a film-hardening agent, a surface active agent, a plasticizer, a wetting agent and so on.

In the light-sensitive silver halide color hydrophilic colloid to be employed for preparing an emulsion includes gelatin, gelatin derivatives, graft polymer of gelatin with other polymers, proteins such as albumin an casein, and any synthtic hydrophilic homopolymers and copolymers such as cellulose derivatives (e.g., hydroxyethylcellulose derivatives and carboxymethylcelbulose derivatives), starch derivatives, poly(vinyl alcohol), poly(vinylimidazole), polyacrylamide and so on.

As the support for the light-sensitive silver halide color photographic material to be used in the present invention, there may be mentioned, for example, a baryta paper, a polyethylene-coated paper, a polypropylene synthetic paper, a transparent support which has a reflective layer therein or uses a reflective material therewith such as glass plate, cellulose acetate, cellulose nitrate, polyester film such as polyethylene terephthalate, polyamide film, polycarbonate film, polystyrene film and so on. Other usual transparent support may also be used. These support may optionally be selected depending upon the purpose of use of the light-sensitive halide color photographic material according to the present invention.

For coating the silver halide emulsion layer and other photographic constituting layers, they may be employed various coating methods such as the dipping coating, the air-doctor coating, the curtain coating, the hopper coating and so on. There may also be employed a coating method by which two or more layers may be coated simultaneously, as disclosed in U.S. Pat. Nos. 2,761,791 and 2,941,898.

In the present invention, each emulsion layer may optionally be coated at any position.

For example, in the case of a light-sensitive material for a full-color photographic paper, layers may preferably be arranged, successively from the side of the support, in the order of a blue-sensitive silver halide emulsion layer, a green-sensitive silver halide emulsion layer and a red-sensitive silver halide emulsion layer. Each of the light-sensitive silver halide layers may consist of two or more layers.

In the light-sensitive material to be used in the present invention, it is optional to provide an intermediate layer having an appropriate thickness. Further, various layers such as a filter layer, a curl-preventing layer, a protective layer and an anti-halation layer may optionally be employed in combination.

In these constituent layers, there may also be used, as a binder, such a hydrophilic coloid as can be used in the above-mentioned emulsion layers. In these constituent layers, various photographic additives as included in the above-mentioned emulsion layers may also be incorporated.

In the method for processing a light-sensitive silver halide color photographic material according to the present invention, there may be employed, as the light-sensitive silver halide color photographic material, any light-sensitive material which contains a coupler in the emulsion and can be processed by the so-called coupler in emulsion type development system, for example, a color poper, a color negative film, a color positive film, a color reversal film for slide, a color reversal film for moving picture, a color reversal film for TV, a reversal color paper and the like.

As explained above in detail, according to the processing method of the present invention, the stability during storage of the color developing agent is excellent; stain caused by bleaching-fix can effectively be inhibited; and the photographic properties at the maximum density of color development, and thus the present invention can provide a method of processing a light-sensitive silver halide color photographic material which is suitable for quick processing.

Next, the present invention will be explained in more detail by way of the following Examples, which however should not be construed to limit the present invention.

EXAMPLE 1

On a polyethylene-laminated paper support, there was coated each of the following layers successively in the order of numbered layers viewed from the side of the support.

Layer 1: a layer containing 1.2 g/m$^2$ of gelatin, 0.42 g/m$^2$ (calculated in terms of silver, the same applies hereinafter) of a blue-sensitive silver chlorobromide emulsion (containing 95 mole % of AgCl) and $1.0\times10^{-3}$ mole/m$^2$ of below-mentioned yellow coupler (Y-1) dissolved in 0.50 g/m$^2$ of dioctyl phthalate.

Layer 2: an intermediate layer comprising of 0.6 g/m$^2$ of gelatin.

Layer 3: a layer containing 1.2 g/m$^2$ of gelatin, 0.25 g/m$^2$ of a green-sensitive silver chlorobromide emulsion (containing 98 mole % of AgCl) and $0.9\times10^{-3}$ mole/m$^2$ of below-mentioned magenta coupler (M-1) dissolved in 0.26 g/m$^2$ of dioctyl phthalate.

Layer 4: an intermediate layer comprising of 1.3 g/m$^2$ of gelatin.

Layer 5: a layer containing 1.4 g/m$^2$ of gelatin, 0.27 g/m$^2$ of a red-sensitive silver chlorobromide emulsion (containing 98 mole % of AgCl) and $1.5\times10^{-3}$ mole/m$^2$ of below-mentioned cyan coupler (C-1) dissolved in 0.20 g/m$^2$ of dibutyl phthalate.

Layer 6: a layer containing 1.0 g/m$^2$ of gelatin and 0.25 g/m$^2$ of Tinuvin 328 (a ultraviolet absorber manufactured by Ciba-Geigy AG) dissolved in 0.20 g/m$^2$ of dioctyl phthalate.

Layer 7: a layer containing 0.48 g/m$^2$ of gelatin.

Further, there was added 2,4-dichloro-6-hydroxy-s-triazin sodium as a film-hardener to Layers 2, 4 and 7 so that the amount thereof in each Layer may be 0.015 g per one gramm of gelatin.

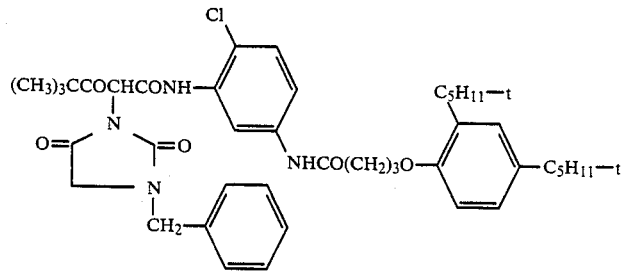

Y-1

-continued

M-1

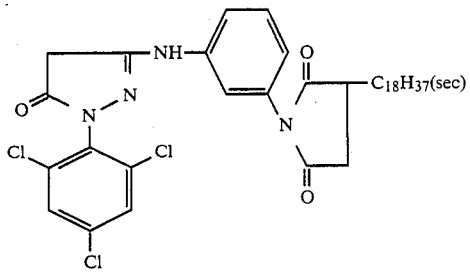

C-1

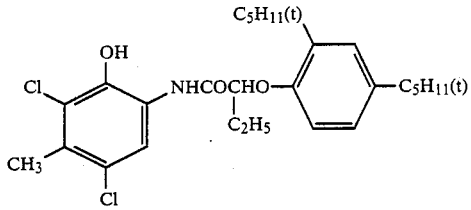

Next, these samples were wedge-exposed to light according to a conventional method and then subjected to development treatment as follows:

| Processing step | Processing temperature | Processing time |
|---|---|---|
| (1) Color development | 35° C. | 45 seconds |
| (2) Bleach-fixing | 35° C. | 45 seconds |
| (3) Water-washing | 30° C. | 90 seconds |
| (4) Drying | 60–80° C. | 60 seconds |

The color developing solution and the bleach-fixing solution employed had the following compositions, respectively.

| (Color developing solution) | |
|---|---|
| Potassium chloride | 1.0 g |
| Potassium sulfite | described in Table 1 |
| Sodium polyphosphate | 2.0 g |
| Color developing agent (Exemplified compound A-1) | 5.5 g |
| Potassium carbonate | 30 g |

Water was added to make up the solution to 1 l and the solution was adjusted to pH 10.15 by using potassium hydroxide and a 50% sulfuric acid.

| (Bleach-fixing solution) | |
|---|---|
| Ethylenediaminetetraacetic acid iron (III)ammonium dihydrate | 60.0 g |
| Ethylenediaminetetraacetic acid | 3.0 g |
| Ammonium thiosulfate (70% solution) | 100.0 ml |
| Ammonium sulfite (40% solution) | 27.5 ml |

Water was added to make up the total volume to 1 l and the solution was adjusted to pH as described in Table 1 by using potassium carbonate or glacial acetic acid.

Be noted however that 200 ml of said color developing solution was mixed with said bleach-fixing solution and the mixture was stored for two days followed by development treatment.

Samples after development treatment were measured with respect to Dmin (minimum magenta dye density) and yellow density at the portion of the highest density, by using a Sakura Photoelectric densitometer PDA-65 (manufactured by Konishiroku Photo Industry Co., Ltd.).

The results are summarized in Table 1.

TABLE 1

| Experiment No. | Sulfite ion onc. in color developing solution (mole/l) | Bleach-fixing solution (pH) | Magenta density (unexposed portion) | Yellow density (at the portion of the highest density) |
|---|---|---|---|---|
| 1 | $25 \times 10^{-3}$ | 6.0 | 0.02 | 0.84 |
| 2 | $20 \times 10^{-3}$ | 6.0 | 0.02 | 1.26 |
| 3 | $17 \times 10^{-3}$ | 6.0 | 0.02 | 1.53 |
| 4 | $14 \times 10^{-3}$ | 6.0 | 0.02 | 1.83 |
| 5 | $10 \times 10^{-3}$ | 6.0 | 0.02 | 1.85 |
| 6 | $7 \times 10^{-3}$ | 6.0 | 0.02 | 2.13 |
| 7 | $4 \times 10^{-3}$ | 6.0 | 0.02 | 2.40 |
| 8 | $3 \times 10^{-3}$ | 6.0 | 0.03 | 2.46 |
| 9 | $1 \times 10^{-3}$ | 6.0 | 0.03 | 2.51 |
| 10 | $0 \times 10^{-3}$ | 6.0 | 0.03 | 2.54 |
| 11 | $1 \times 10^{-3}$ | 4.0 | 0.12 | 2.49 |
| 12 | $1 \times 10^{-3}$ | 4.5 | 0.04 | 2.50 |
| 13 | $1 \times 10^{-3}$ | 5.0 | 0.03 | 2.50 |
| 14 | $1 \times 10^{-3}$ | 5.5 | 0.02 | 2.50 |
| 15 | $1 \times 10^{-3}$ | 6.0 | 0.03 | 2.51 |
| 16 | $1 \times 10^{-3}$ | 6.5 | 0.03 | 2.51 |
| 17 | $1 \times 10^{-3}$ | 6.8 | 0.04 | 2.50 |
| 18 | $1 \times 10^{-3}$ | 7.0 | 0.09 | 2.52 |
| 19 | $1 \times 10^{-3}$ | 7.5 | 0.15 | 2.52 |

As is apparent from Table 1, it can be understood that, in cases where the light-sensitive material according to the present invention is used and the pH value of the bleach-fixing solution is in the range of 4.5 to 6.8, yellow dye density can be obtained despite the extremely short period of time for color development of 45 seconds and generation of magenta stain at the unexposed portion is little.

Further, in cases where the sulfite ion concentration in the color developing solution is not more than $2 \times 10^{-2}$ mole/l, the magenta stain does not worsened and the yellow density is improved.

Furthermore, it should be understood that these effects are particularly good at a sulfite ion concentration of not more than $4 \times 10^{-3}$ mole/l.

EXAMPLE 2

Experiments were carred out in the same manner as in Example 1 except that the color developing agent (A-1) in the color developing solution employed in Example 1 was replaced by below-mentioned (B-1) or (B-2).

As the result, magenta stains worsened by 0.02 in each case.

Similarly, experiments were conducted in the same manner as in Example 1 except that the color developing agent (A-1) in Example 1 was replaced by Exemplified compound (A-2), (A-4) and (A-15), respectively. As the result, almost the same result as in Example 1 was obtained.

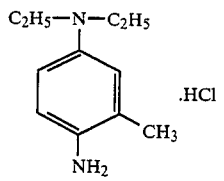

(B-1)

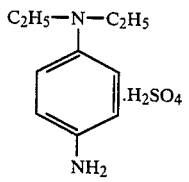

(B-2)

EXAMPLE 3

Experiments were run in the same manner as in Example 1 except that the silver halide composition of the blue-sensitive layer in the light-sensitive silver halide color photographic material used in Experiment No. 6 of Example 1 was changed to those in below-mentioned Table 2, respectively. The results are summarized in Table 2.

TABLE 2

| Example No. | Silver halide composition AgBr(mole %) | AgCl(mole %) | Yellow density at the portion of the highest density |
|---|---|---|---|
| 21 | 100 | 0 | 1.12 |
| 22 | 75 | 25 | 1.33 |
| 23 | 50 | 50 | 1.65 |
| 24 | 30 | 70 | 1.96 |
| 25 | 20 | 80 | 2.24 |
| 26 | 10 | 90 | 2.38 |
| 27 | 5 | 95 | 2.45 |
| 28 | 3 | 97 | 2.51 |
| 29 | 0 | 100 | 2.52 |

As is apparent from Table 2, it can be understood that yellow dye density is sufficient when the silver halide composition in the light-sensitive color phtographic material contains not less than 80 mole % of silver chloride, while lower silver chloride content will not bring about sufficient color density.

Further, it can be understood that better color density is obtained in cases where the silver halide contains 90 mnole % or more and especially good color density is obtained in cases where the silver halide contains more than 95 mole % of silver chloride. When the silver halide composition in the red-sensitive layer or the green-sensitive layer was varied in the same way as in the above, similar results were obtained with respect to the cyan color density and the magenta color density. In particular, in cases where the silver chloride content in all the silver halide emulsion layers is not less than 80 mole %, particularly not less than 90 mole % and especially not less than 95 mole %, it was found that all the layers given satisfactory color density to provide complete blackness.

EXAMPLE 4

Experiments were run in the same manner as in Example 1 except that there was added each of Exemplified compounds (A'-2), (A'-4) and (A'-9) (all the compounds are triazylstylbene series fluorescent-brightening agents) in an amount of 2 g/l, respectively to the color developing solution used in Example 1.

As the result, occurrence of magenta stains was improved by 0.01 to 0.02.

EXAMPLE 5

On a polyethylene-laminated paper support, there was coated each of the following layers successively in the order of numbered layers viewed from the side of the support.

Layer 1: a layer containing 1.1 g/m$^2$ of gelatin, 0.40 g/m$^2$ (calculated in terms of silver, the same applies hereinafter) of a blue-sensitive silver chlorobromide emulsion (containing 95 mole % of AgCl) and $1.0\times10^{-3}$ mole/m$^2$ of above-mentioned yellow coupler (Y-1) dissolved in 0.50 g/m$^2$ of dioctyl phthalate.

Layer 2: an intermediate layer comprising 0.6 g/m$^2$ of gelatin.

Layer 3: a layer containing 1.20 g/m$^2$ of gelatin, 0.25 g/m$^2$ of a green-sensitive silver chlorobromide emulsion (containing 98 mole % of AgCl) and $0.90\times10^{-3}$ mole/m$^2$ of above-mentioned magenta coupler (M-1) dissolved in 0.27 g/m$^2$ of dioctyl phthalate.

Layer 4: an intermediate layer comprising 1.4 g/m$^2$ of gelatin.

Layer 5: a layer containing 1.4 g/m$^2$ of gelatin, 0.37 g/m$^2$ of a red-sensitive silver chlorobromide emulsion (containing 98 mole % of AgCl) and $1.5\times10^{-3}$ mole/m$^2$ of above-mentioned cyan coupler (C-1) dissolved in 0.230 g/m$^2$ of dibutyl phthalate.

Layer 6: a layer containing 1.0 g/m$^2$ of gelatin and 0.25 g/m$^2$ of Tinuvin 328 (a ultraviolet absorber manufactured by Ciba-Geigy AG) dissolved in 0.250 g/m$^2$ of dioctyl phthalate.

Layer 7: a layer containing 0.48 g/m$^2$ of gelatin.

Further, there was added 2,4-dichloro-6-hydroxy-s-triazine sodium as a film-hardener to Layers 2, 4 and 7 so that the amount thereof in each Layer may be 0.015 g per one gramm of gelatin.

Next, these samples were wedge-exposed to light according to a conventional method and then subjected to development treatment as follows:

| | Processing step | Processing temperature | Processing time |
|---|---|---|---|
| (1) | Color development | 35° C. | 45 seconds |
| (2) | Bleach-fixing | 35° C. | 45 seconds |
| (3) | Water-washing | 30° C. | 90 seconds |
| (4) | Drying | 60–80° C. | 60 seconds |

The color developing solution and the bleach-fixing solution employed had the following compositions, respectively.

| (Color developing solution) | |
|---|---|
| Potassium chloride | 2.0 g |
| Potassium sulfite described in Table 3 | |
| Sodium polyphosphate | 2.0 g |
| Color developing agent (Exemplified compound A - 1) | 5.6 g |
| Potassium carbonate | 30 g |
| The compound of general formula (I) (described in Table 3) | 15 g |

Water was added to make up the solution to 1 l and the solution was adjusted to pH 10.15 by using potassium hydroxide and a 50% sulfuric acid.

| (Bleach-fixing solution) | |
|---|---|
| Ethylenediaminetetraacetic acid iron (III) ammonium dihydrate | 60.0 g |
| Ethylenediaminetetraacetic acid | 3.0 g |
| Ammonium thiosulfate (70% solution) | 100.0 ml |
| Ammonium sulfite (40% solution) | 27.5 ml |

Water was added to make up the total volume to 1 l and adjusted to pH as described in Table 3 by using potassium carbonate or glacial acetic acid.

Be noted however that $Fe^{3+}$ was added to said bleach-fixing solution in an amount of 3 ppm and the so obtained bleach-fixing solution was mixed with 250 ml of said color developing solution and the mixture was stored for 4 days at 45° C. followed by development treatment.

Samples after development treatment were measured with respect to the magenta density at the unexposed portion of which a fog would be problematic due to the high coupling speed and the yellow density at the maximum density portion of which color density is hard to appear due to the slow development speed, by using a Sakura Photoelectric Densitometer PDA-65 (manufactured by Konishiroku Photo Industry Co., Ltd.)

The results are summarized in Table 3.

TABLE 3

| Experiment No. | Sulfite ion conc. in color developing solution (mole/l) | Compound of formula (I) | Bleach-fixing solution (pH) | Magenta density (unexposed portion) | Yellow density (highest density portion) |
|---|---|---|---|---|---|
| 1 | $20 \times 10^{-3}$ | Exemplified Compound (I - 3) | 6.0 | 0.03 | 1.18 |
| 2 | $10 \times 10^{-3}$ | Exemplified Compound (I - 3) | 6.0 | 0.03 | 1.71 |
| 3 | $7 \times 10^{-3}$ | Exemplified Compound (I - 3) | 6.0 | 0.03 | 1.90 |
| 4 | $4 \times 10^{-3}$ | Exemplified Compound (I - 3) | 6.0 | 0.03 | 2.43 |
| 5 | $2 \times 10^{-3}$ | Exemplified Compound (I - 3) | 6.0 | 0.03 | 2.47 |
| 6 | $1 \times 10^{-3}$ | Exemplified Compound (I - 3) | 6.0 | 0.03 | 2.48 |
| 7 | 0 | Exemplified Compound (I - 3) | 6.0 | 0.04 | 2.49 |
| 8 | $1 \times 10^{-3}$ | Not added | 6.0 | 0.35 | 1.11 |
| 9 | $1 \times 10^{-3}$ | Exemplified Compound (I - 3) | 4.0 | 0.09 | 2.47 |
| 10 | $1 \times 10^{-3}$ | Exemplified Compound (I - 3) | 4.5 | 0.06 | 2.48 |
| 11 | $1 \times 10^{-3}$ | Exemplified Compound (I - 3) | 5.0 | 0.04 | 2.46 |
| 12 | $1 \times 10^{-3}$ | Exemplified Compound (I - 3) | 5.5 | 0.03 | 2.48 |
| 13 | $1 \times 10^{-3}$ | Exemplified Compound (I - 3) | 6.0 | 0.03 | 2.48 |
| 14 | $1 \times 10^{-3}$ | Exemplified Compound (I - 3) | 6.3 | 0.03 | 2.48 |
| 15 | $1 \times 10^{-3}$ | Exemplified Compound (I - 3) | 6.5 | 0.03 | 2.50 |
| 16 | $1 \times 10^{-3}$ | Exemplified Compound (I - 3) | 6.8 | 0.05 | 2.49 |
| 17 | $1 \times 10^{-3}$ | Exemplified Compound (I - 3) | 7.0 | 0.11 | 2.48 |
| 18 | $1 \times 10^{-3}$ | Exemplified Compound (I - 3) | 7.5 | 0.13 | 2.47 |
| 19 | $1 \times 10^{-3}$ | Exemplified Compound (I - 2) | 6.0 | 0.03 | 2.48 |
| 20 | $1 \times 10^{-3}$ | Exemplified Compound (I - 7) | 6.0 | 0.03 | 2.46 |
| 21 | $1 \times 10^{-3}$ | Exemplified Compound (I - 15) | 6.0 | 0.03 | 2.49 |

As a apparent from Table 3, it can be understood that, in cases where the concentration of sulfite irons in the color developing solution is in the range of not more than $4 \times 10^{-3}$ mole/l, the color developing solution contains the compound of the above-mentioned general formula (I) according to the present invention and the pH value of the bleach-fixing solution is in the range of 4.5 to 6.8, sufficient yellow dye density can be obtained despite the extremely short period of time for color development of 45 seconds and generation of magenta stain at the unexposed portion is little.

However, in cases where the sulfite ion concentration in the color developing solution, the existence or non-existence of the compound of the above-mentioned general formula [I] according to the present invention, the pH value in the bleach-fixing solution are outside the scope of the present invention, yellow dye density is insufficient, large amounts of magenta stains occur and the commercial value of the product is decreased.

Further, upon examination of the color developing solution after storage, tar was caused in cases where any compound of the above-mentioned general formula (I).

EXAMPLE 6

Experiments were run in the same manner as in Example 5 except that the color developing agent (A-1) in the color developing solution employed in Example 5 was replaced by above-mentioned (B-1) or (B-2).

As the result, magenta stain at the unexposed portion worsened by 0.02 in each case.

Similarly, experiments were conducted in the same manner as in Example 5 except that the color developing agent (A-1) in Example 5 was replaced by Exemplified compound (A-2), (A-4) and (A-15), respectively. As the result, almost the same result as in Example 5 was obtained.

EXAMPLE 7

Experiments were run in the same manner as in Example 5 except that the silver halide composition of the blue-sensitive layer in the light-sensitive silver halide color photographic material employed in Experiment No. 6 of Example 5 was changed to those in below-mentioned Table 4, respectively. The results are summarized in Table 4.

TABLE 4

| Example No. | Silver halide composition AgBr(mole %) | AgCl(mole %) | Yellow density at the portion of the highest density |
|---|---|---|---|
| 21 | 100 | 0 | 1.08 |
| 22 | 75 | 25 | 1.27 |
| 23 | 50 | 50 | 1.64 |
| 24 | 30 | 70 | 1.93 |
| 25 | 20 | 80 | 2.24 |
| 26 | 10 | 90 | 2.35 |
| 27 | 5 | 95 | 2.41 |
| 28 | 3 | 97 | 2.50 |
| 29 | 0 | 100 | 2.51 |

As is apparent from Table 4, it can be understood that yellow dye density is sufficient when the silver halide composition in the light-sensitive color phtographic material contains not less than 80 mole % of silver chloride, while a lower silver chloride content than 80 mole % will not bring about sufficient color density.

Further, it can be understood that better color density is obtained in cases where the silver halide contains 90 mole % or more and especially good color density can be obtained in cases where the silver halide contains more than 95 mole % of silver chloride. When the silver halide composition in the red-sensitive layer or the green-sensitive layer was varied in the same way as in the above, similar results were obtained with respect to the cyan color density and the magenta color density. In particular, in cases where the silver chloride content in all the silver halide emulsion layers is not less than 80 mole %, particularly not less than 90 mole % and especially not less than 95 mole %, it was found that all the layers give satisfactory color density to provide complete blackness.

EXAMPLE 8

Experiments were run in the same manner as in Example 5 except that there was added each of Exemplified compounds (A'-2), A'-4) and (A'-9) (all the compounds are triazylstylbene series fluorescent-brightening agents) in an amount of 2 g/l, respectively to the color developing solution used in Example 5.

As the result, occurrence of magenta stains was improved by 0.01 to 0.02.

EXAMPLE 9

On a polyethylene-laminated paper support, there was coated each of the following layers successively in the order of numbered layers viewed from the side of the support.

Layer 1: a layer containing 1.3 g/m$^2$ of gelatin, 0.37 g/m$^2$ (calculated in terms of silver, the same applies hereinafter) of a blue-sensitive silver chlorobromide emulsion (containing 96 mole % of AgCl) and $1.0\times10^{-3}$ mole/m$^2$ of above-mentioned yellow coupled (Y-1) dissolved in 0.50 g/m$^2$ of dioctyl phthalate.

Layer 2: an intermediate layer consisting of 0.56 g/m$^2$ of gelatin.

Layer 3: a layer containing 1.58 g/m$^2$ of gelatin, 0.26 g/m$^2$ of a green-sensitive silver chlorobromide emulsion (containing 98 mole % of AgCl) and $1.1\times10^{-3}$ mole/m$^2$ of above-mentioned magenta coupled (M-1) dissolved in 0.36 g/m$^2$ of dioctyl phthalate.

Layer 4: an intermediate layer consisting of 1.5 g/m$^2$ of gelatin.

Layer 5: a layer containing 1.3 g/m$^2$ of gelatin, 0.26 g/m$^2$ of a red-sensitive silver chlorobromide emulsion (containing 98 mole % of AgCl) and $1.4\times10^{-3}$ mole/m2 of above-mentioned cyan coupler (C-1) dissolved in 0.20 g/m$^2$ of dibutyl phthalate.

Layer 6: a layer containing 1.0 g/m$^2$ of gelatin and 0.34 g/m$^2$ of Tinuvin 328 (a ultraviolet absorber manufactured by Ciba-Geigy AG) dissolved in 0.220 g/m$^2$ of dioctyl phthalate.

Layer 7: a layer containing 0.48 g/m$^2$ of gelatin.

Further, there was added 2,4-dichloro-6-hydroxy-s-triazine sodium as a film-hardener to Layers 2, 4 and 7 so that the amount thereof in each Layer may be 0.012 g per one gramm of gelatin.

Comparative color papers were prepared in the manner as mentioned above. Similarly, samples for experiments including samples according to the present invention and comparative samples were prepared and used by replacing magenta coupler (M-1) with the magenta couplers as shown in Table 5.

Next, these samples were wedge-exposed to light according to a conventional method and then subjected to development treatment as follows:

| | Processing step | Processing temperature | Processing time |
|---|---|---|---|
| (1) | Color development | 35° C. | 45 seconds |
| (1) | Bleach-fixing | 35° C. | 45 seconds |
| (3) | Water-washing | 30° C. | 100 seconds |
| (4) | Drying | 60–80° C. | 90 seconds |

The color developing solution and the bleach-fixing solution employed had the following compositions, respectively.

| (Color developing solution) | |
|---|---|
| Potassium chloride | 2.0 g |
| Potassium sulfite described in Table 5 | |
| Sodium polyphosphate | 2.0 g |
| Color developing agent (Exemplified compound A - 1) | 5.6 g |
| Potassium carbonate | 30 g |

Water was added to make up the solution to 1 l and the solution was adjusted to pH 10.15 by using potassium hydroxide and a 50% sulfuric acid.

| (Bleach-fixing solution) | |
|---|---|
| Ethylenediaminetetraacetic acid iron (III) ammonium dihydrate | 60.0 g |
| Ethylenediaminetetraacetic acid | 3.0 g |
| Ammonium thiosulfate (70% solution) | 100.0 ml |
| Ammonium sulfite (40% solution) | 27.5 ml |

Water was added to make up the total volume to 1 l and adjusted to pH as described in Table 5 by using potassium carbonate or glacial acetic acid.

Be noted however that $Fe^{3+}$ and $Cu^{2+}$ was added to said bleach-fixing solution in amounts of 3 ppm and 1.5 ppm, respectively, and the so obtained bleach-fixing solution was mixed with 250 ml of said color developing solution and the mixture was stored for 3 days at 45° C. followed by development treatment.

Samples after development treatment were measured with respect to the magenta density at the unexposed portion of which a fog would be problematic due to the high coupling speed and the yellow density at the maximum density portion of which color density is hard to appear due to the slow development speed, by using a Sakura Photoelectric Densitometer PDA-65 (manufactured by Konishiroku Photo Industry Co., Ltd.).

TABLE 5

| (present invention) | Sulfite ion conc. in color developing solution (mole/l) | Magenta coupler | Bleach-fixing solution (pH) | Magenta density (unexposed portion) | Yellow density (highest density portion) |
|---|---|---|---|---|---|
| 1 | $20 \times 10^{-3}$ | Exemplified Coupler (M - 5) | 6.0 | 0.03 | 1.26 |
| 2 | $10 \times 10^{-3}$ | Exemplified Coupler (M - 5) | 6.0 | 0.03 | 1.79 |
| 3 | $7 \times 10^{-3}$ | Exemplified Coupler (M - 5) | 6.0 | 0.03 | 2.08 |
| 4 | $4 \times 10^{-3}$ | Exemplified Coupler (M - 5) | 6.0 | 0.03 | 2.48 |
| 5 | $2 \times 10^{-3}$ | Exemplified Coupler (M - 5) | 6.0 | 0.03 | 2.55 |
| 6 | $1 \times 10^{-3}$ | Exemplified Coupler (M - 5) | 6.0 | 0.03 | 2.59 |
| 7 | 0 | Exemplified Coupler (M - 5) | 6.0 | 0.04 | 2.61 |
| 8 | $1 \times 10^{-3}$ | Exemplified Coupler (M - 1) | 6.0 | 0.26 | 2.57 |
| 9 | $1 \times 10^{-3}$ | Exemplified Coupler (M - 5) | 4.0 | 0.10 | 2.56 |
| 10 | $1 \times 10^{-3}$ | Exemplified Coupler (M - 5) | 4.5 | 0.05 | 2.60 |
| 11 | $1 \times 10^{-3}$ | Exemplified Coupler (M - 5) | 5.0 | 0.03 | 2.60 |
| 12 | $1 \times 10^{-3}$ | Exemplified Coupler (M - 5) | 5.5 | 0.03 | 2.60 |
| 13 | $1 \times 10^{-3}$ | Exemplified Coupler (M - 5) | 6.0 | 0.03 | 2.61 |
| 14 | $1 \times 10^{-3}$ | Exemplified Coupler (M - 5) | 6.5 | 0.03 | 2.61 |
| 15 | $1 \times 10^{-3}$ | Exemplified Coupler (M - 5) | 6.8 | 0.04 | 2.61 |
| 16 | $1 \times 10^{-3}$ | Exemplified Coupler (M - 5) | 7.0 | 0.11 | 2.61 |
| 17 | $1 \times 10^{-3}$ | Exemplified Coupler (M - 5) | 7.5 | 0.18 | 2.61 |
| 18 | $1 \times 10^{-3}$ | Exemplified Coupler (M - 18) | 6.0 | 0.03 | 2.57 |
| 19 | $1 \times 10^{-3}$ | Exemplified Coupler (M - 44) | 6.0 | 0.03 | 2.59 |
| 20 | $1 \times 10^{-3}$ | Exemplified Coupler (M - 59) | 6.0 | 0.03 | 2.59 |

As is apparent from Table 5, it can be understood that, in cases where the concentration of sulfite ions in the color developing solution is in the range of not more than $4 \times 10^{-3}$ mole/l, the color developing solution contains the compound of the above-mentioned general formula (I) according to the present invention and the pH value of the bleach-fixing solution is in the range of 4.5 to 6.8, sufficient yellow dye density can be obtained despite the extremely short period of time for color development of 45 seconds and generation of magenta stain at the unexposed portion is little.

However, in cases where the sulfite ion concentration in the color developing solution the existence or non-existence of the magenta coupler of the above-mentioned general formula (M) according to the present invention the pH value in the bleach-fixing solution are outside the scope of the present invention, yellow dye density is insufficient, large amounts of magenta stains occur and the commercial value of the product is decreased.

EXAMPLE 10

Experiments were run in the same manner as in Example 9 except that the color developing agent (A-1) in the color developing solution employed in Example 1 was replaced by above-mentioned (B-1) or (B-2).

As the result, magenta stains at the unexposed portion worsened by 0.02 in each case.

Similarly, experiments were conducted in the same manner as in Example 9 except that the color developing agent (A-1) in Example 9 was replaced by Exemplified compound (A-2), (A-4) and (A-15), respectively. As the result, almost the same result as in Example 9 was obtained.

EXAMPLE 11

Experiments were run in the same manner as in Example 9 except that the silver halide composition of the blue-sensitive layer in the light-sensitive silver halide color photographic material employed in Experiment No. 6 of Example 9 was changed to those in below-mentioned Table 6, respectively. The results are summarized in Table 6.

TABLE 6

| Example No. | Silver halide composition AgBr(mole %) | Silver halide composition AgCl(mole %) | Yellow density at the portion of the highest density |
|---|---|---|---|
| 21 | 100 | 0 | 1.13 |
| 22 | 75 | 25 | 1.40 |
| 23 | 50 | 50 | 1.68 |
| 24 | 30 | 70 | 1.83 |
| 25 | 20 | 80 | 2.24 |
| 26 | 10 | 90 | 2.40 |
| 27 | 5 | 95 | 2.54 |
| 28 | 3 | 97 | 2.61 |

TABLE 6-continued

| Example No. | Silver halide composition AgBr(mole %) | AgCl(mole %) | Yellow density at the portion of the highest density |
|---|---|---|---|
| 29 | 0 | 100 | 2.64 |

As is apparent from Table 6, it can be understood that yellow dye density is sufficient when the silver halide composition in the light-sensitive color phtographic material contains not less than 80 mole % of silver chloride, while a lower silver chloride content than 80 mole % will not bring about sufficient color density.

Further, it can be understood that better color density is obtained in cases where the silver halide contains 90 mole % or more and especially good color density will be obtained in cases where the silver halide contains more than 95 mole % of silver chloride. When the silver halide composition in the red-sensitive layer or the green-sensitive layer was varied in the same way as in the above, similar results were obtained with respect to the cyan color density and the magenta color density. In particular, in cases where the silver chloride content in all the silver halide emulsion layers is not less than 80 mole %, particularly not less than 90 mole % and especially not less than 95 mole %, it was found that all the layers give satisfactory color density to provide complete blackness.

EXAMPLE 12

Experiments were run in the same manner as in Example 9 except that there was added each of Exemplified compounds (A'-2), (A'-4) and (A'-9) (all the compounds are triazylstylbene series fluorescent-brightening agents) in an amount of 2 g/l, respectively to the color developing solution used in Example 9.

As the result, occurrence of magenta stains was improved by 0.01 to 0.02, i.e., by 20% to 40%.

EXAMPLE 13

Experiments were run in the same manner as in Example 9 except that the color developing solution used in Experiment No. 6 of Example 9 was incorporated with 0.5 g/l of Exemplified compound (B-I-2), (B-I-3) and (B-I-3). As the result, the magenta stain density was reduced by 0.01 to 0.02 and thus improved.

EXAMPLE 14

Experiments were run in the same manner as in Example 9 except that the color developing solution used in Experiment No. 6 of Example 9 was incorporated with 12 g/l of Exemplified compound (I-3) or (I-7), respectively. As the result, the color density of the color developing solution was improved and the magenta stain was reduced further by 0.01.

EXAMPLE 15

Experiments were run in the same manner as in Example 9 except that the Exemplified couper (M-5) used in Experiment No. 6 of Example 9 was replaced by (M-7), (M-22), (M-104), (M-152), (M-171) or (M-1), respectively. As the results, almost the same results as in Example 9 were obtained.

EXAMPLE 16

On a polyethylene-laminated paper support, there was coated each of the following layers successively in the order of numbered layers viewed from the side of the support.

Layer 1: a layer containing 1.2 g/m$^2$ of gelatin, 0.32 g/m$^2$ (calculated in terms of silver, the same applies hereinafter) of a blue-sensitive silver chlorobromide emulsion (containing 96 mole % of AgCl) and $1.10\times10^{-3}$ mole/m$^2$ of above-mentioned yellow coupler (Y-1) dissolved in 0.60 g/m$^2$ of dioctyl phthalate.

Layer 2: an intermediate layer comprising 0.56 g/m$^2$ of gelatin.

Layer 3: a layer containing 1.25 g/m$^2$ of gelatin, 0.26 g/m$^2$ of a green-sensitive silver chlorobromide emulsion (containing 98 mole % of AgCl) and $1.14\times10^{-3}$ mole/m$^2$ of above-mentioned magenta coupler (M-1) dissolved in 0.3 g/m$^2$ of dioctyl phthalate.

Layer 4: an intermediate layer comprising 1.15 g/m$^2$ of gelatin.

Layer 5: a layer containing 1.23 g/m$^2$ of gelatin, 0.26 g/m$^2$ of a red-sensitive silver chlorobromide emulsion (containing 98 mole % of AgCl) and $1.3\times10^{-3}$ mole/m2 of above-mentioned cyan coupler (C-1) dissolved in 0.220 g/m$^2$ of dibutyl phthalate.

Layer 6: a layer containing 1.10 g/m$^2$ of gelatin and 0.34 g/m$^2$ of Tinuvin 328 (a ultraviolet absorber manufactured by Ciba-Geigy AG) dissolved in 0.220 g/m$^2$ of dioctyl phthalate.

Layer 7: a layer containing 0.48 g/m$^2$ of gelatin.

Further, there was added 2,4-dichloro-6-hydroxy-s-triazine sodium as a film-hardener to Layers 2, 4 and 7 so that the amount thereof in each Layer may be 0.015 g per one gramm of gelatin.

Comparative color papers were prepared in the manner as mentioned above. Similarly, samples for experiments including samples according to the present invention and comparative samples were prepared and used by replacing the above-mentioned cyan coupler (C-1) with the cyan couplers as shown in Table 7.

Next, these samples were wedgewise exposed to light according to a conventional method and then subjected to development treatment as follows:

| Processing step | Processing temperature | Processing time |
|---|---|---|
| (1) Color development | 35° C. | 45 seconds |
| (2) Bleach-fixing | 35° C. | 45 seconds |
| (3) Water-washing | 30° C. | 100 seconds |
| (4) Drying | 60–80° C. | 90 seconds |

The color developing solution and the bleach-fixing solution employed had the following compositions, respectively.

| (Color developing solution) | |
|---|---|
| Potassium chloride | 2.0 g |
| Potassium sulfite | described in Table 7 |
| Sodium polyphosphate | 2.0 g |
| Color developing agent (Exemplified compound A-1) | 5.6 g |
| Potassium carbonate | 30 g |

Water was added to make up the solution to 1 l and the solution was adjusted to pH 10.15 by using potassium hydroxide and a 50% sulfuric acid.

| (Bleach-fixing solution) | |
|---|---|
| Ethylenediaminetetraacetic acid | 60.0 g |

-continued

| (Bleach-fixing solution) | |
|---|---|
| iron (III) ammonium dihydrate Ethylenediaminetetraacetic acid | 3.0 g |
| Ammonium thiosulfate (70% solution) | 100.0 ml |
| Ammonium sulfite (40% solution) | 27.5 ml |

Water was added to make up the total volume to 1 l and adjusted to the pH value as described in Table 7 by using potassium or glacial acetic acid.

Be noted however that $Cu^{2+}$ was added to said bleach-fixing solution in an amount of 3 ppm and the so obtained bleach-fixing solution was mixed with 250 ml of said color developing solution and the mixture was stored for 3 days at 45° C. followed by development treatment.

Samples after development treatment were measured with respect to the cyan density at the unexposed portion the magenta density at the unexpected portion of which a fog would be problematic due to the high coupling speed and the yellow density at the maximum density portion of which color density is hard to appear due to the slow development speed, by using a Sakura Photoelectric Densitometer PDA-65 (manufactured by Konishiroku Photo Industry Co., Ltd.).

TABLE 7

| Experiment No. | Sulfite ion conc. in color developing solution (mole/l) | Cyan coupler | Bleach-fixing solution (pH) | Magenta density (unexposed portion) | Yellow density (highest density portion) | Cyan density (unexposed portion) |
|---|---|---|---|---|---|---|
| 1 | $120 \times 10^{-3}$ | Exemplified Coupler C-8 | 6.0 | 0.04 | 1.31 | 0.04 |
| 2 | $210 \times 10^{-3}$ | Exemplified Coupler C-8 | 6.0 | 0.04 | 2.81 | 0.04 |
| 3 | $37 \times 10^{-3}$ | Exemplified Coupler C-8 | 6.0 | 0.04 | 1.12 | 0.04 |
| 4 | $44 \times 10^{-3}$ | Exemplified Coupler C-8 | 6.0 | 0.04 | 2.51 | 0.03 |
| 5 | $2 \times 10^{-3}$ | Exemplified Coupler C-8 | 6.0 | 0.04 | 2.60 | 0.02 |
| 6 | $1 \times 10^{-3}$ | Exemplified Coupler C-8 | 6.0 | 0.04 | 2.62 | 0.02 |
| 7 | 0 | Exemplified Coupler C-8 | 6.0 | 0.06 | 2.66 | 0.02 |
| 8 | $1 \times 10^{-3}$ | Exemplified Coupler C-1 | 6.0 | 0.32 | 2.61 | 0.15 |
| 9 | $1 \times 10^{-3}$ | Exemplified Coupler C-8 | 4.0 | 0.16 | 2.60 | 0.16 |
| 10 | $1 \times 10^{-3}$ | Exemplified Coupler C-8 | 4.5 | 0.06 | 2.64 | 0.05 |
| 11 | $1 \times 10^{-3}$ | Exemplified Coupler C-8 | 5.0 | 0.04 | 2.64 | 0.04 |
| 12 | $1 \times 10^{-3}$ | Exemplified Coupler C-8 | 5.5 | 0.04 | 2.63 | 0.03 |
| 13 | $1 \times 10^{-3}$ | Exemplified Coupler C-8 | 6.0 | 0.04 | 2.62 | 0.02 |
| 14 | $1 \times 10^{-3}$ | Exemplified Coupler C-8 | 6.5 | 0.04 | 2.63 | 0.02 |
| 15 | $1 \times 10^{-3}$ | Exemplified Coupler C-8 | 6.8 | 0.05 | 2.62 | 0.03 |
| 16 | $1 \times 10^{-3}$ | Exemplified Coupler C-8 | 7.0 | 0.14 | 2.62 | 0.05 |
| 17 | $1 \times 10^{-3}$ | Exemplified Coupler C-8 | 7.5 | 0.22 | 2.63 | 0.11 |
| 18 | $1 \times 10^{-3}$ | Exemplified Coupler C-2 | 6.0 | 0.04 | 2.60 | 0.03 |
| 19 | $1 \times 10^{-3}$ | Exemplified Coupler C-9 | 6.0 | 0.04 | 2.61 | 0.03 |
| 20 | $1 \times 10^{-3}$ | Exemplified Coupler | 6.0 | 0.04 | 2.59 | 0.03 |

TABLE 7-continued

| Experiment No. | Sulfite ion conc. in color developing solution (mole/l) | Cyan coupler | Bleach-fixing solution (pH) | Magenta density (un-exposed portion) | Yellow density (highest density portion) | Cyan density (un-exposed portion) |
|---|---|---|---|---|---|---|
| | | C-15 | | | | |

As is apparent from Table 7, it can be understood that, in cases where the concentration of sulfite ions in the color developing solution is in the range of not more than $4\times10^{-3}$ mole/l, the light-sensitive material according to the present invention contains the compound of the above-mentioned general formula (C) according to the present invention and the pH value of the bleach-fixing solution is in the range of 4.5 to 6.8, sufficient yellow dye density can be obtained despite the extremely short period of time for color development of 45 seconds and generation of magenta stain at the unexposed portion is little.

However, in cases where the sulfite ion concentration in the color developing solution the existence or non-existence of the cyan coupler the above-mentioned general formula (C) according to the present invention the pH value in the bleach-fixing solution are outside the scope of the present invention, yellow dye density is insufficient, large amounts of magenta stains occur and the commercial value of the product is decreased.

EXAMPLE 17

Experiments were run in the same manner as in Example 16 except that the color developing agent (A-1) in the color developing solution employed in Example 16 was replaced by the above-mentioned (B-1) or (B-2).

As the result, magenta stain at the unexposed portion worsened by 0.02 in each case.

Similarly, experiments were conducted in the same manner as in Example 16 except that the color developing agent (A-1) in Example 1 was replaced by Exemplified compound (A-2), (A-4) and (A-15), respectively. As the result, almost the same result as in Example 16 was obtained.

EXAMPLE 18

Experiments were run in the same manner as in Example 16 except that the silver halide composition of the blue-sensitive layer in the light-sensitive silver halide color photographic material employed in Experiment No. 6 of Example 16 was changed to those in below-mentioned Table 8, respectively. The results are summarized in Table 2.

TABLE 8

| Example No. | Silver halide composition AgBr(mole %) | AgCl(mole %) | Yellow density at the portion of the highest density |
|---|---|---|---|
| 21 | 100 | 0 | 1.21 |
| 22 | 75 | 25 | 1.44 |
| 23 | 50 | 50 | 1.70 |
| 24 | 30 | 70 | 1.92 |
| 25 | 20 | 80 | 2.31 |
| 26 | 10 | 90 | 2.51 |
| 27 | 5 | 95 | 2.60 |
| 28 | 3 | 97 | 2.62 |
| 29 | 0 | 100 | 2.69 |

As is apparent from Table 8, it can be understood that yellow dye density is sufficient when the silver halide composition in the light-sensitive color phtographic material contains not less than 80 mole % of silver chloride, while a lower silver chloride content than 80 mole % will not bring about sufficient color density.

Further, it can be understood that better color density is obtained in cases where the silver halide contains 90 mole % or more and especially good color density will be obtained in cases where the silver halide contains more than 95 mole % of silver chloride. When the silver halide composition in the red-sensitive layer or the green-sensitive layer was varied in the same way as in the aboove, similar results were obtained with respect to the cyan color density and the magenta color density. In particular, in cases where the silver chloride content in all the silver halide emulsion layers is not less than 80 mole %, particularly not less than 90 mole % and especially not less than 95 mole %, it was found that all the layers give satisfactory color density to provide complete blackness.

EXAMPLE 19

Experiments were run in the same manner as in Example 16 except that there was added each of Exemplified compounds (A'-2), (A'-4) and (A'-9) (all the compounds are triazylstylbene series fluorescent-brightening agents) in an amount of 2 g/l, respectively to the color developing solution used in Example 16.

As the result, occurrence of magenta stain was reduced by 0.01 to 0.02, i.e., by 20% to 40% and thus improved.

EXAMPLE 20

Experiments were run in the same manner as in Example 16 except that the color developing solution used in Experiment No. 6 of Example 16 was incorporated with 12 g/l of Exemprified compound (I-1), (I-5) or (I-2), respectively. Upon measurement of the amount of the color developing agent remaining in the color developing solution after storage, the degradation rate there of was improved by 3 to 4%. The magenta density (stain) was also reduced further by 0.01.

EXAMPLE 21

Experiments were run in the same manner as in Example 16 except that the color developing solution used in Experiment No. 6 of Example 16 was incorporated with 0.5 g/l of Exemprified compound (B-I-2), (B-I-3) and (B-II-3). As the result, the magenta stain density was reduced by 0.01 to 0.02 and thus improved.

EXAMPLE 22

Experiments were run in the same manner as in Example 16 except that the color developing solution used in Experiment No. 6 of Example 1 was incorporated with 12 g/l of Exemprified compound (I-3) or (I-7), respectively. As the result, the color density of the color developing solution was improved and the magenta stain was reduced further by 0.01.

EXAMPLE 23

Experiments were run in the same manner as in Example 16 except that Exemplified cyan coupler (C-1) used in Experiment No. 6 of Example 16 was replaced by (C-20), (C-23), (C-27) or (C-12), respectively. As the results, almost the same results as in Example 1 were obtained.

EXAMPLE 24

On a polyethylene-laminated paper support, there was coated each of the following layers successively in the order of numbered layers viewed from the side of the support.

Layer 1: a layer containing 1.3 g/m$^2$ of gelatin, 0.35 g/m$^2$ (calculated in terms of silver, the same applies hereinafter) of a blue-sensitive silver chlorobromide emulsion (containing 96 mole % of AgCl) and $1.0\times10^{-3}$ mole/m$^2$ of above-mentioned yellow coupler (Y-1) dissolved in 0.60 g/m$^2$ of dioctyl phthalate.

Layer 2: an intermediate layer consisting of 0.52 g/m$^2$ of gelatin.

Layer 3: a layer containing 1.2 g/m$^2$ of gelatin, 0.24 g/m$^2$ of a green-sensitive silver chlorobromide emulsion (containing 97 mole % of AgCl) and $1.2\times10^{-3}$ mole/m$^2$ of above-mentioned magenta coupler (M-1) dissolved in 0.3 g/m$^2$ of dioctyl phthalate.

Layer 4: an intermediate layer consisting of 1.2 g/m$^2$ of gelatin.

Layer 5: a layer containing 1.2 g/m$^2$ of gelatin, 0.24 g/m$^2$ of a red-sensitive silver chlorobromide emulsion (containing 98 mole % of AgCl) and $1.2\times10^{-3}$ mole/m$^2$ of above-mentioned cyan coupler (C-1) dissolved in 0.22 g/m$^2$ of dibutyl phthalate.

Layer 6: a layer containing 1.2 g/m$^2$ of gelatin and 0.32 g/m$^2$ of Tinuvin 328 (a ultraviolet absorber manufactured by Ciba-Geigy AG) dissolved in 0.21 g/m$^2$ of dioctyl phthalate.

Layer 7: a layer containing 0.45 g/m$^2$ of gelatin.

Further, there was added 2,4-dichloro-6-hydroxy-s-triazine sodium as a film-hardener to Layers 2, 4 and 7 so that the amount thereof in each Layer may be 0.012 g per one gramm of gelatin.

Comparative color papers were prepared in the manner as mentioned above. Similarly, samples for experiments including samples according to the present invention and comparative samples were prepared and used by replacing cyan coupler coupler (C-1) with the cyan couplers as shown in Table 9.

Next, these samples were wedge-exposed to light according to a conventional method and then subjected to development treatment as follows:

| Processing step | Processing temperature | Processing time |
|---|---|---|
| (1) Color development | 35° C. | 45 seconds |
| (2) Bleach-fixing | 35° C. | 45 seconds |
| (3) Water-washing | 30° C. | 100 seconds |
| (4) Drying | 60–80° C. | 70 seconds |

The color developing solution and the bleach-fixing solution employed had the following compositions, respectively.

| (Color developing solution) | |
|---|---|
| Potassium chloride | 2.0 g |
| Potassium sulfite | described in Table 9 |
| Sodium polyphosphate | 2.0 g |
| Solor developing agent (Exemplified compound A-1) | 5.6 g |
| Potassium carbonate | 30 g |

Water was added to make up the solution to 1 l and the solution was adjusted to pH 10.15 by using potassium hydroxide and a 50% sulfuric acid.

| (Bleach-fixing solution) | |
|---|---|
| Ethylenediaminetetraacetic acid iron (III) ammonium dihydrate | 60.0 g |
| Ethylenediaminetetraacetic acid | 3.0 g |
| Ammonium thiosulfate (70% solution) | 100.0 ml |
| Ammonium sulfite (40% solution) | 27.5 ml |

Water was added to make up the total volume to 1 l and adjusted to the pH as described in Table 9 by using potassium carbonate or glacial acetic acid.

Provided however that said color developing solution was incorporated with 0.3 ml of said bleach-fixing solution per 1 l and 1 ppm of $Cu^{2+}$ and said bleach-fixing solution is incorporated with 250 ml of said color developing solution, followed by storage for 3 days at 45° C. and then color development treatment.

Samples after development treatment were measured with respect to the cyan density, the magenta density at the unexposed portion of which a fog would be problematic due to the high coupling speed and the yellow density at the maximum density portion of which color density is hard to appear due to the slow development speed, by using a Sakura Photoelectric Densitometer PDA-65 (manufactured by Konishiroku Photo Industry Co., Ltd.).

The results are summarized in Table 9.

TABLE 9

| Experiment No. | Sulfite ion conc. in color developing solution (mole/l) | Cyan coupler | Bleach-fixing solution (pH) | Magenta density (unexposed portion) | Yellow density (highest density portion) | Cyan density (unexposed portion) |
|---|---|---|---|---|---|---|
| 1 | $20\times10^{-3}$ | Exemplified Coupler C'-30 | 6.0 | 0.04 | 1.22 | 0.06 |
| 2 | $10\times10^{-3}$ | Exemplified Coupler C'-30 | 6.0 | 0.04 | 1.73 | 0.06 |
| 3 | $7\times10^{-3}$ | Exemplified Coupler C'-30 | 6.0 | 0.04 | 1.98 | 0.06 |
| 4 | $4\times10^{-3}$ | Exemplified Coupler | 6.0 | 0.04 | 2.31 | 0.05 |

TABLE 9-continued

| Experiment No. | Sulfite ion conc. in color developing solution (mole/l) | Cyan coupler | Bleach-fixing solution (pH) | Magenta density (un-exposed portion) | Yellow density (highest density portion) | Cyan density (un-exposed portion) |
|---|---|---|---|---|---|---|
| 5 | $2 \times 10^{-3}$ | C'-30 Exemplified Coupler | 6.0 | 0.04 | 2.42 | 0.04 |
| 6 | $1 \times 10^{-3}$ | C'-30 Exemplified Coupler | 6.0 | 0.04 | 2.45 | 0.04 |
| 7 | 0 | C'-30 Exemplified Coupler | 6.0 | 0.05 | 2.49 | 0.04 |
| 8 | $1 \times 10^{-3}$ | C'-30 Exemplified Coupler | 6.0 | 0.28 | 2.45 | 0.16 |
| 9 | $1 \times 10^{-3}$ | C-1 Exemplified Coupler | 4.0 | 0.14 | 2.42 | 0.07 |
| 10 | $1 \times 10^{-3}$ | C'-30 Exemplified Coupler | 4.5 | 0.06 | 2.46 | 0.06 |
| 11 | $1 \times 10^{-3}$ | C'-30 Exemplified Coupler | 5.0 | 0.04 | 2.45 | 0.05 |
| 12 | $1 \times 10^{-3}$ | C'-30 Exemplified Coupler | 5.5 | 0.04 | 2.44 | 0.04 |
| 13 | $1 \times 10^{-3}$ | C'-30 Exemplified Coupler | 6.0 | 0.04 | 2.45 | 0.04 |
| 14 | $1 \times 10^{-3}$ | C'-30 Exemplified Coupler | 6.5 | 0.04 | 2.47 | 0.04 |
| 15 | $1 \times 10^{-3}$ | C'-30 Exemplified Coupler | 6.8 | 0.06 | 2.47 | 0.04 |
| 16 | $1 \times 10^{-3}$ | C'-30 Exemplified Coupler | 7.0 | 0.13 | 2.47 | 0.07 |
| 17 | $1 \times 10^{-3}$ | C'-30 Exemplified Coupler | 7.5 | 0.19 | 2.48 | 0.09 |
| 18 | $1 \times 10^{-3}$ | C'-30 Exemplified Coupler | 6.0 | 0.04 | 2.43 | 0.05 |
| 19 | $1 \times 10^{-3}$ | C'-58 Exemplified Coupler | 6.0 | 0.04 | 2.46 | 0.05 |
| 20 | $1 \times 10^{-3}$ | C'-76 Exemplified Coupler | 6.0 | 0.04 | 2.47 | 0.05 |
| | | C'-61 | | | | |

As is apparent from Table 9, it can be understood that, in cases where the concentration of sulfite irons in the color developing solution is in the range of not more than $4 \times 10^{31\ 3}$ mole %/l, the color developing solution contains at least are cyan coupler of the above-mentioned general formula (C-I) or (C-II) according to the present invention and the pH value of the bleach-fixing solution is in the range of 4.5 to 6.8, sufficient yellow dye density can be obtained despite the extremely short period of time for color development of 45 seconds and generation of magenta stain at the unexposed portion is little.

However, in cases where the sulfite ion concentration in the color developing solution the existence or non-existence of the cyan coupler of the above-mentioned general formula (C-I) or (C-II) according to the present invention and the pH value in the bleach-fixing solution are outside the scope of the present invention, yellow dye density is insufficient, large amounts of magenta stains occur and the commercial value of the product is decreased.

EXAMPLE 25

Experiments were run in the same manner as in Example 24 except that the color developing agent (A-1) in the color developing solution employed in Example 24 was replaced by above-mentioned (B-1) or (B-2).

As the result, magenta stains at the unexposed portion worsened by 0.02 in each case.

Similarly, experiments were conducted in the same manner as in Example 24 except that the color developing agent (A-1) in Example 24 was replaced by Exemplified compound (A-2), (A-4) and (A-15), respectively. As the result, almost the same result as in Example 24 was obtained.

EXAMPLE 26

Experiments were run in the same manner as in Example 24 except that the silver halide composition of the blue-sensitive layer in the light-sensitive silver halide color photographic material employed in Experiment No. 6 of Example 24 was changed to those in below-mentioned Table 10, respectively. The results are summarized in Table 10.

TABLE 10

| Example No. | Silver halide composition AgBr(mole %) | AgCl(mole %) | Yellow density at the portion of the highest density |
|---|---|---|---|
| 21 | 100 | 0 | 1.13 |
| 22 | 75 | 25 | 1.43 |
| 23 | 50 | 50 | 1.71 |
| 24 | 30 | 70 | 1.83 |
| 25 | 20 | 80 | 1.95 |
| 26 | 10 | 90 | 2.35 |
| 27 | 5 | 95 | 2.38 |
| 28 | 3 | 97 | 2.45 |
| 29 | 0 | 100 | 2.51 |

As is apparent from Table 10, it can be understood that yellow dye density is sufficient when the silver halide composition in the light-sensitive color phtographic material contains not less than 80 mole % of silver chloride, while a lower silver chloride content than 80 mole % will not bring about sufficient color density.

Further, it can be understood that better color density is obtained in cases where the silver halide contains 90 mole % or more and especially good color density will be obtained in cases where the silver halide contains more than 95 mole % of silver chloride. When the silver halide composition in the red-sensitive layer or the green-sensitive layer was varied in the same way as in the aboove, similar results were obtained with respect to the cyan color density and the magenta color density. In particular, in cases where the silver chloride content in all the silver halide emulsion layers is not less than 80 mole %, particularly not less than 90 mole % and especially not less than 95 mole %, it was found that all the layers give satisfactory color density to provide complete blackness.

EXAMPLE 27

Experiments were run in the same manner as in Example 24 except that there was added each of Exemplified compounds (A'-2), (A'-4) and (A'-9) (all the compounds are triazylstylbene series fluorescent-brightening agents) in an amount of 2 g/l, respectively to the color developing solution used in Example 24.

As the result, occurrence of magenta stains was reduced by 0.01 to 0.02, i.e., by 20% to 40%.

EXAMPLE 28

Experiments were run in the same manner as in Example 24 except that color developing solution used in Experiment No. 6 of Example 24 was incorporated with 12 g/l of Exemprified compound (I-1), (I-5) or (I-2), respectively. Upon measurement of the amount of the color developing agent remaining in the color developing solution after storage, the degradation rate thereof was improved by 3 to 4%. The magenta density (stain) was also reduced further by 0.01.

EXAMPLE 29

Experiments were run in the same manner as in Example 24 except that Exemplified cyan coupler (C-1) used in Experiment No. 6 of Example 24 was replaced by (C-72), (C-2), (C-10) or (C-16), respectively. As the results, almost the same results as in Example 24 were obtained.

What is claimed is:

1. A method for processing a light-sensitive silver halide color photographic material in which a light-sensitive silver halide color photographic material having at least one silver halide emulsion layer is exposed imagewise to light and then subjected to processing including at least a color development treatment followed by a bleach-fixing treatment, the improvement wherein said at least one silver halide emulsion layer is a silver halide emulsion layer in which not less than 80 mole % of the total silver halide in the layer is silver chloride, the sulfite ion concentration in the color developing solution used in said color development treatment is not more than $4\times10^{-3}$ mole/1, and the pH value of the bleach-fixing solution used in said bleach-fixing treatment is in the range of 4.5 to 6.8.

2. The method according to claim 1, wherein the color developing solution used in said color development treatment contains an alkanolamine represented by the formula:

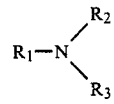

wherein $R_1$ represents a hydroxyalkyl group having 2 to 6 carbon atoms, $R_2$ and $R_3$ each represent a hydrogen atom, an alkyl group having 1 to 6 carbon atoms, a hydroxyalkyl group having 2 to 6 carbon atoms, a benzyl group or the group

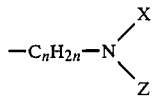

(in which n is an integer of 1 to 6, and X and Z each represent a hydrogen atom, an alkyl group having 1 to 6 carbon atoms or a hydroxyalkyl group having 2 to 6 carbon atoms).

3. The method according to claim 1, wherein the color developing agent in the color developing solution used in said color development treatment is a p-phenylenediamine series color developing agent having at least one water-soluble group.

4. The method according to claim 3, wherein said water-soluble group is selected from the group consisting of $-(CH_2)_n-CH_2OH$; $-(CH_2)_m-NHSO_2-(CH_2)_n-CH_3$; $-(CH_2)_m-O-(CH_2)_n-CH_3$; $-(CH_2CH_2O)_n-C_mH_{2m+1}$ (wherein m and n each represent zero or a positive integer; —COOH; and $-SO_3H$.

5. The method according to claim 1, wherein the color developing solution used in said color development treatment contains a triazine series fluorescent-brightening agent represented by the formula:

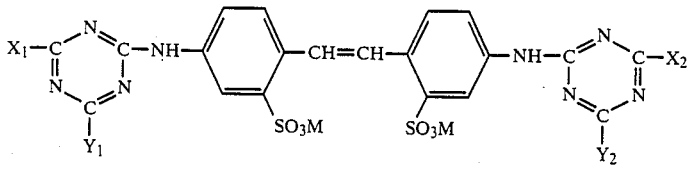

wherein $X_1$, $X_2$, $Y_1$ and $Y_2$ each represent a hydroxyl group, a halogen atom, a morpholino group, an alkoxy group, an aryloxy group, an aryl group, an amino group, an alkyl amino group or an arylamino group, and M represents a hydrogen atom, a sodium atom, a potassium atom, an ammonium group or a lithium atom.

6. The method according to claim 1, wherein said at least one silver halide emulsion layer contains a magenta coupler represented by the formula (M):

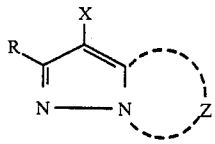

(M)

wherein Z represents a non-metallic atom group necessary for forming a nitrogen-containing heterocyclic ring which may be substituted; X represents a hydrogen atom or a substituent capable of being released by the reaction with an oxidized form of the color developing agent, and R represents a hydrogen atom or a substituent.

7. The method according to claim 1, wherein said at least one silver halide emulsion layer contains a cyan coupler represented by the formula (C)

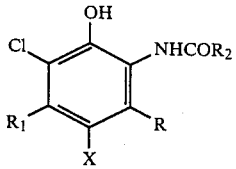

(C)

wherein one of R and $R^1$ represents a hydrogen atom and the other represents a straight-chain or branched alkyl group having 2 to 12 carbon atoms, X represents a hydrogen atom or a group capable of being released by the reaction with an oxidized form of an N-hydroxyalkyl-substituted p-phenylenediamine series color developing agent, and $R_2$ represents a ballast group.

8. The method according to claim 1, wherein said at least one silver halide emulsion layer contains at least one of the cyan couplers represented by the formula (C-I) or (C-II):

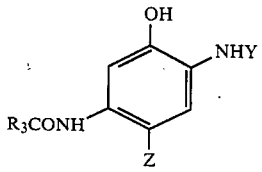

(C-I)

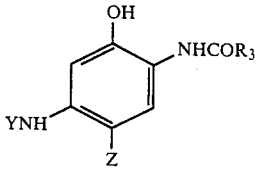

(C-II)

Y represents $-COR_4$, $-SO_2R_4$, $-CON\begin{matrix}R_4\\R_5\end{matrix}$ $-\underset{\underset{S}{\|}}{C}-N\begin{matrix}R_4\\R_5\end{matrix}$, $-SO_2N\begin{matrix}R_4\\R_5\end{matrix}$, $-CONHCOR_4$ or $-CONHSO_2R_4$ (where $R_4$ represents an alkyl group, an alkenyl group, a cycloalkyl group, an aryl group or a heterocyclic group; $R_5$ represents a hydrogen atom, an alkyl group, an alkenyl group, a cycloalkyl group, an aryl group or a heterocyclic group; and $R_4$ and $R_5$ may be bonded with each other to form a 5- or 6-membered ring); $R_3$ represents a ballast group; and Z represents a hydrogen atom or a group eliminable through the coupling reaction with the oxidized product of an aromatic primary amine series color developing agent.

* * * * *